US006183943B1

(12) United States Patent
Tanabe et al.

(10) Patent No.: US 6,183,943 B1
(45) Date of Patent: Feb. 6, 2001

(54) PROCESSING METHOD OF SILVER HALIDE PHOTOGRAPHIC LIGHT-SENSITIVE MATERIAL

(75) Inventors: Junichi Tanabe; Takeo Arai, both of Hino (JP)

(73) Assignee: Konica Corporation (JP)

( * ) Notice: Under 35 U.S.C. 154(b), the term of this patent shall be extended for 0 days.

(21) Appl. No.: 09/506,523

(22) Filed: Feb. 17, 2000

(30) Foreign Application Priority Data

Feb. 18, 1999 (JP) ..... 11-039891
Mar. 17, 1999 (JP) ..... 11-071977

(51) Int. Cl.[7] ..... G03C 5/26
(52) U.S. Cl. ..... 430/434; 430/570
(58) Field of Search ..... 430/434, 570

(56) References Cited

U.S. PATENT DOCUMENTS

| | | | |
|---|---|---|---|
| 4,779,356 | 10/1988 | Hehn | 34/114 |
| 5,298,382 | 3/1994 | Toyoda et al. | 430/539 |
| 5,460,935 | 10/1995 | Toya | 430/567 |
| 5,500,329 | 3/1996 | Kawai et al. | 430/363 |

FOREIGN PATENT DOCUMENTS 0308212 3/1989 (EP) .
0754966 1/1997 (EP) .

OTHER PUBLICATIONS

Abstract, JP 404138452, May 1992, Konica Corp.*
European Search Report EP 00 10 3524, Jun. 2000.
1 page Abstract XP–002139575.
1 page Abstract XP–002139576.
1 page Abstract XP–002139577.
1 page Abstract XP–002139578.
1 page Abstract XP–002139579.
1 page Abstract, Patent Abstracts of Japan, Publication No. 06083016, Publication date: Mar. 25, 1994.

* cited by examiner

*Primary Examiner*—Hoa Van Le
(74) *Attorney, Agent, or Firm*—Jordan B. Bierman; Bierman, Muserlian and Lucas

(57) ABSTRACT

A processing method of a silver halide photographic material in an automatic processor is disclosed, comprising the steps of developing, followed by fixing, washing and drying, in which the silver halide photographic material exhibits an absorption maximum at a wavelength of 600 to 800 nm; the automatic processor comprises at least a roller provided after completing the step of washing, the roller is brought into contact with the silver halide photographic material, and the surface of the roller is covered with a material exhibiting a contact angle with water(θ) within a range of 0°<θ<60°.

16 Claims, 2 Drawing Sheets

PROCESSING METHOD OF SILVER HALIDE PHOTOGRAPHIC LIGHT-SENSITIVE MATERIAL

FIELD OF THE INVENTION

The present invention relates to a method for processing a silver halide photographic light-sensitive material (hereinafter also referred to light-sensitive material), and particularly to a method for rapidly processing large sized light-sensitive material for graphic arts use by an automatic processor without formation of stain on the formed image.

BACKGROUND OF THE INVENTION

Recently, photographic light-sensitive materials for graphic arts are often processed by an automatic processor combined with a laser image output apparatus, a so-called image-setter. The processed light-sensitive material outputting an image output by the image-setter is often used as a final original image for printing to a lithographic printing plate. Therefore, clear images become an important property of the processed light-sensitive material.

On the other hand, the exposure by the image-setter can be rapidly performed. Accordingly, it requires shortening the time for processing by raising the transportation speed of the automatic processor to respond to the speed of the exposing process. Some problems such as adhesion of stains of remaining color and formation of roller marks on the processed light-sensitive material and jamming of the light-sensitive material, are occurring during high speed transportation and processing to correspond to the output speed of the image-setter. Such problems are markedly produced in silver halide photographic light sensitive materials having an absorption maximum at the wavelength of 600 to 800 nm. Specifically in silver halide photographic light sensitive materials containing a compound represented by formulas (1) to (6), described below, such problems occur markedly.

SUMMARY OF THE INVENTION

The object of the invention is to provide a method for processing a light-sensitive material for use in graphic arts by which the light-sensitive material can be processed without any problem such as formation of stain, residual color, unsuitable transportation and formation of roller marks even during the rapid processing so as to correspond to the output speed by the image-setter.

The object of the invention can be accomplished by the following constitution:

1. A method for processing a silver halide photographic light sensitive material in an automatic processor comprising the steps of:
   (a) developing an exposed silver halide photographic light sensitive material with a developing solution in the automatic processor,
   (b) fixing the developed silver halide photographic material with a fixing solution in the automatic processor,
   (c) washing the fixed silver halide photographic material with water in the automatic processor, and
   (d) drying the washed silver halide photographic material in the automatic processor, wherein the silver halide photographic material exhibits an absorption maximum at a wavelength of 600 to 800 nm; the automatic processor comprises at least a roller provided after completing the step of washing, the roller is brought into contact with the silver halide photographic material, and the surface of the roller is covered with a material exhibiting a contact angle with water(θ) of more than 0° and less than 60° (i.e., within the range of 0°<θ<60°);

2. The processing method described in 1 above, wherein the silver halide photographic material comprises a sensitizing dye represented by the following formulas (1) to (6):

Formula (1)

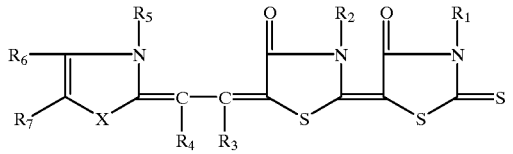

wherein X is —O—, —S— or —Se—; $R_1$, $R_2$, $R_3$, $R_4$ and $R_5$ are each an organic group and at least two of them, each has a water-solubilizing group, provided that $R_3$ and $R_4$ are not simultaneously organic groups having a water-solubilizing group, and $R_1$, $R_2$, $R_3$, $R_4$ and $R_5$ are each a hydrogen atom, an alkyl group, an alkenyl group or an aryl group when the organic group is not the group having the water-soluble group and these groups each may have a substituent; $R_6$ and $R_7$ are each a hydrogen atom, hydroxyl, a halogen atom, carboxyl, cyano, an alkyl group, an alkenyl group, an alkynyl group, an alkoxyl group, an alkylthio group, an arylthio group, an aryl group, an acyl group, an acyloxy group, an alkoxycarbonyl group, an alkylsulfonyl group, a carbamoyl group or a sulfamoyl group, the groups represented by $R_6$ or $R_7$ each may have a substituent, and $R_6$ and $R_7$ may be bonded together to form a ring;

Formula (2)

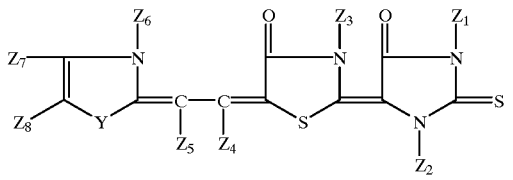

wherein Y is —O—, —S— or —$S_e$—; $Z_1$, $Z_2$, $Z_3$, $Z_4$, $Z_5$ and $Z_6$ are each an organic group and at least two of them each has a water-solubilizing group, provided that $Z_4$ and $Z_5$ are not simultaneously organic groups having a water-solubilizing group, and the organic group represented by $Z_1$, $Z_2$, $Z_3$, $Z_4$, $Z_5$ or $Z_6$ is a hydrogen atom, an alkyl group, an alkenyl group or an aryl group when the organic group is not a group having water-solubilizing group and each of which may have a substituent; and $Z_7$ and $Z_8$ are the same as $R_6$ and $R_7$ defined in Formula (1);

Formula (3)

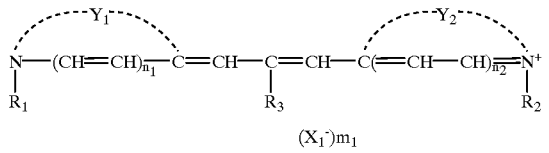

wherein $Y_1$ and $Y_2$ are each a group of non-metal atom necessary to form a benzothiazole ring, a benzoselenazole ring, a naphthothiazole ring, a naphthoselenazole ring or a quinoline ring, these heterocyclic rings each may be substituted with a lower alkyl group, an alkoxyl group, an aryl group, a hydroxyl group, an alkoxycarbonyl group or a halogen atom; $R_1$ and $R_2$ are each a lower alkyl group, an alkyl group having a sulfo group or an alkyl group having a carboxyl group; $R_3$ is a methyl group, an ethyl group or a propyl group, $X_1$ is an anion, $n_1$ and $n_2$ are each 1 or 2, $m_1$ is 1 or 0, and l is 1 or 0, provided that $m_1$ is 0 when an intramolecular salt is formed;

Formula (4)

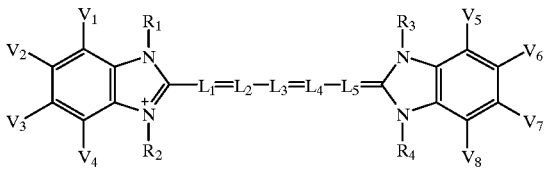

$(M_1)_l$ wherein $R_1$, $R_2$, $R_3$ and $R_4$ are each a substituted or unsubstituted aliphatic group and at least one of $R_2$ and $R_4$ has a water-solubilizing group; $V_1$, $V_2$, $V_3$, $V_4$, $V_5$, $V_6$, $V_7$ and $V_8$ are each a hydrogen atom or a substituent, $V_1$, and $V_2$, $V_2$ and $V_3$, $V_3$ and $V_4$, $V_4$ and $V_5$, $V_5$ and $V_6$, $V_6$ and $V_7$, and $V_7$ and $V_8$ each may be condensed to form a ring, the sum of Hammett's values $\sigma_p$ of $V_1$ to $V_4$, and that of $V_5$ to $V_8$ are each not less than 0.12; $L_1$, $L_2$, $L_3$, $L_4$ and $L_5$ are each a methine group; $M_1$ is an ion necessary to neutralize the intramolecular charge, and l is a number of ion necessary to neutralize the charge;

Formula (5)

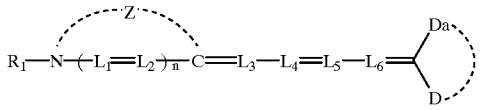

$(M_1)m_1$ wherein $R_1$ is a substituted or unsubstituted alkyl group; Z is a group of atoms necessary to form a 5- or 6-member nitrogen-containing heterocyclic ring; D and Da is a group of atoms necessary to form an acyclic or cyclic acidic nucleus; $L_1$, $L_2$, $L_3$, $L_4$, $L_5$ and $L_6$ is a methine group; $M_1$ is a counter ion necessary to neutralize the intramolecular charge, $m_1$ is a number of 0 or more necessary to neutralize the intramolecular charge, and n is 0 or 1;

Formula (6)

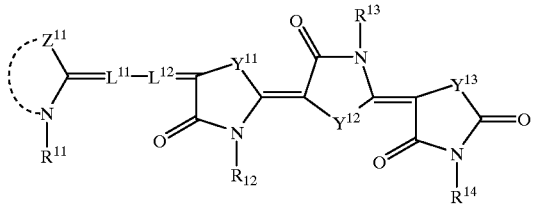

$(M^{11})n^{11}$ wherein $Y^{11}$, $Y^{12}$ and $Y^{13}$ are each —$N(R^{10})$—, an oxygen atom, a sulfur atom, a selenium atom or a tellurium atom; $R^{11}$ is an aliphatic group having 8 or less carbon atoms and having a water-solubilizing group; $R^{10}$, $R^{12}$, $R^{13}$ and $R^{14}$ are each an aliphatic group, an aryl group or a heterocyclic group and at least three of them are substituted with a water-solubilizing group; $Z^{11}$ is a group of non-metal atoms necessary to form a 5- or 6-member nitrogen-containing heterocyclic ring, which may be condensed; $L^{11}$ and $L^{12}$ are each independently a substituted or unsubstituted methine group; $M^{11}$ is an ion necessary to neutralize the total intramolecular charge and $n^{11}$ is the number of ion necessary to neutralize the charge;

3. The processing method described in 1. above, wherein the roller is provided between after completion of the step of washing and before start of the step of drying;
4. The processing method described in 1. above, wherein the roller is a squeegee roller to squeeze washing water adhered to or penetrated into the silver halide photographic material;
5. The processing method described in 1. above, wherein the roller is at least one of two opposed rollers, which is covered with a material exhibiting a contact angle with water(θ) within the range of 0°<θ<60°;
6. The processing method described in 5. above, wherein the silver halide photographic material comprises a support and a silver halide emulsion layer containing silver halide grains and provided on at least one side of the support, and the roller is brought into contact with the emulsion layer side of the silver halide photographic material;
7. The processing method described in 5 above, wherein the opposed rollers each are covered with a material exhibiting a contact angle with water(θ) within the range of 0°<θ<60°;
8. The processing method described in 1 above, wherein the silver halide photographic material comprises a hydrazine compound represented by the following formula (H):

Formula H

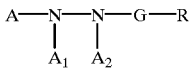

wherein A is an aryl group or a heterocyclic group containing a sulfur atom or an oxygen atom; G is —$(CO)_n$—, a sulfonyl group, a sulfoxy group, —$P(=O)R_{52}$— or an iminomethylene group, in which n is an integer of 1 or 2, and $R_{52}$ is an alkyl group, an alkenyl group, an alkynyl group, an aryl group, an alkoxyl group, an alkenyloxy group, an alkynyloxy group, an aryloxy group or an amino group, the groups represented by $R_{52}$ each may have a substituent; both of $A_1$ and $A_2$ are each a hydrogen atom or one of them is a hydrogen atom and the other one is a substituted or unsubstituted alkylsulfonyl group or a substituted or unsubstituted acyl group; R is a hydrogen atom, an alkyl group, an alkenyl group, an aryl group, an alkoxy group, an alkenyloxy group, an aryloxy group, a heterocyclicoxy group, an amino group, a carbamoyl group, or an oxycarbonyl group, and the group represented by R may have a substituent;

9. The processing method described in 1. above, wherein the steps of developing to drying are completed within a time of 15 to 60 sec.;
10. The processing method described in 3. above, wherein one or more rollers are provided in the step of drying and an initial roller thereof is brought into contact with the silver halide photographic material, and the surface of the initial roller is covered with a material exhibiting a contact angle with water(θ) of 0°<θ<60°;

11. The processing method described in 3. above, wherein one or more rollers are provided in the step of drying and at least 80% of the surface of each roller is covered with a material exhibiting a contact angle with water(θ) of 0°<θ<60°;

12. The processing method described in 1. above, wherein the fixing solution is substantially free of an aluminum compound;

13. The processing method described in 1 above, wherein the moisture content of the silver halide photographic material at the time immediately after completion of the step of washing is not more than 18 g/m$^2$;

14. The processing method described in 13. above, wherein the moisture content of the silver halide photographic material at the time immediately after passing through the roller is at least 50% by weight, based on the moisture content at the time immediately after completion of the step of washing;

15. The processing method described in 1 above, wherein the processor comprises an auxuliary roller which is brought into contact with the roller described in 1 and is not brought into contact with the silver halide photographic material;

16. The processing method described in 1 above, wherein the processor transports the silver halide photographic material at a speed of 400 to 3,000 mm/min; and 17. A method for processing a silver halide photographic light-sensitive material comprising the steps of:

developing, fixing, washing and drying a silver halide photographic light-sensitive material by an automatic processor, in which the silver halide photographic material contains a sensitizing dye represented by the foregoing formula (1), (2), (3), (4), (5), or (6), and the surface of each of squeezing rollers arranged in the course from completion of the washing step to starting of the drying step is covered with a material exhibiting a contact angle with water θ which satisfies the relation of 0°<θ<60°; the silver halide photographic light-sensitive material contains a hydrazine compound represented by Formula (H) described above, and the time from the start of the development to the completion of the drying is a time of from 15 to 60 seconds; 80% of the surface area of the first If. roller of a transportation rack in the drying process is covered with a material exhibiting a contacting angle with water θ satisfying the relation of 0°<θ<60°; 80% of the total surface area of all the rollers of a transportation rack in the drying process is covered with a material exhibiting a contacting angle with water θ satisfying the relation of 0°<θ<60°; a fixing solution used in the processing contains substantially no aluminum compound; the moisture content of the silver halide photographic light-sensitive material after developing, fixing and washing is not more than 18 g/m$^2$; and the moisture content of the silver halide photographic light-sensitive material just after passing between the squeezing rolles of each of the developing process, fixing process and washing process is not less than 50% of the moisture content of the silver halide photographic light-sensitive material after each of the processes, respectively.

DETAILED DESCRIPTION OF THE INVENTION

It was discovered by the inventors that dye stains can be reduced by controlling the wetting property of the surface of the roller, and the residual color and transportation property are improved and the line-like marks (roller marks) on the surface of the light-sensitive material caused by the roller pressure are also inhibited by a means based on the assumption that dye stains of the processed light sensitive material relates to the behavior of the water derived from the light-sensitive material on the roller.

In cases where the light-sensitive material exhibited the absorption maximum at wavelengths of 600 to 800 nm, specifically, when the light-sensitive material contained a sensitizing dye represented by formula (1), (2), (3), (4), (5) or (6), dye stains were prominent. In the invention, such stains can be reduced by controlling the property of the roller which is directly in contact with the light-sensitive material (preferably, the roller provided between after the step of washing and before the step of drying, and more preferably, being a squeezing roller). Specifically, the present invention is characterized in that the surface of the roller is covered with a material exhibiting a contact angle with water (θ) of between 0° and 60° (i.e., 0°<θ<60°).

The expression "after the step of washing" means downstream of the position at which supply of washing water to the light-sensitive material is finished. In cases where the processor has a transport rack in the drying step zone, the expression "before the step of drying" means at the front of the rack. In cases where the position of starting the drying step is not definitely specified by such a rack, the temperature of the light-sensitive material immediately after completion of washing is assumed to be α° C. and the position "before the step of drying" is to be the position immediately before the temperature in he vicinity of the light sensitive materials, preferably the temperature of the light-sensitive material reaches α plus 30° C.

It is preferred that at least 80% of the surface of the roller (more preferably, at least 95%) is covered with a material exhibiting a contact angle with water satisfying the relationship of 0°<θ<60°. The roller is preferably opposite roller type, comprising two rollers opposite to each other. The surface of one of the opposed rollers, which is brought into contact with the emulsion layer side of the light-sensitive material, is preferably covered with a material exhibiting a water contact angle (θ) of 0°<θ<60°, and more preferably, the surface of both of the opposite rollers is covered with material exhibiting a water contact angle (θ) of 0°<θ<60°.

Figure 1:
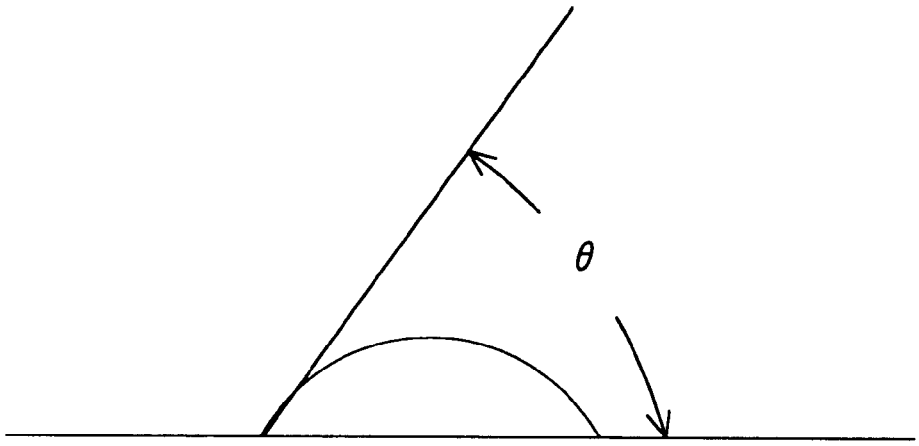
FIG. 1 illustrates a contact angle according to an embodiment of the invention.

Herein, a squeezing roller refers to a roller to squeeze washing water adhered to, or penetrated into the light-sensitive material after completion of washing. In general, the contact angle is defined as the angle (θ) between a liquid and the surface of a solid material at the line of contact, as illustrated in FIG. 1. Thus, the contact angle with water (i.e., a water contact angle) means the angle of contact between water and the surface of the material.

Further, in addition to the roller (preferably, squeezing roller) provided between after the step of washing and before the step of drying, it is preferred that at least 80% of the surface of the first roller (or initial roller) during the drying stage is covered with a material exhibiting a contact angle (θ) with water within the range of $0°<\theta<60°$. It is more preferred that at least 80% of the surface of all of rollers provided in the drying step zone (preferably, all rollers of a transport rack during the drying step zone) is covered with a material exhibiting a water contact angle (θ) within the range of $0°<\theta<60°$.

An auxiliary roller which is brought into contact with the roller described above but not in contact with the light-sensitive material may be provided in the processor. Such an embodiment will be described later. Even in cases where the surface of a roller (preferably, a squeezing roller)provided between after the step of washing and before the step of drying is covered with a material exhibiting a water contact angle (θ) of $0°<\theta<60°$, the dye stains can be effectively inhibited by providing the auxiliary roller which is brought into contact with the roller described above but not in contact with the light-sensitive material itself.

The contact angle of the material of the roller surface can be usually controlled by selecting the chemical composition of the surface. For example, the contact angle with water is made larger when the critical surface tension at the roller surface is made smaller. Examples of the material effectively usable for controlling the critical surface tension include phenol resin (Bakelite), silicone rubber, rubber and fluorinated rubber. In the invention, a rubber roller having the surface treated with a water repellent resin. Examples of such the material include natural rubber (NR), isopropylene rubber (IR), polybutadiene rubber (BR), alphin rubber, styrene-butadiene rubber (SBR), high-styrene rubber, ethylene-propylene rubber (EPM, EPDM), chlorosulfonated polyethylene, butyl rubber (IIR), chloroprene rubber (CR), acrylonitrile-butadiene rubber (NBR), polysulfide rubber (T), aryl rubber (AM, ANM), silicone rubber (Si) and fluorinated rubber FPM). Among them, ethylene-propylene rubber, natural rubber and chloroprene rubber are particularly preferred.

The sensitizing dyes are described below. At least two of $R_1$ to $R_5$ in Formula (1), and at least two of $Z_1$ to $Z_5$ in Formula (2) are each an organic group having a water-solubilizing group. The water-solubilizing group is a group having a negative value of π-value by Hansch method which is usually used for representing the structural activity relationship or relationship between the chemical structure and the physiological activity, of the compound. Hansch method is described in detail in J. Med. Chem. 16, 1207 (1973) and ibid. 20, 304, (1979).

A dye which has two or more of the water-solubilizing groups capable of ionized in water with a pK value of from 4 to 11 is preferable. A dye which has two or more groups having a pK value of from 4 to 11 and one or more groups having a pK value of not more than 4 is particularly preferable since such the dye is excellent in the sensitizing ability and the stain caused by remaining thereof is small. Examples of the functional group having the pK value are shown below. However, the dyes relating to the invention is not limited thereto.

Groups having a pK value of from 4 to 11:

$-(CH_2)_nCOOM$, $-C_6H_4COOM$, $-CH_2C_6H_4COOM$, $-CH_2-CH=CH-CH_2COOM$, $-(CH_2)_2SO_2NHC_6H_4$ and $-CH_2CH_2CONH_2$ Groups having a pK value of not more than 4:

$-(CH_2)_nSO_3M$, $-C_6H_4SO_3M$, $-CH_2C_6H_4SO_3M$, $-CH_2-CH=CH-CH_2S)_3M$ and $-CH_2CH(SO_3M)CH_3$ In the above, n is an integer of from 2 to 4 and M is a hydrogen atom, an alkali metal atom, an ammonium group or an organic amine group.

Organic groups represented by $R_1$ to $R_5$ and $Z_1$ to $Z_6$ other than that having no water-solubilizing group are each selected from a hydrogen atom, an alkyl group such as a methyl group and an ethyl group, a substituted alkyl group, an alkenyl group such as an allyl group, a substituted alkenyl group, an aryl group such as a phenyl group and a substituted aryl group such as a p-tolyl group.

The groups represented by $R_6$ and $R_7$ in Formula 1 and those represented by $Z_7$ and $Z_8$, which may be the same or different, are each a hydrogen atom, a hydroxyl group, a halogen atom, an alkyl group such as a methyl group, an ethyl group and a propyl group, a substituted alkyl group such as a trifluoromethyl group, a 2,2,2-trifluoroethyl group, an alkenyl group such as an allyl group, a substituted alkenyl group, an alkoxyl group such as a methoxy group and an ethoxy group, an alkylthio group such as an ethylthio group, a substituted alkylthio group, an arylthio group such as a phenylthio group, a substituted arylthio group, an aryl group such as a phenyl group, a substituted aryl group such as a p-tolyl group, an acyl group such as an acetyl group and a propionyl group, an acyloxy group such as an acetoxy group and a propionyloxy group, an alkoxycarbonyl group such as a methoxycarbonyl group and an ethoxycarbonyl group, an alkylsulfonyl group such as a methylsulfonyl group, a carbamoyl group, a substituted carbamoyl group, an amido group, a substituted amido group, a sulfamoyl group, a substituted sulfamoyl group, a sulfonamido group, a substituted sulfonamido group, a carboxyl group or a cyano group. The groups represented by $R_6$ and $R_7$, and those represented by $Z_7$ and $Z_8$ each may be bonded to form a carbon ring system such as a benzene ring system or a naphthalene ring system, such the rings formed by $R_6$ and $R_7$, $Z_7$ and $Z_8$ may be the same or different, respectively. $R_6$ and $R_7$, $Z_7$ and $Z_8$ each may have one or more substituents selected from the above-mentioned.

Exemplary examples of the compounds represented by Formula (1) or (2) are shown below.

1-1

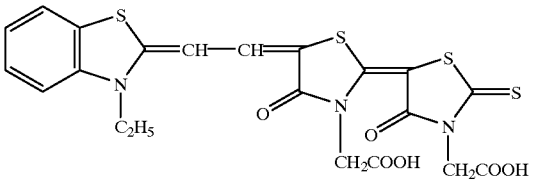

1-2

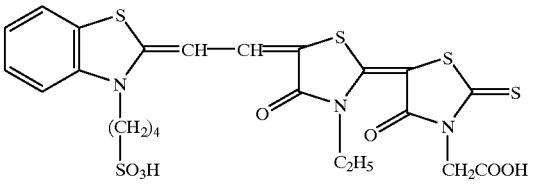

-continued
1-3
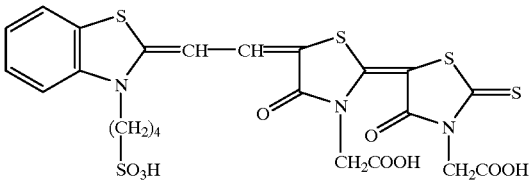
1-4
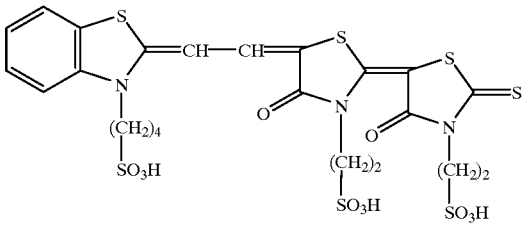
1-5
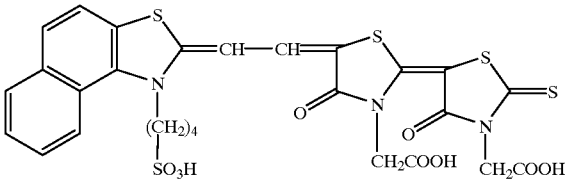
1-6
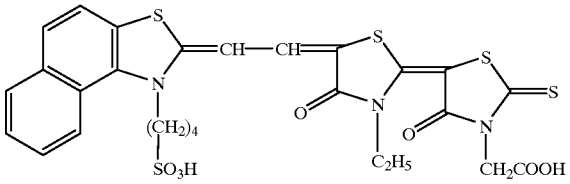
1-7
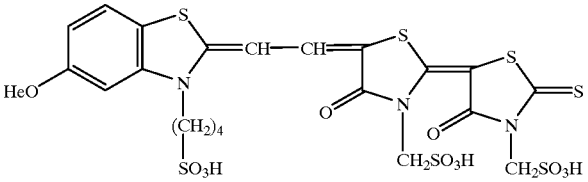
1-8
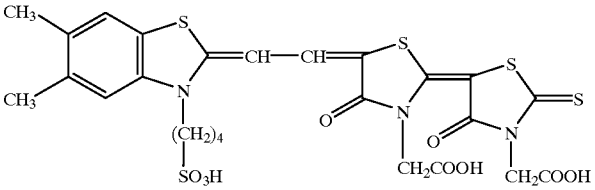
1-9
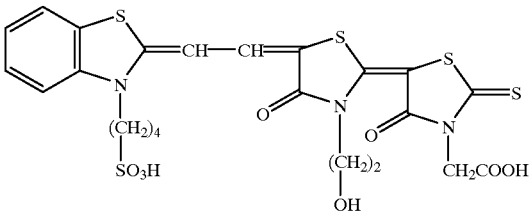
1-10
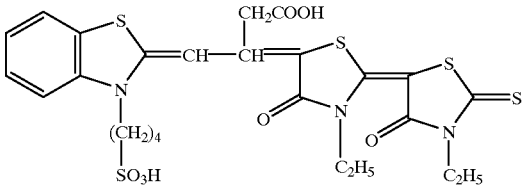
1-11
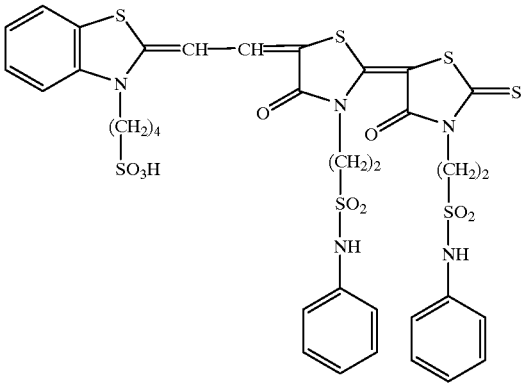
1-12
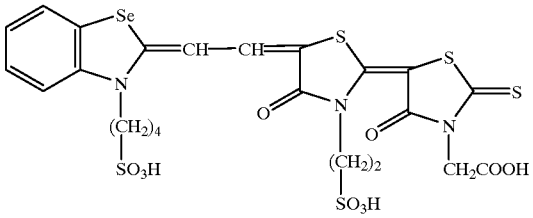

-continued
1-13
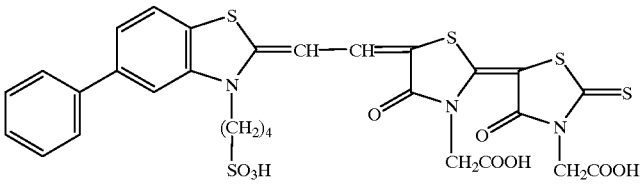
1-14
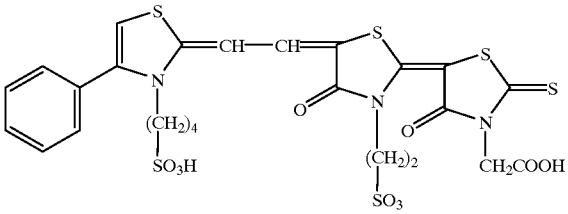
1-15
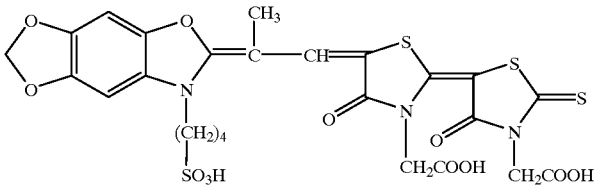
2-1
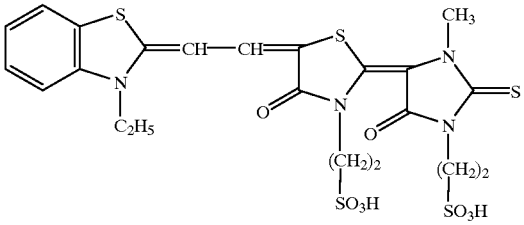
2-2
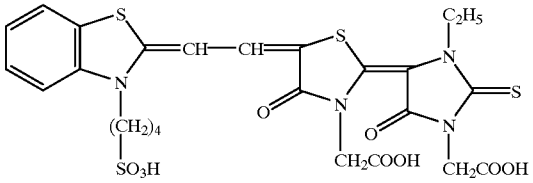
2-3
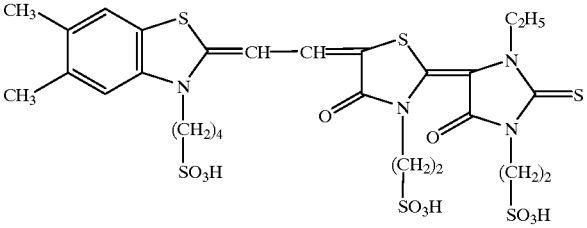
2-4
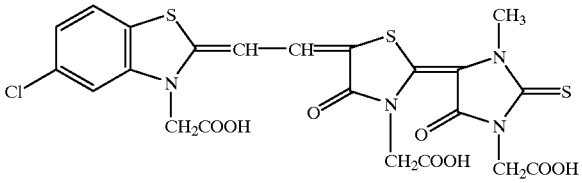
2-5
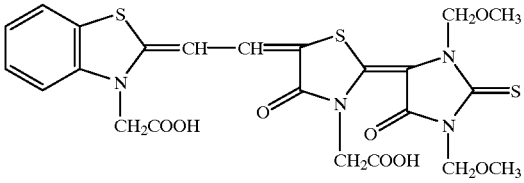
2-6
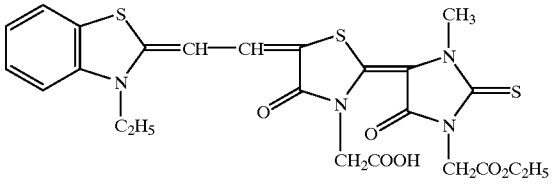

-continued 2-7

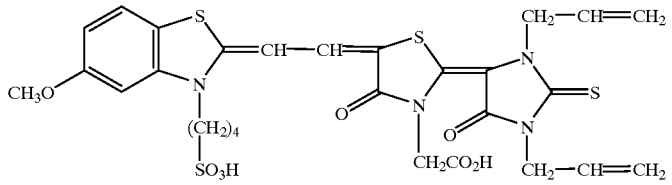

In Formula (3), $Y_1$ and $Y_2$ are each a group of non-metal atoms necessary to form a benzothiazole ring, a benzoselenazole ring, a naphthothiazole ring, a naphthoselenazole ring or a quinoline ring. These heterocyclic rings each may have a substituent, for example, a lower alkyl group such as a methyl group and an ethyl group, an alkoxyl group such as a methoxy group and an ethoxy group, a hydroxyl group, an aryl group such as a phenyl group, an alkoxycarbonyl group such as a methoxycarbonyl group and a halogen atom. $R_1$ and $R_2$ each represents a lower alkyl group such as a methyl group, an ethyl group, a propyl group and a butyl group, an alkyl group having a sulfo group such as a β-sulfoethyl group, a γ-sulfopropyl group, a γ-sulfobutyl group and a δ-sulfobutyl group, a sulfoalkoxyalkyl group such as a sulfoethoxyethyl group and a sulfopropoxyethyl group, or an alkyl group having a carboxyl group such as a β-carboxyethyl group, a γ-carboxypropyl group, a γ-carboxybutyl group and a δ-carboxyl-butyl group. $R_3$ represents a methyl group, an ethyl group or a propyl group. $X_1$ is an anion usually used in a cyanine dye such as a halogen ion, a benzenesulfonate ion and a p-toluenesulfonate ion. $m_1$ is an integer of 1 or 0 and 0 when an intramolecular salt is formed.

Examples of compound represented by Formula (3) usable in the invention are shown below.

3-1

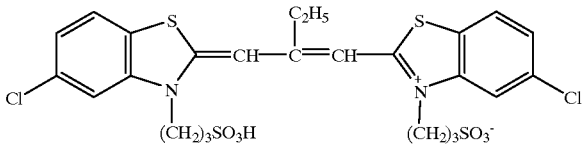

3-2

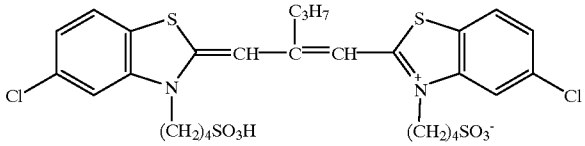

3-3

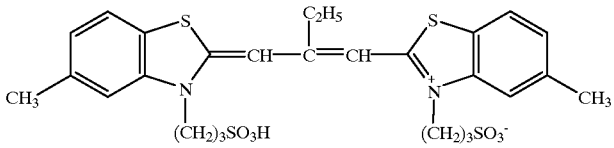

3-4

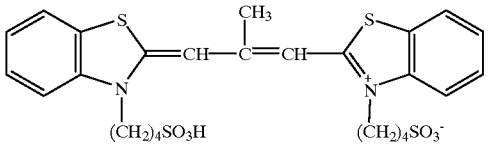

3-5

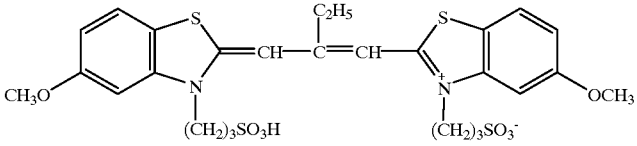

3-6

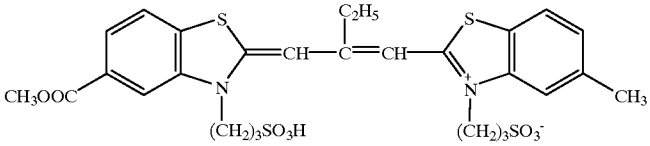

-continued
3-7
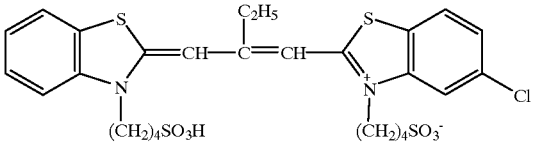
3-8
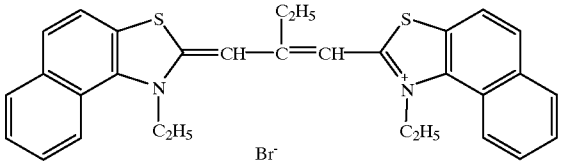
3-9
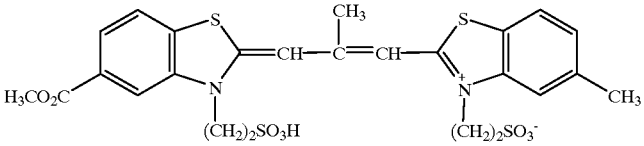
3-10
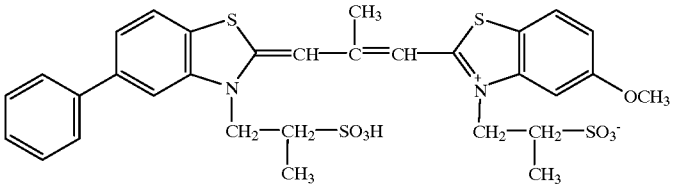
3-11
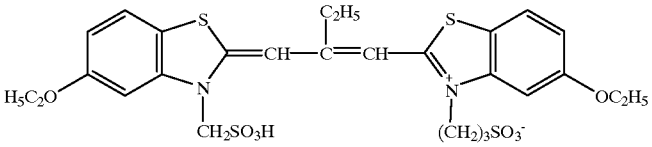
3-12
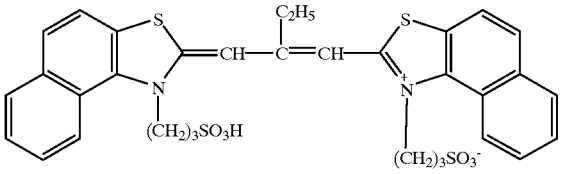
3-13
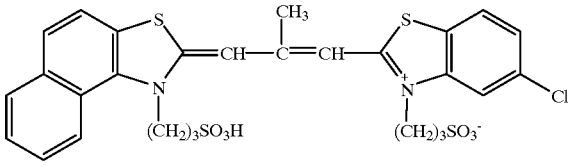
3-14
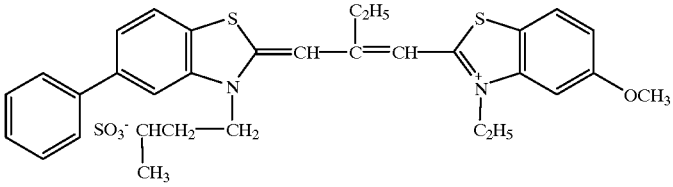
3-15
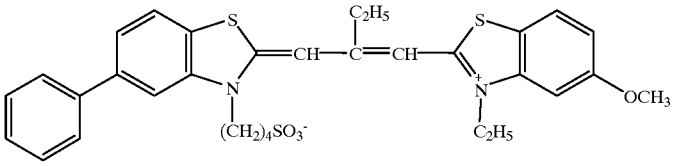
3-16
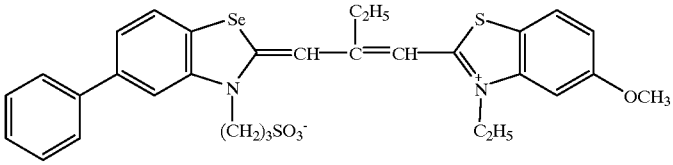

-continued
3-17
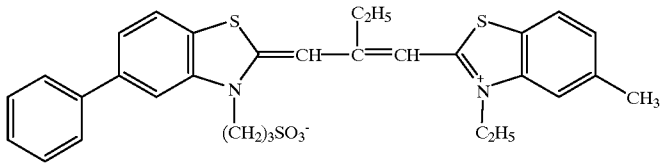
3-18
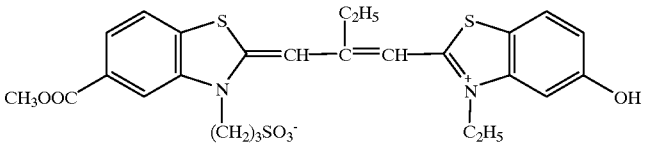
3-19
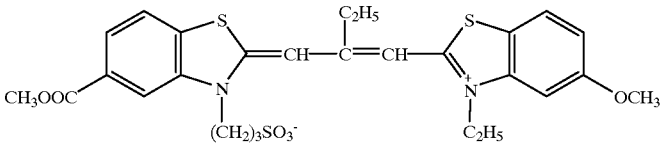
3-20
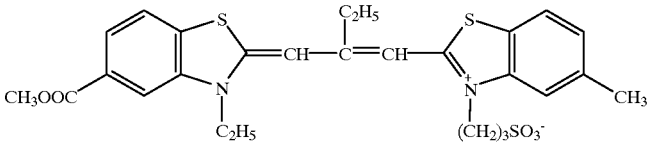
3-21
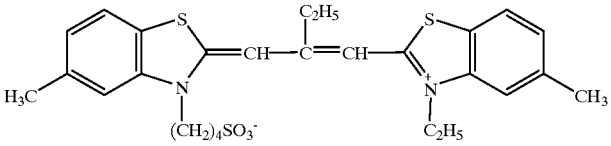
3-22
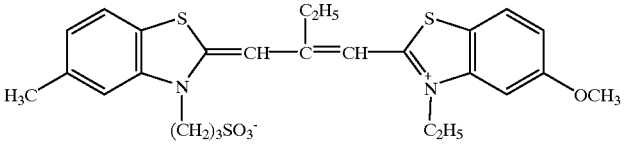
3-23
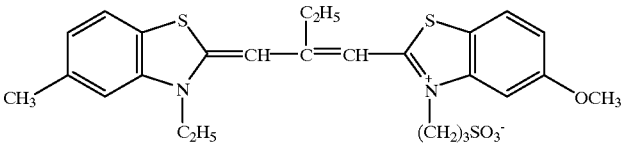
3-24
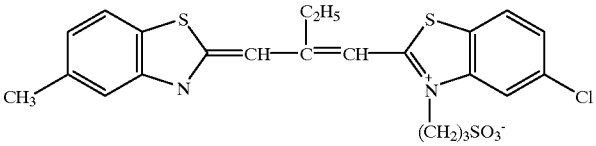
3-25
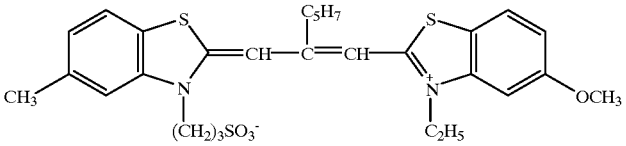

-continued
3-26
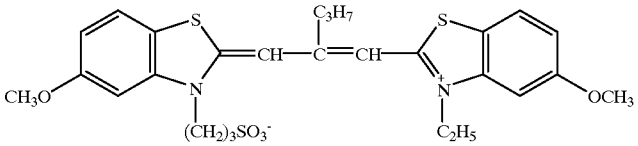
3-27
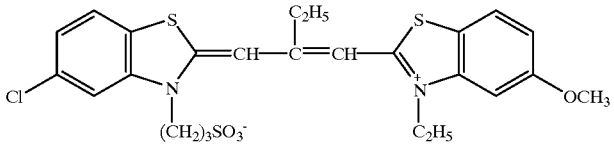
3-28
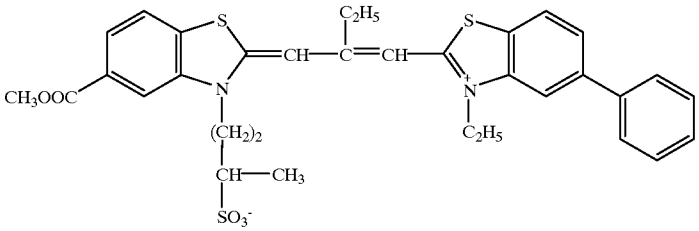
3-29
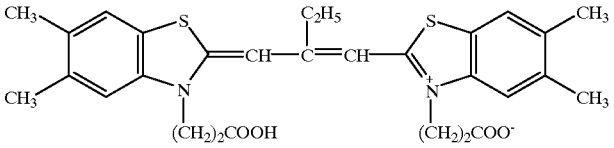
3-30
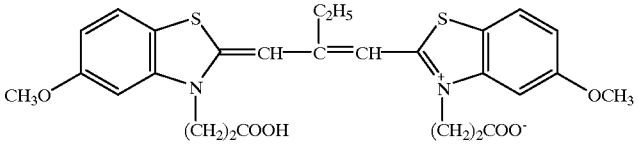
3-31
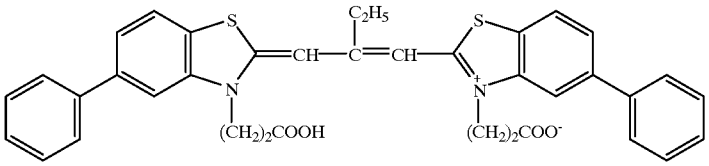
3-32
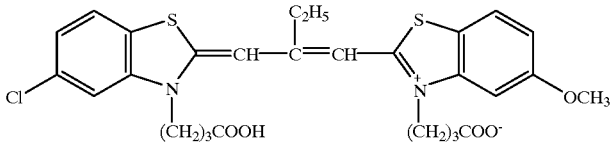
3-33
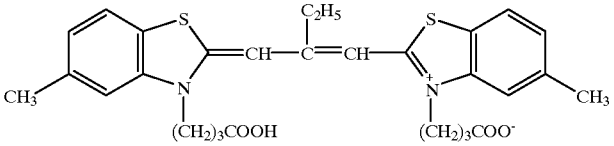
3-34
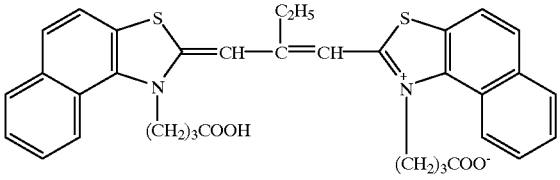

-continued 3-35

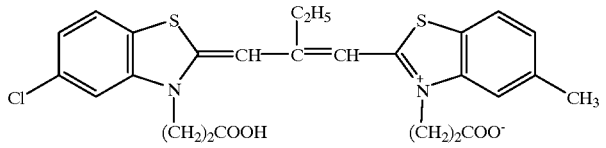

3-36

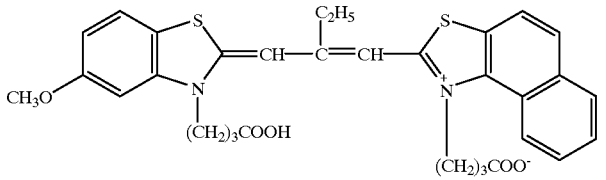

3-37

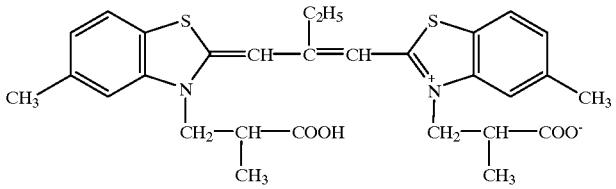

In the invention, the compounds represented by Formula (1) or (2) are preferable among the compounds represented by Formulas (1), (2) or (3).

In Formula (4), examples of the aliphatic group represented by $R_1$, $R_2$, $R_3$ or $R_4$ include a branched- or linear-chain alkyl group having 1 to 10 carbon atoms such as a methyl group, an ethyl group, an n-propyl group, an n-pentyl group and an isobutyl group, a vinyl group, an alkenyl group having 3 to 10 carbon atoms such as a 3-butenyl group and a 2-propenyl group, and an aralkyl group having 7 to 14 carbon atoms such as a benzyl group and a phenethyl group.

Examples of the water-solubilizing group to be contained at least one of $R_2$ and $R_4$ include a sulfo group, a carboxyl group, a phosphono group, a sulfate group and a sulfino group. Concrete examples of the aliphatic group having the water-solubilizing group as the substituent thereof include a carboxymethyl group, a sulfoethyl group, a sulfopropyl group, a sulfobutyl group, a sulfopentyl group, a 3-sulfobutyl group, a 6-sulfo-3-oxahexyl group, a ω-sulfopropoxycarbonylmethyl group, a ω-sulfopropylaminocarbonylmethyl group, a 3-sulfinobutyl group, a 3-phosphonopropyl group, a 4-sulfo-3-butenyl group, a 2-carboxy-2-propenyl group, an o-sulfobenzyl group, a p-sulfophenetyl group and a p-carboxybenzyl group.

The aliphatic group represented by $R_1$, $R_2$, $R_3$ or $R_4$ may have a substituent, for example, a hydroxyl group, a halogen atom, an alkoxyl group such as a methoxy group and an ethoxy group, an aryloxy group such as a phenoxy group and a p-sulfophenoxy group, a cyano group, a carbamoyl group such as a carbamoyl group, an N-methylcarbamoyl group and an N,N-tetramethylenecarbamoyl group, a sulfamoyl group such as a sulfamoyl group and an N,N-3-oxapentamethyleneaminosulfonyl group, a methanesulfonyl group, an alkoxycarbonyl group such as an ethoxycarbonyl group and a butoxycarbonyl group, an aryl group such as a phenyl group and a carboxyphenyl group, an acyl group such as an acetyl group and a benzoyl group, and an acylamino group such as an acetylamino group.

The substituents represented by $V_1$, $V_2$, $V_3$, $V_4$, $V_5$, $V_6$, $V_7$ or $V_8$ are selected so the sum of Hammett's $\sigma_\pi$ values of the groups represented by $V_1$ to $V_4$, and $V_5$ to $V_8$ are each respectively not less than 0.12. An electron donative group and an electron withdrawing group are optionally usable. In concrete, the following groups are usable: a cyano group, a carboxyl group, a linear- or branched-chain alkyl group such as a methyl group, an ethyl group, an iso-propyl group, a t-butyl group, an iso-butyl group, a t-pentyl group and a hexyl group; an alkoxyl group such as a methoxy group, an ethoxy group and a propoxy group; an alkylthio group such as a methylthio group; a halogen atom; a carbamoyl group such as a carbamoyl group, an N-methylcarbamoyl group and an N,N-pentamethylenecarbamoyl group; a sulfamoyl group such as an N-methylsulfamoyl group, a morpholinosulfamoyl group and a piperidinosulfamoyl group; an acylamino group such as an acetylamino group, a propionylamino group and a benzoylamino group; a sulfonylamino group such as a methanesulfonylamino group, a benzenesulfonylamino group, an m-chlorobenzenesulfonyl-amino group and a perfluoromethanesulfonylamino group; an alkoxycarbonyl group such as a methoxycarbonyl group, an ethoxycarbonyl group and a butoxycarbonyl group; an alkylsulfonyl group such as a methanesulfonyl group, an ethanesulfonyl group and a trifluoromethanesulfonyl group; an arylsulfonyl group such as a benzenesulfonyl group; an acyl group such as an acetyl group and a benzoyl group; a perfluoroalkyl group such as a trifluoromethyl group and a pentafluoroethyl group; a perfluoroalkoxyl group such as a trifluoromethoxy group and a pentafluoroethoxy group; a perfluoroalkylthio group such as a trifluoromethylthio group and a pentafluoroethylthio group; an aryl group such as a phenyl group and an m-chlorophenyl group; and a heterocyclic group such as a pyryl group, a prydiyl group, an imidazolyl group, a furyl group and an thienyl group.

The Hammett's $\sigma_p$ value is a constant of substituent defined by Hammett et al. based on the effects of electron of substituents on the hydrolysing rate of ethyl benzoate. The value of various groups are described in detail in Chemical Reviews Vol. 17, 125–136 (1935), "Journal of Organic Chemistry", Vol. 123, 420–427 (1958); "Jikken Kagaku Kouza (Lectures on Experimental Chemistry)", Vol. 14, Maruzen-shuppansha; "Physical Chemistry", McGraw Hill Book (1940); "Drug Design VII" Academic Press, New York (1970); "Yakubutsu no Kozo Kassei Sokann (Relation between structure and Activity od Medicine)", Konando (1979); and "Substituent Constant for Correlation Analysis in Chemistry and Biology", John Wiley and Sons (1979).

When $V_1$ to $V_8$ is an aryl group, a heterocyclic group or an alkyl group, these groups may have the foregoing substituent.

$V_1$, and $V_2$, $V_2$ and $V_3$, $V_3$ and $V_4$, $V_4$ and $V_5$, $V_5$ and $V_6$, $V_6$ and $V_7$, or $V_7$ and $V_8$, each may be bonded to form a ring such as a 5-, 6- or 7-member saturated carbon ring, an aromatic carbon ring and a heterocyclic ring, and such the rings may have the foregoing substituent.

Examples of substituent to be bonded to the carbon atom of methine group represented by $L_1$, $L_2$, $L_3$, $L_4$ or $L_5$ include a lower alkyl group such as a methyl group and an ethyl group, a cycloalkyl group such as a cyclopropyl group and a cyclopentyl group, a substituted alkyl group such as a 2-methoxyethyl group and a 2-thienylmethyl group, an aralkyl group such as a benzyl group and a phenetyl group, a phenyl group such as a phenyl group and a carboxyphenyl group, a heterocyclic group such as a thienyl group, a furyl group and an imidazolyl group, an alkoxyl group such as a methoxy group and an ethoxy group, and a fluorine atom. $L_1$ may be condensed with $R_1$ or $R_2$, and $L_2$ may be condensed with $R_3$ or $R_4$, to form a ring.

$M_1$ is a cation, for example, a proton, a organic ammonium ion such as triethylammonium ion and triethanolammonium ion, and an inorganic cation such as a lithium ion, a sodium ion and a calcium ion, or an acid anion such as a halogen ion, a p-toluene-sulfonate ion, a perchlorate ion and a boron tetrafluoride ion.

The value of 1 is 0 when the charge is neutralized by formation of an intramolecular salt.

Concrete examples of spectral sensitizing dye represented by Formula (4) are shown below. However, the dye usable in the invention is not limited thereto.

4-1

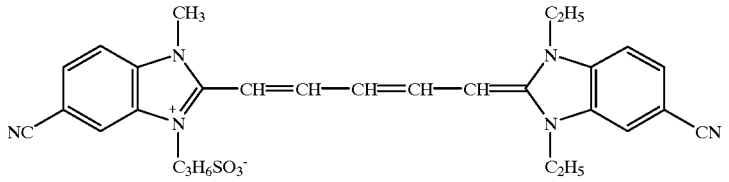

4-2

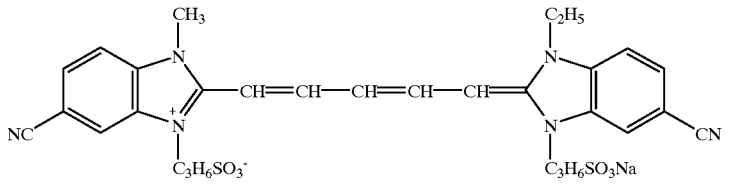

4-3

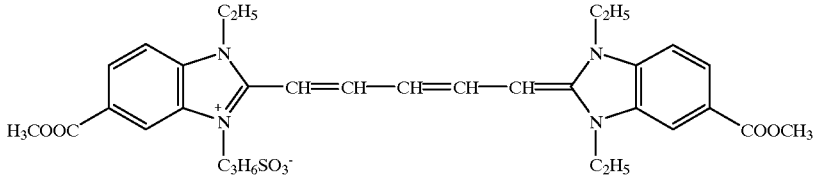

4-4

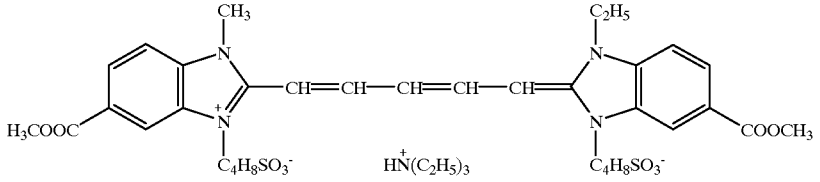

4-5

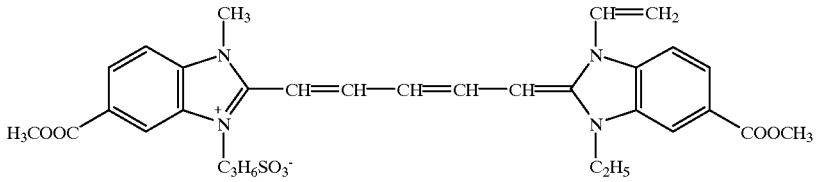

-continued
4-6
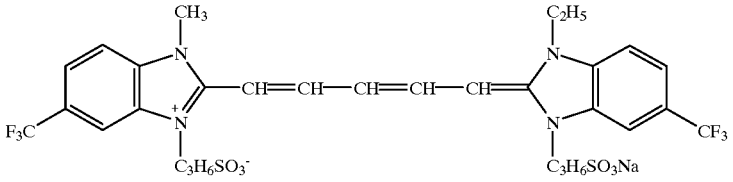
4-7
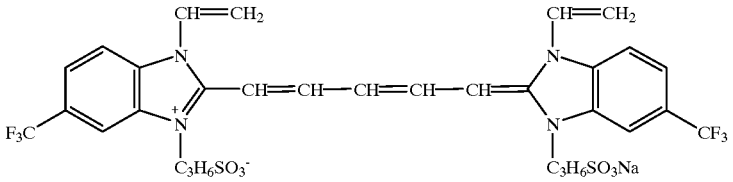
4-8
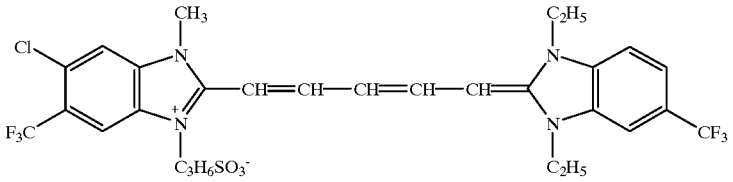
4-9
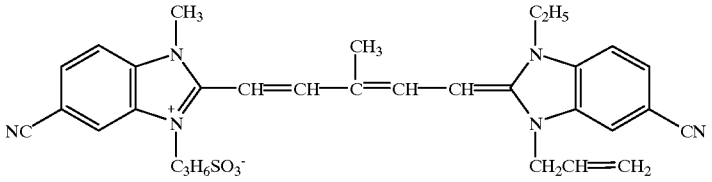
4-10
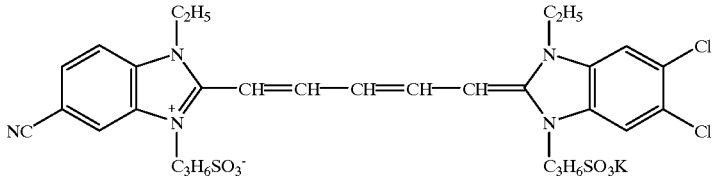
4-11
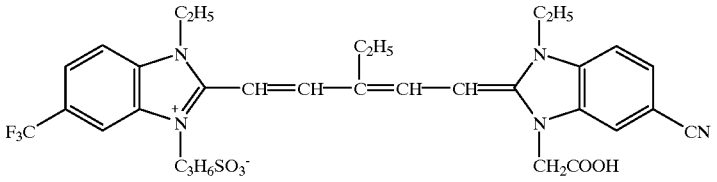
4-12
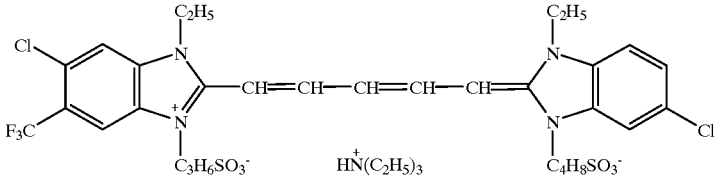
4-13
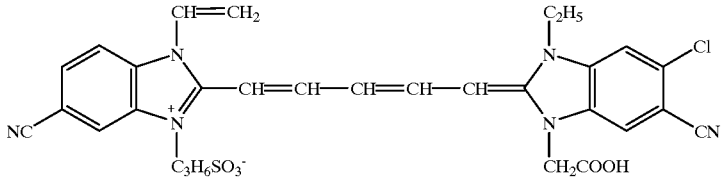

-continued
4-14
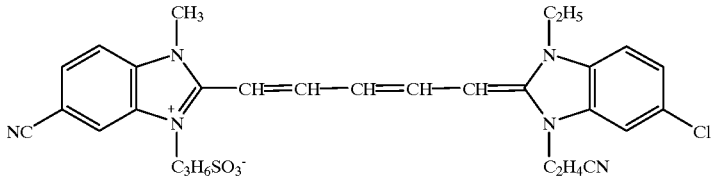
4-15
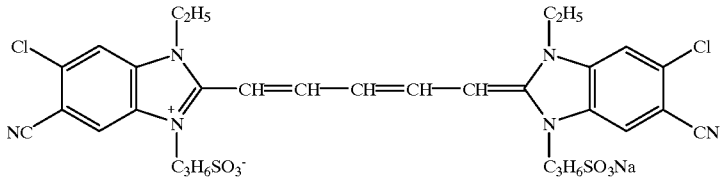
4-16
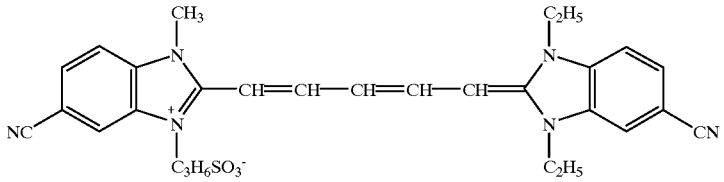
4-17
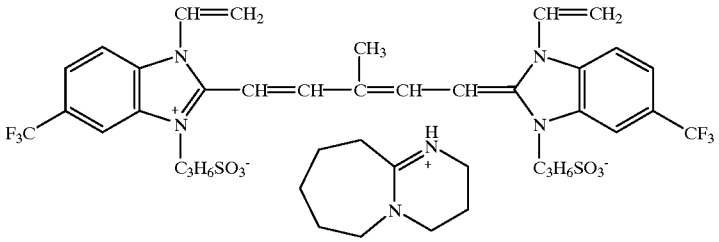
4-18
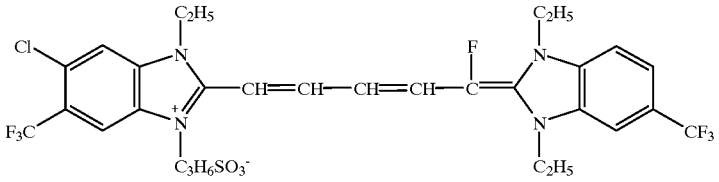
4-19
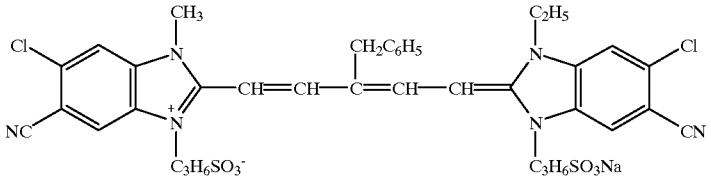
4-20
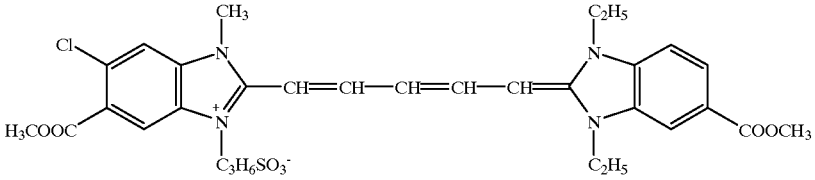
4-21
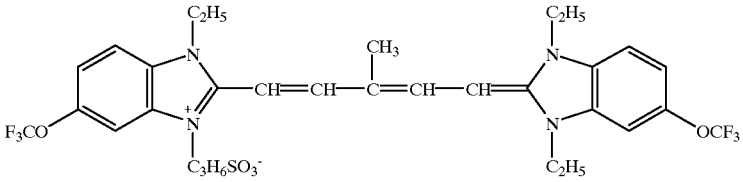

-continued
4-22
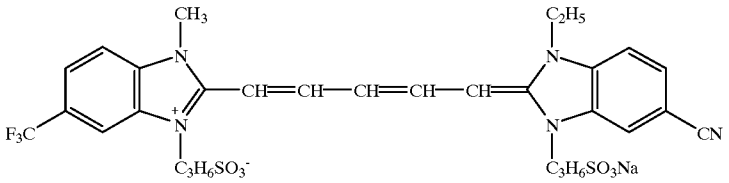
4-23
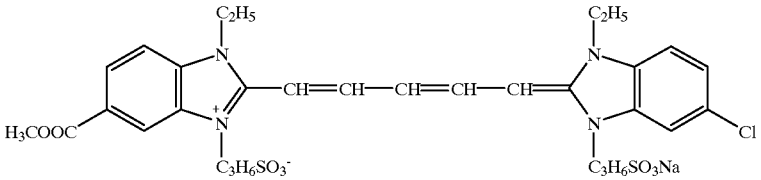
4-24
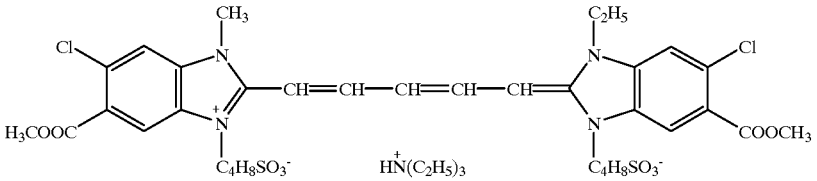
4-25
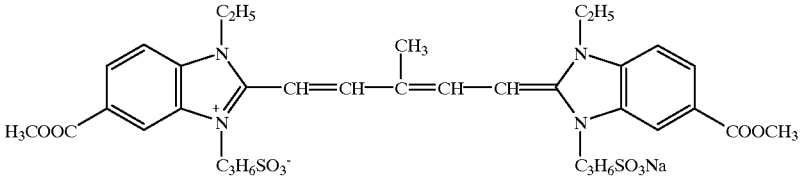
4-26
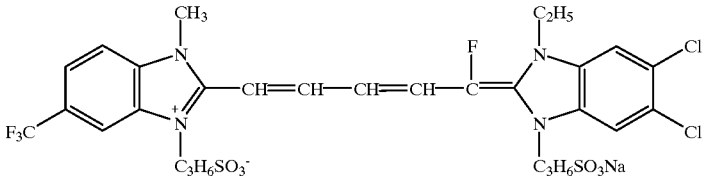
4-27
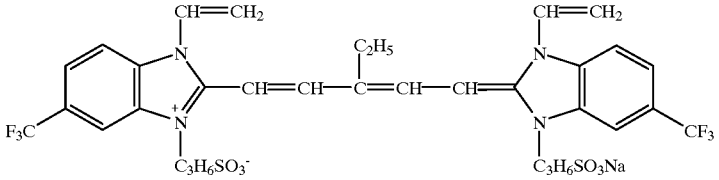
4-28
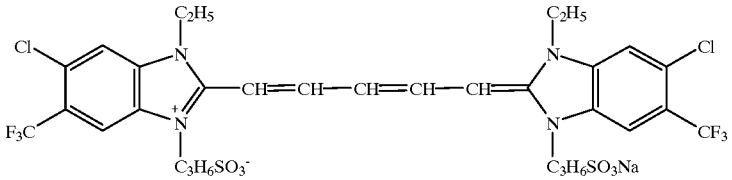
4-29
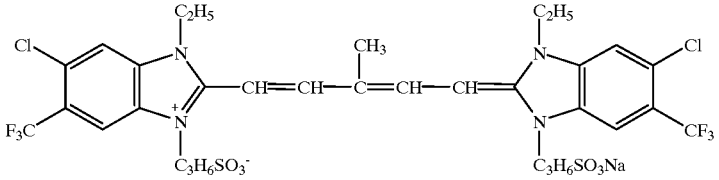

-continued
4-30
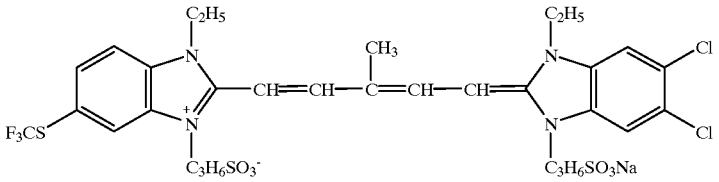
4-31
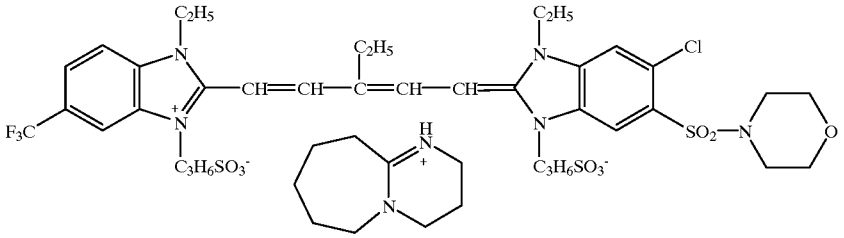
4-32
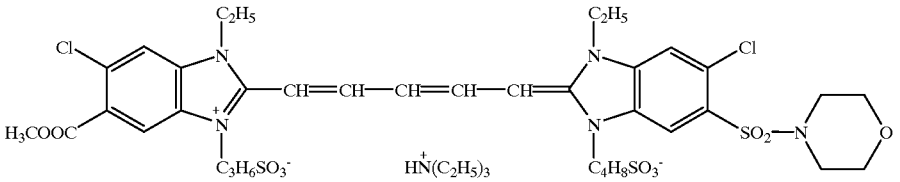
4-33
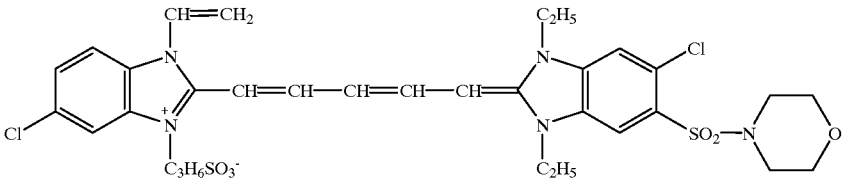
4-34
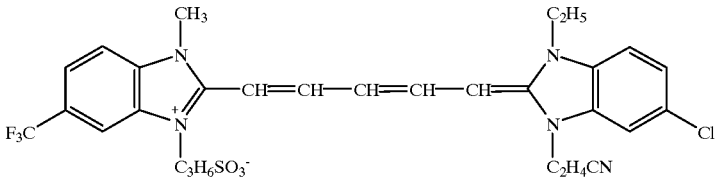
4-35
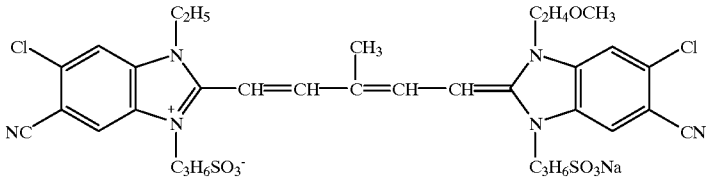
4-36
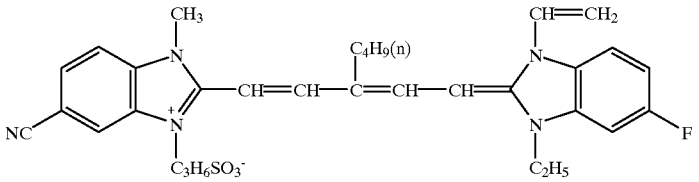
4-37
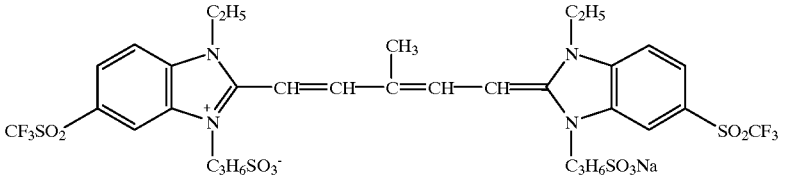

-continued
4-38
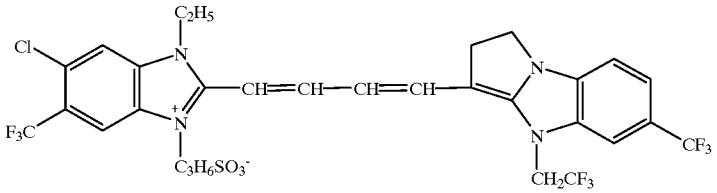
4-39
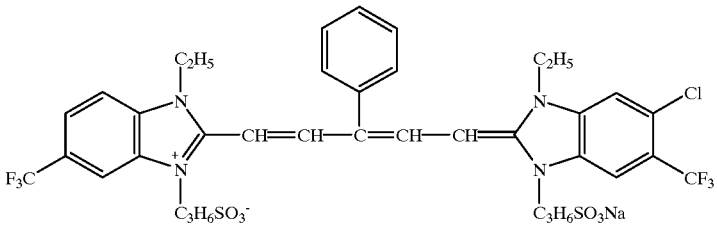
4-40
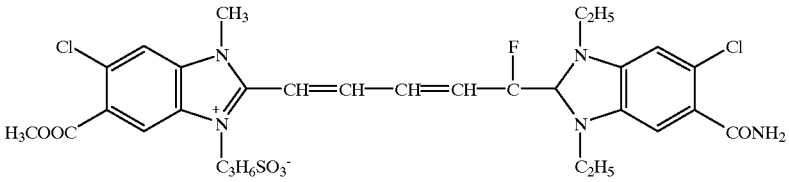
4-41
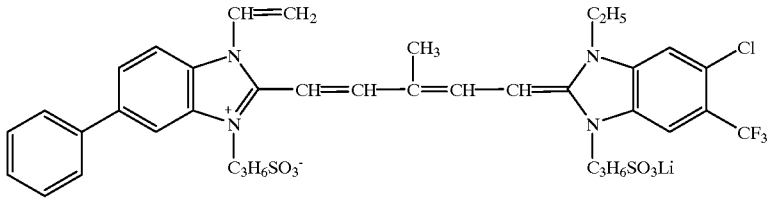
4-42
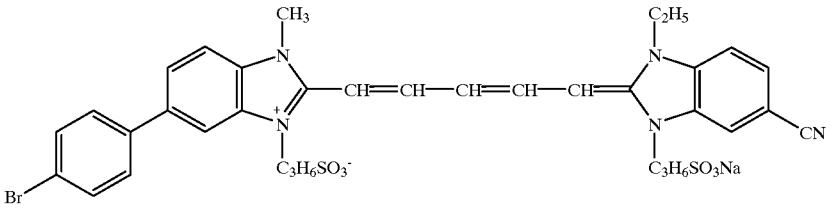
4-43
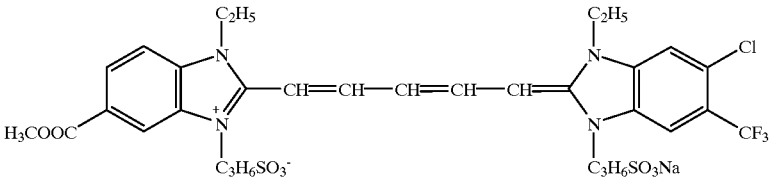
4-44
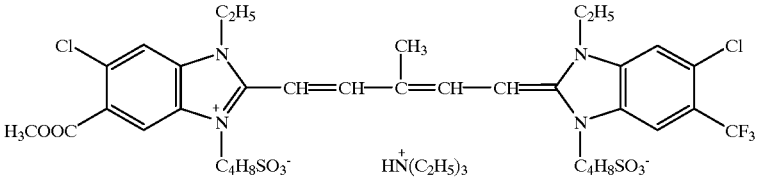

-continued
4-45
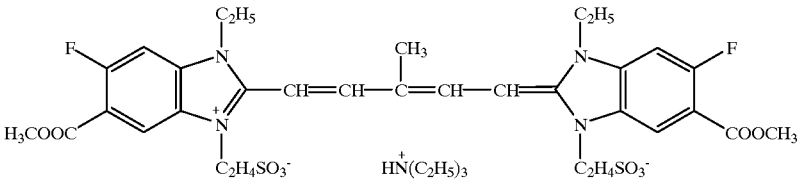
4-46
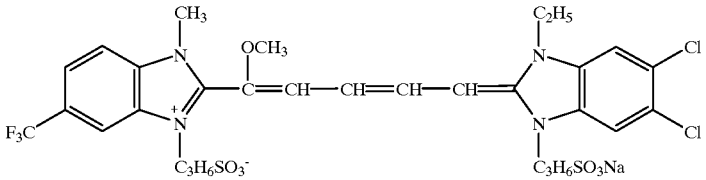
4-47
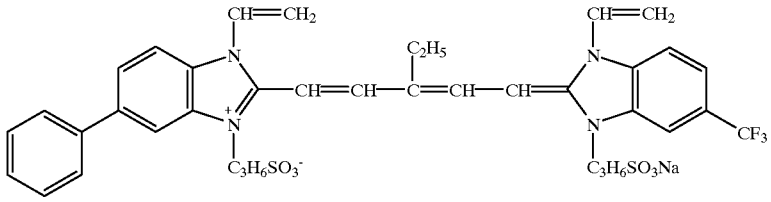
4-48
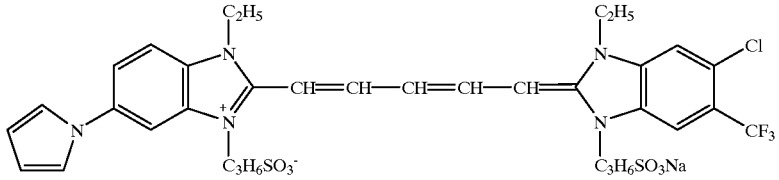
4-49
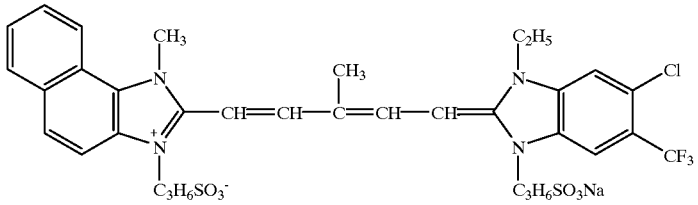
4-50
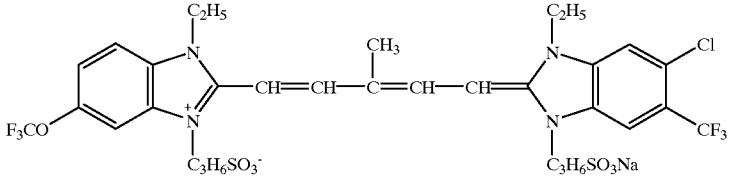
4-51
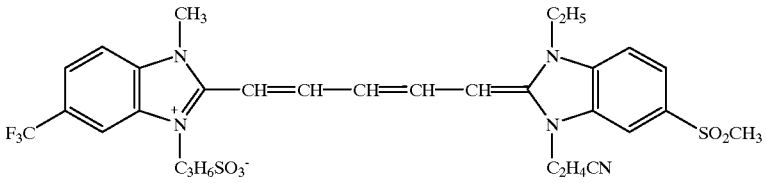
4-52
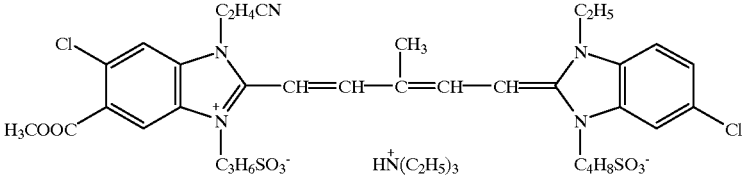

-continued
4-53
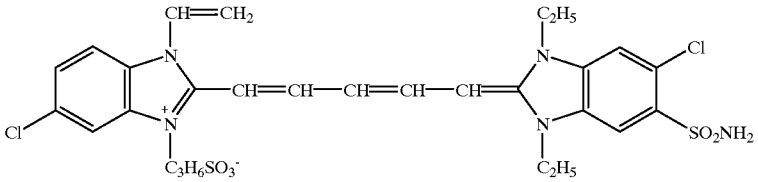
4-54
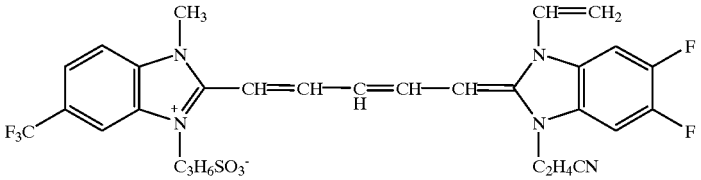
4-55
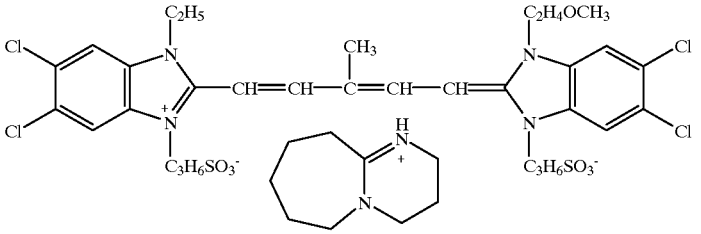
4-56
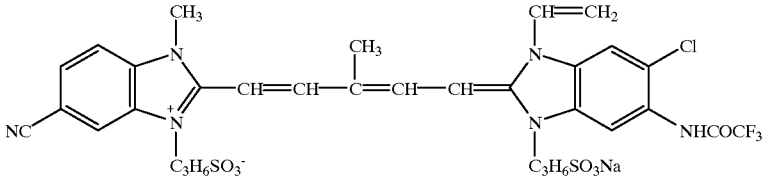
4-57
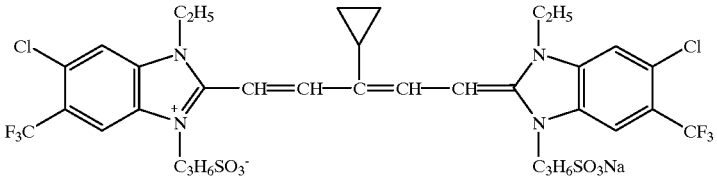
4-58
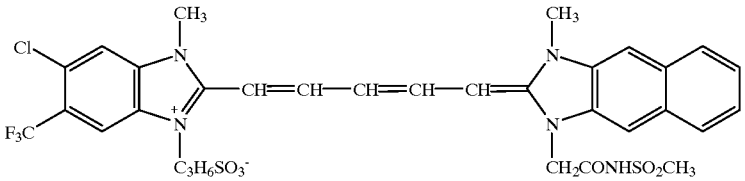
4-59
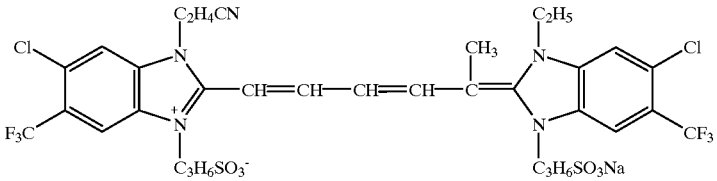
4-60
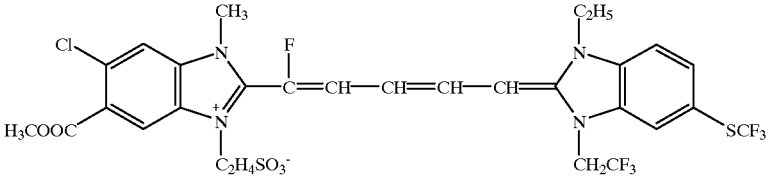

-continued
4-61
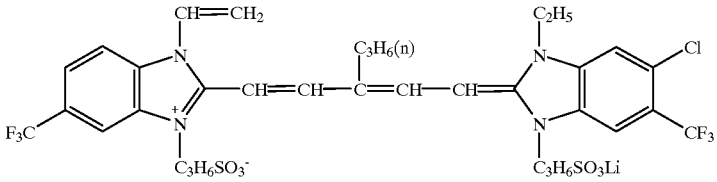
4-62
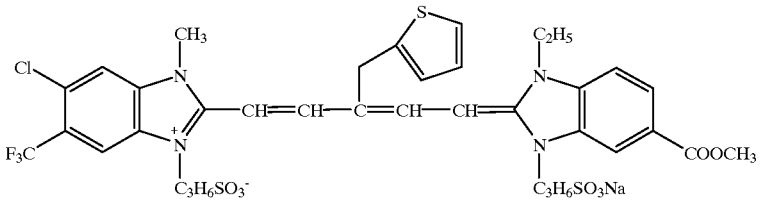
4-63
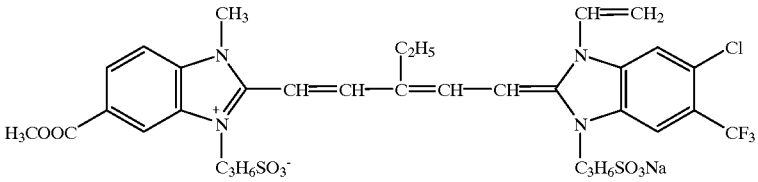
4-64
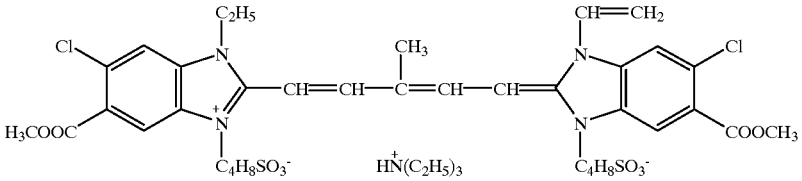
4-65
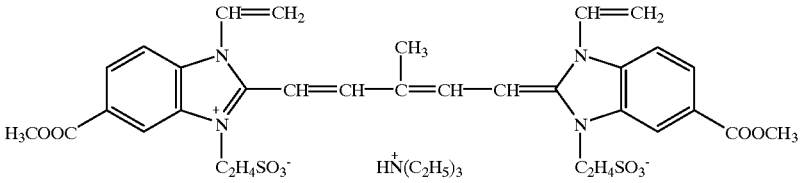
4-66
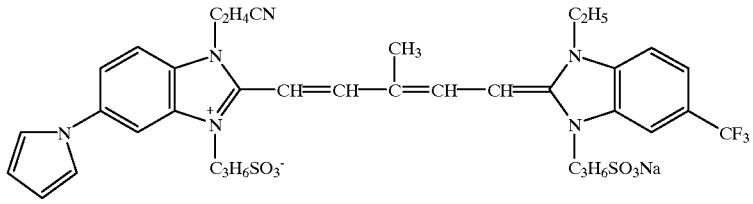
4-67
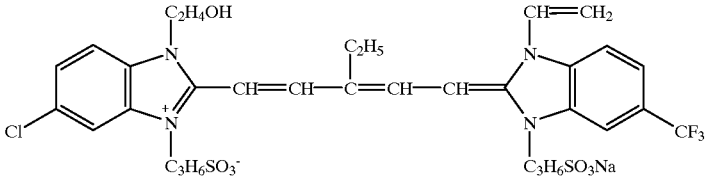
4-68
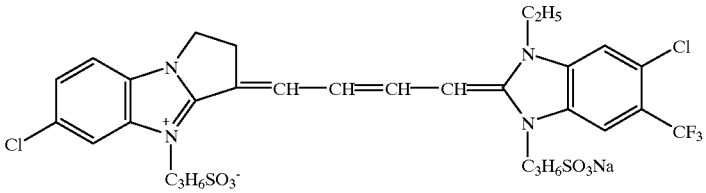

-continued
4-69
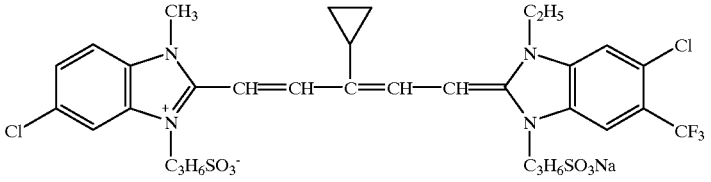
4-70
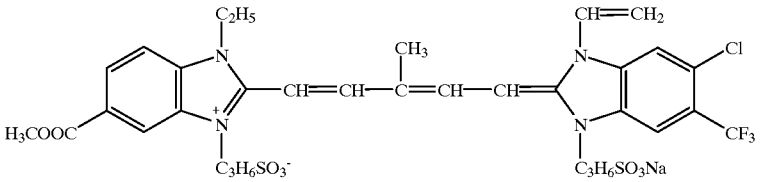
4-71
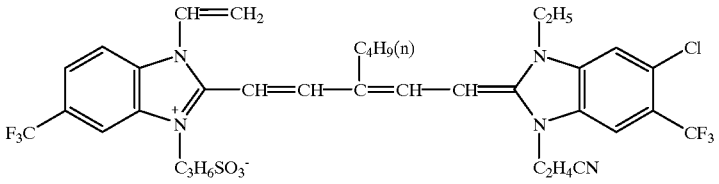
4-72
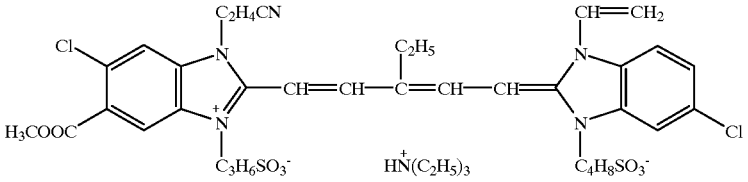
4-73
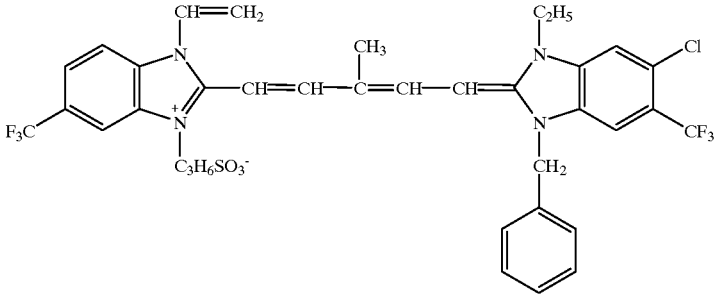
4-74
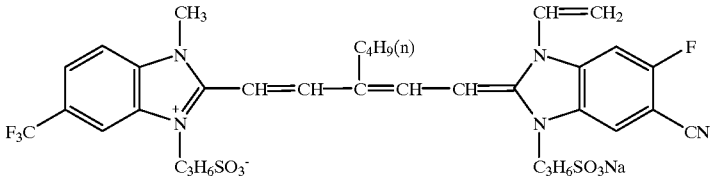
4-75
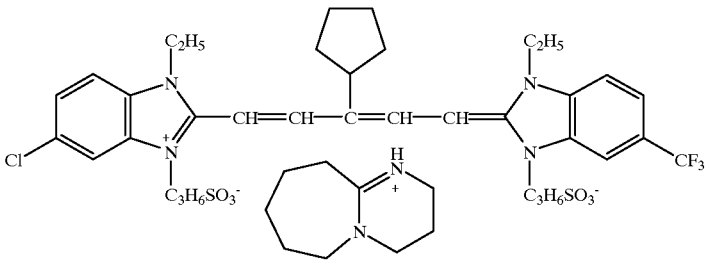

-continued 4-76

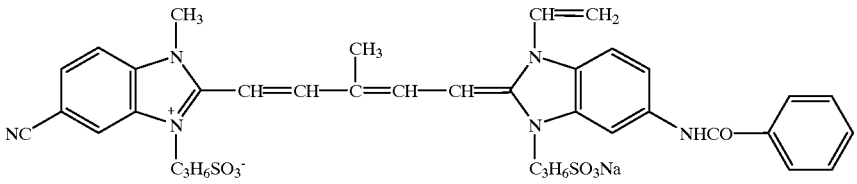

4-77

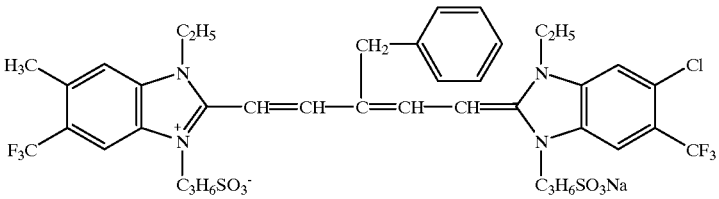

4-78

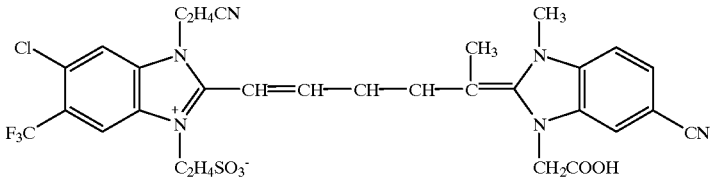

4-79

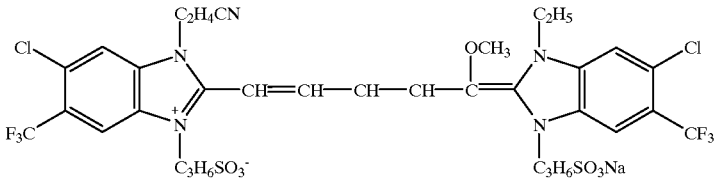

4-80

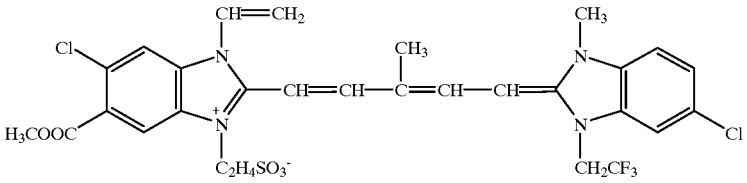

These compounds can be synthesized by referring the methods described in F. M. Hamer "Cyanine Dyes and Related Compounds" Interscience Publisher (1964), Ukr. Khim. Zh., 1977, 43 (4) 381–4, British Patent No. 980,234, U.S. Pat. No. 3,684,517 and Japanese Patent Publication Open for Public Inspection (JP O.P.I.) No. 61-203446.

In Formula (5), $R_1$ is preferably an unsubstituted alkyl group having not more than 18 carbon atoms such as a methyl group, a propyl group, a pentyl group, a decyl group and an octadecyl group, or a substituted alkyl group having a substituent such as a carboxyl group, a sulfo group, a cyano group, a halogen atom, a hydroxyl group, an alkoxycarbonyl group having not more than 8 carbon atoms, an alkanesulfonylaminocarbonyl group having not more than 8 carbon atoms, an acylaminosulfonyl group having not more than 8 carbon atoms, an alkoxyl group having not more than 8 carbon atoms, an alkylthio group having not more than 8 carbon atoms, an aryloxy group having not more than 20 carbon atoms, an acyloxy group having not more than 3 carbon atoms, an acylthio group having not more than 3 carbon atoms, an acyl group having not more than 8 carbon atoms, a carbamoyl group having not more than 8 carbon atoms, a sulfamoyl group having not more than 8 carbon atoms, and an alkyl group having not more than 18 carbon atoms substituted with an aryl group having not more than 20 carbon atoms. Among them, an unsubstituted alkyl group, a carboxyalkyl group such as a 2-carboxyethyl group and a carboxymethyl group and a salt thereof, a sulfoalkyl group such as a 2-sulfoethyl group, a 3-sulfopropyl group, a 4-sulfobutyl group and a salt thereof, a methanesulfonylcarbamoylmethyl group and a salt thereof, are preferred. A sulfoalkyl group, particularly a 2-sulfoethyl group, is more preferable.

The followings are preferable as the nucleus formed by Z: a thiazole nucleus, a benzothiazole nucleus, a naphthothiazole nucleus, a thiazoline nucleus, an thiooxazole nucleus, a benzoxazole nucleus, a naphthoxazole nucleus, a selenazole nucleus, a benzoselenazole nucleus, a naphthoselenazole nucleus, a selenazoline nucleus, a tetrazole nucleus, a benzotetrazole nucleus, a tetrazoline nucleus, a 3,3-dialkylindolenine nucleus, an imidazole nucleus, a benzoimidazole nucleus, naphthoimidazole nucleus, a pyridine nucleus, a suinoline nucleus, an isoquinoline nucleus, an imidazo[4,5-b]quinoquizalne nucleus, a a oxadiazole nucleus, a thiadiazole nucleus, a tetrazole nucleus, and a pyrimidine nucleus. The benzothiazole nucleus, naphthothiazole nucleus, benzoxazole nucleus, naphthothioxazole nucleus, benzoimidazole nucleus, 2-quinoline nucleus, and 4-quinoline nucleus are preferable and the benzoxazole nucleus is particularly preferred.

D and Da represent a group of atoms necessary to form an acidic nucleus. The acidic nucleus is defined by the description on p. 198 of James "The Theory of the Photographic Process" 4th edition, Macmilan, 1977. Preferable examples of the acidic nucleus include the followings: a 2-pyrazoline-5-one nucleus, a pyrazolidine-3,5-dione nucleus, an imidazoline-5-one nucleus, a hydantoin nucleus, a 2- or 4-thiohydantoine nucleus, a 2-imino-oxazolidine-4-one nucleus, a 2-oxazolidine-5-one nucleus, a 2-thiooxazolidine-2,4-dione nucleus, an isooxazoline-5-one nucleus, a 2-thiazoline-4-one nucleus, a thiazolidine-4-one nucleus, a thiazolidine-2,4-dione nucleus, a rhodanine nucleus, an isorhodanine nucleus, an indane-1,3-dione nucleus, a thiophene-3-one nucleus, a thiophene-3-one-1,1-dioxide nucleus, an indoline-2-one nucleus, an indoline-3-one nucleus, an indazoline-3-one nucleus, a 2-oxoindazolinium nucleus, a 3-oxoindazolinium nucleus, a 5,7-dioxo-6,7-dihydrothiazolo[3,2-a]-pyrimidine nucleus, a cyclohexane-1,3-dione nucleus, a 3,4-dihydroisoquinoline-4-one nucleus, a 1,3-dioxane-4,4-dione nucleus, a barbituric acid nucleus, a 2-thiobarbituric acid nucleus, a chromane-2,4-dione nucleus, an indazoline-2-one nucleus, a pyrido[1,2-a]-pyrimidine-1,3-dione nucleus, a pyrazolo[1,5-b] quinazolone nucleus, a pyrazolo-[1,5-a]benzimidazole nucleus, a pyrazopyridone nucleus, a 1,2,3,4-tetrahydroquinoline-2,4-dione nucleus, a 3-oxo-2,3-dihydrobenzo-[d]thiophene-1,1-dioxide nucleus and a 3-dicyanomethine-2,3-dihydrobenzo[d]-thiophene-1,1-dioxide nucleus. Among them, the 2-thiohydantoine nucleus, 2-oxazoline-5-one nucleus and rhodanine nucleus are preferable and rhodanine nucleus is particularly preferred.

Typical examples of the dye represented by Formula (5) are shown below. However, the dye usable in the invention is not limited thereto.

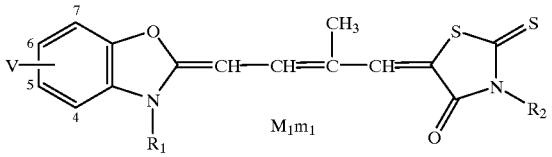

$M_1m_1$

| Compound No. | $R_1$ | $R_2$ | V | $M_1$ | $m_1$ |
|---|---|---|---|---|---|
| 5-1 | $(CH_2)_2SO_3^-$ | $CH_2CO_2^-$ | H | $Na^+$ | 2 |
| 5-2 | $(CH_2)_2SO_3^-$ | $CH_2CO_2^-$ | H | $K^+$ | 2 |
| 5-3 | $(CH_2)_2SO_3^-$ | $CH_2CO_2^-$ | H | $(C_2H_5)_3\overset{+}{N}H$ | 2 |
| 5-4 | $(CH_2)_4SO_3^-$ | $CH_2CO_2^-$ | H | $(C_2H_5)_3\overset{+}{N}H$ | 2 |
| 5-5 | $(CH_2)_3SO_3^-$ | $CH_2CO_2^-$ | H | $(C_2H_5)_3\overset{+}{N}H$ | 2 |
| 5-6 | $(CH_2)_2-CH(CH_3)SO_3^-$ | $CH_2CO_2^-$ | H | $(C_2H_5)_3\overset{+}{N}H$ | 2 |
| 5-7 | $(CH_2)_4SO_3^-$ | $CH_2CO_2^-$ | 5-$OCH_3$ | $(C_2H_5)_3\overset{+}{N}H$ | 2 |
| 5-8 | $(CH_2)_4SO_3^-$ | $CH_2CO_2^-$ | 5-F | $Na^+$ | 2 |
| 5-9 | $(CH_2)_2SO_3^-$ | $CH_2CO_2^-$ | 5-$CH_2$ | $Na^+$ | 2 |
| 5-10 | $(CH_2)_2SO_3^-$ | $CH_2CO_2^-$ | 5,6-$(CH_3)_2$ | $Na^+$ | 2 |
| 5-11 | $(CH_2)_4SO_3^-$ | $(CH_2)_2SO_3^-$ | H | $K^+$ | 2 |
| 5-12 | $CH_2CO_2^-$ | $CH_2CO_2^-$ | H | $Na^+$ | 2 |
| 5-13 | $CH_2CO_2^-$ | $(CH_2)_2SO_3^-$ | H | $Na^+$ | 2 |
| 5-14 | $(CH_2)_3SO_3^-$ | $(CH_2)_2SO_3^-$ | H | $Na^+$ | 2 |
| 5-15 | $(CH_2)_4SO_3^-$ | $(CH_2)_2OH$ | H | $K^+$ | 1 |
| 5-16 | $(CH_2)_4SO_3^-$ | $(CH_2)_2CO_2^-$ | H | $K^+$ | 2 |
| 5-17 | $(CH_2)_4SO_3^-$ | $(CH_2)_3CO_2^-$ | H | $K^+$ | 2 |
| 5-18 | $(CH_2)_4SO_3^-$ | $(CH_2)_5CO_2^-$ | H | $K^+$ | 2 |
| 5-19 | $(CH_2)_4SO_3^-$ | $(CH_2)_2NH-C(=O)CH_3$ | H | $K^+$ | 1 |
| 5-20 | 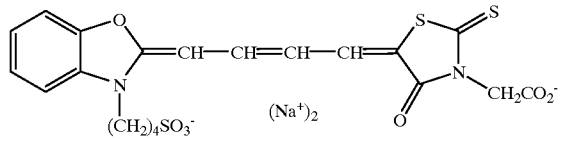 | | | | |

-continued
5-21
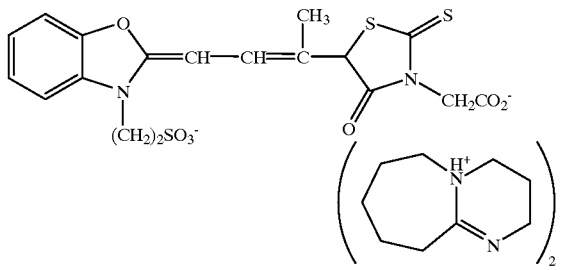
5-22
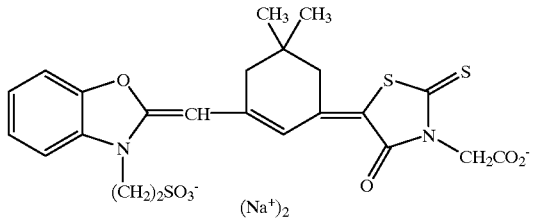
5-23
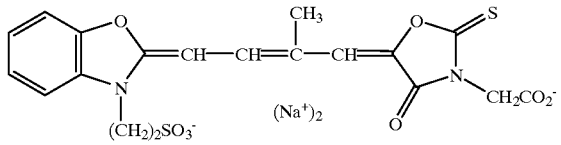
5-24
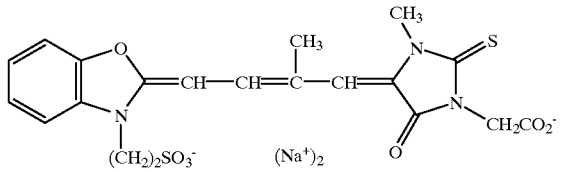
5-25
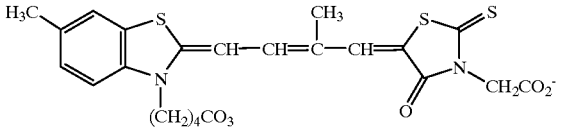
5-26
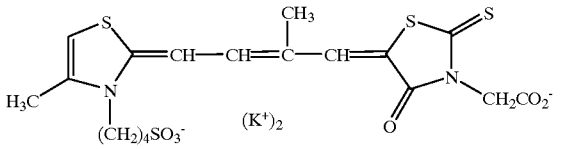
5-27
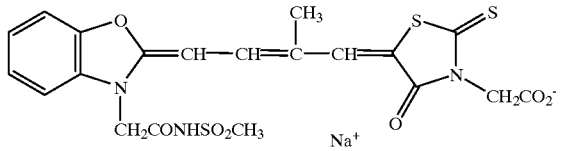
5-28
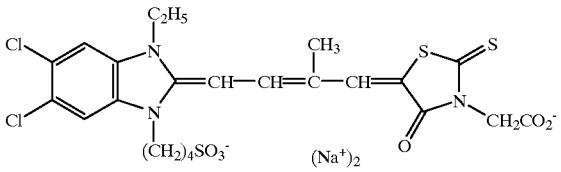

-continued 5-29

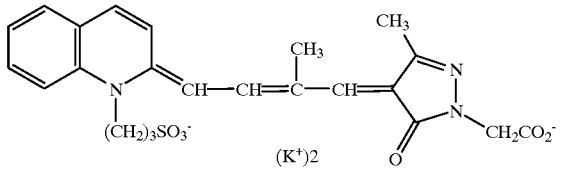

5-30

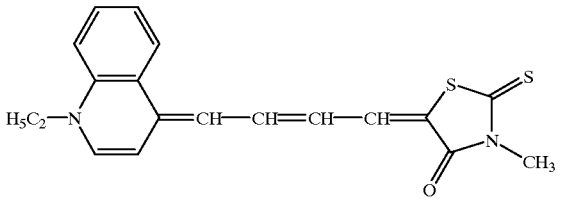

5-31

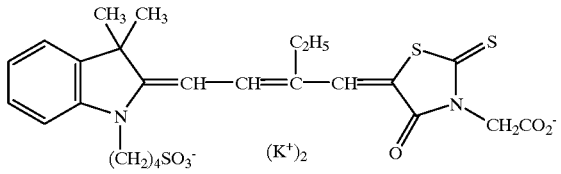

5-32

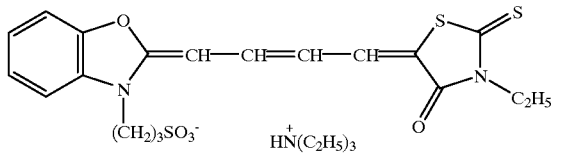

5-33

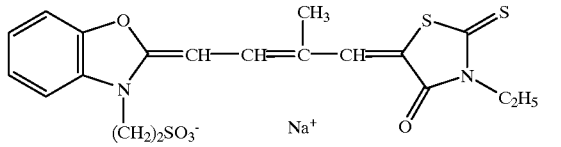

5-34

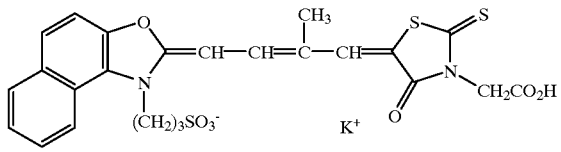

In the compounds represented by Formula (6), the water-solubilizing group to be substituent of the groups represented $R^{10}$, $R^{11}$, $R^{12}$, $R^{13}$ or $R^{14}$ is an acidic group such as a sulfo group, a carboxyl group, a phosphono group, a sulfate group and sulfino group.

Examples of the aliphatic group represented by $R^{10}$, $R^{11}$, $R^{12}$, $R^{13}$ or $R^{14}$ include a branched- or linear-chain alkyl group such as a methyl group, an ethyl group, an n-propyl group, an n-pentyl group and an isobutyl group, an alkenyl group having 3 to 10 carbon atoms such as a 3-butenyl group and a 2-propenyl group, and an aralkyl group having 3 to 10 carbon atoms such as a benzyl group and a phenetyl group. $R^{11}$ is an aliphatic group having not more than 8 carbon atoms and substituted with a water-solubilizing group such as a carboxymethyl group, a sulfoethyl group, a sulfopropyl group and a sulfobutyl group.

Examples of the aryl group represented by $R^{10}$, $R^{12}$, $R^{12}$ or $R^{14}$ include a phenyl group, and that of the heterocyclic group represented by $R^{10}$, $R^{12}$, $R^{12}$ or $R^{14}$ includes a 2- and 4-pyridyl groups, a 2-furyl group, a 2-thienyl group, a sulforanyl group, tetrahydrofuryl group and piperidinyl group. The group represented by $R^{10}$, $R^{12}$, $R^{12}$ or $R^{14}$ may be substituted by a substituent such as a halogen atom and an alkoxyl group.

Examples of the aliphatic group having a water-solubilizing group include a carboxymethyl group, a sulfoethyl group, a sulfobutyl group, a sulfopentyl group, a 3-sulfobutyl group, a 6-sulfo-3-oxahexyl group, a ω-sulfopropoxy-carbonylmethyl group, a ω-sulfopropylaminocarbonylmethyl group, a 3-sulfinobutyl group, a 3-phosphonopropyl group, a 4-sulfo-3-butenyl group, a 2-carboxy-2-propenyl group, an o-sulfo-benzyl group, a p-sulfophenetyl group and a p-carboxybenzyl group. Examples of the aryl group having a water-solubilizing group include a p-sulfophenyl group and a p-carboxyphenyl group, and those of the heterocyclic group having a water-solubilizing group include a 4-sulfothienyl group and a 5-carboxypyridyl group.

Examples of the 5- or 6-member nitrogen-containing heterocyclic ring represented by $Z^{11}$, which may be condensed with another ring, include condensed rings such as a benzoxazole ring, a 4,5,6,7-a tetrahydrobenzoxazole ring, a naphtho[1,2-d]oxazole ring, a naphtho[2,3-d]oxazole ring, a benzothiazole ring, a 4,5,6,7-tetrahydrobenzothiazole ring, a naphtho[1,2-d]thiazole ring, a naphtho[2,3-d]thiazole ring, a benzoselenazole ring and a naphtho[1,2-d]selenazole ring.

Examples of the group to be substituted with the methine group represented by $L^{11}$ or $L^{12}$ include a lower alkyl group such as a methyl group and an ethyl group, a phenyl group such as a phenyl group and a carboxyphenyl group, an alkoxyl group such as a methoxy group and an ethoxy group, and an aralkyl group such as a benzyl group.

Example of the electron withdrawing group represented by $E^1$ or $E^2$ is a cyano group.

As to the compound represented by Formula 6, a high spectral sensitivity usually can be obtained when one of methine groups represented by $L^{11}$ and $L^{12}$. It is found that such the compound is easily decolored in the processing solution. Accordingly such the compound is advantageous to reduce the stain caused by remained dye.

$M^{11}$ represents a cation or an acid anion. Concrete examples of the cation include a proton, an organic ammonium ion such as a triethylammonium ion and a triethanolammonium ion, an inorganic cation such as a lithium ion, a sodium ion and a calcium ion. Examples of the acid anion include a halogen ion such as a chorine ion, a bromine ion, and an iodine ion, a p-toluenesulfonic acid ion, a perchlorate ion and a boron tetrafluoride ion. $n^{11}$ is 0 when the charge is neutralized by formation of an intramolecular salt.

Exemplary examples of the dye represented by Formula (6) are shown below. However, the dye usable in the invention is not limited thereto.

6-1

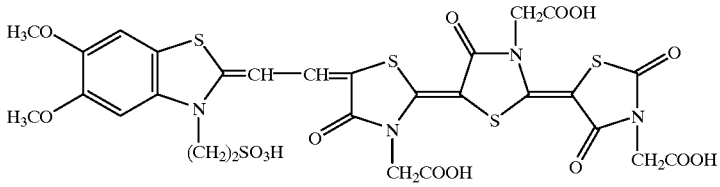

6-2

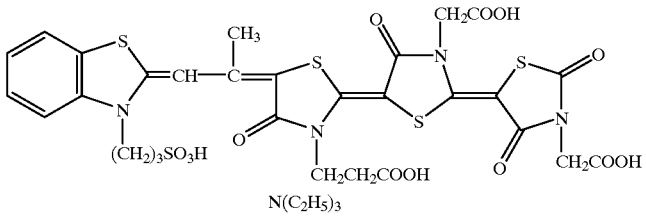

6-3

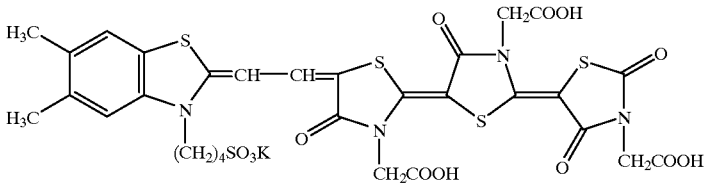

6-4

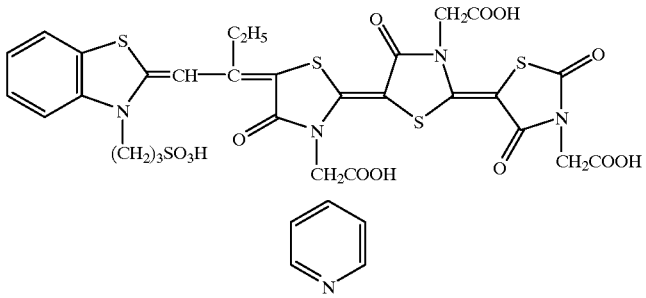

-continued
6-5
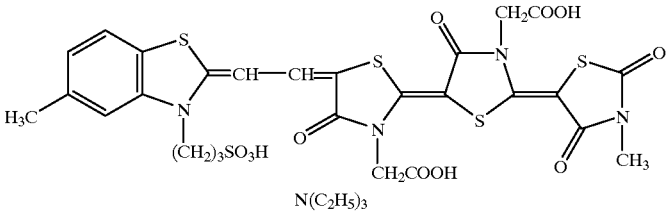
6-6
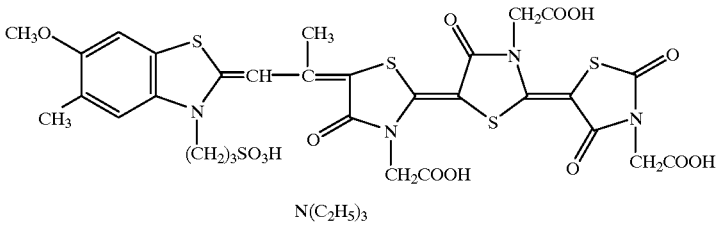
6-7
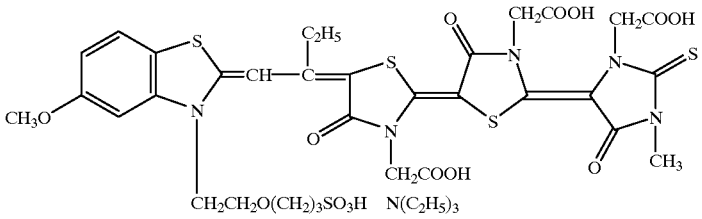
6-8
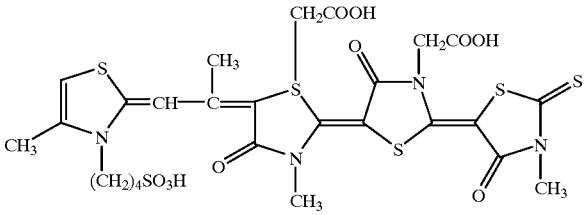
6-9
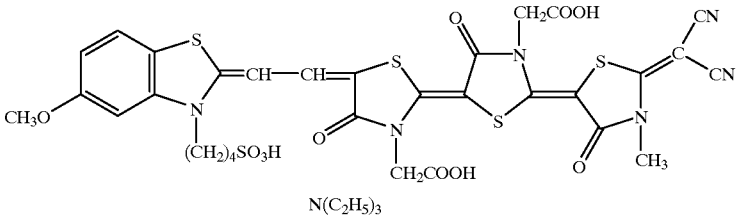
6-10
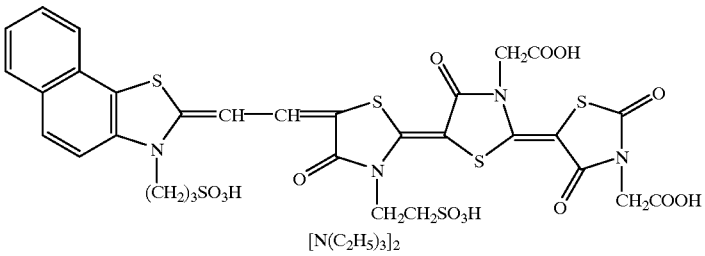

-continued
6-11
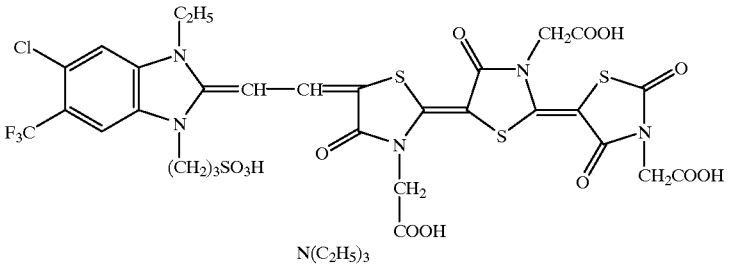
6-12
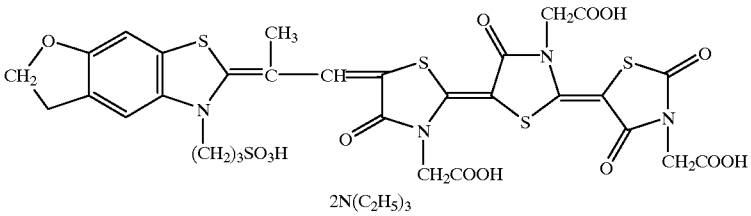
6-13
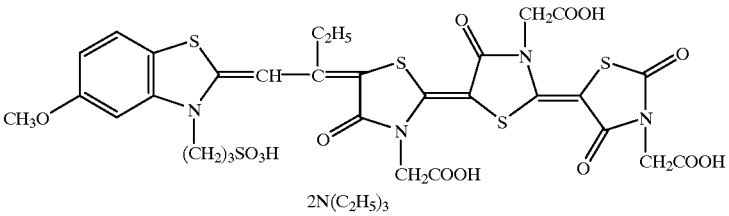
6-14
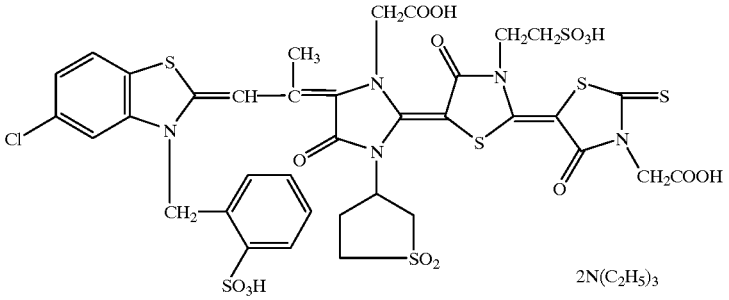
6-15
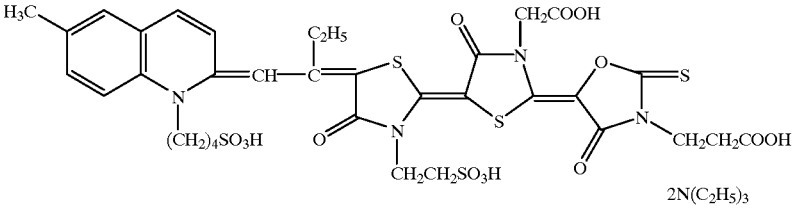
6-16
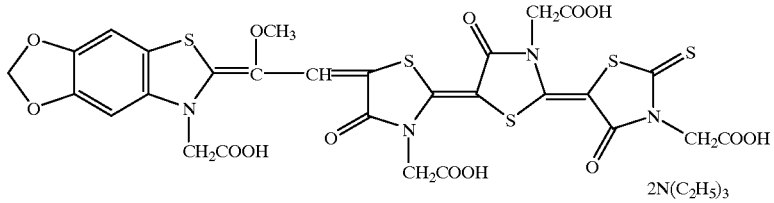

-continued
6-17
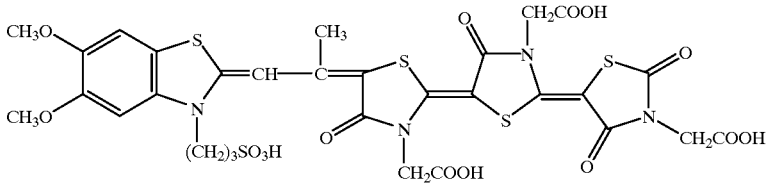
$2N(C_2H_5)_3$
6-18
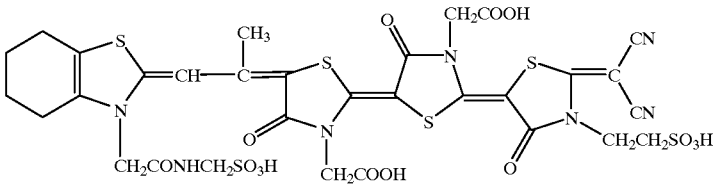
$N(C_2H_5)_3$
6-19
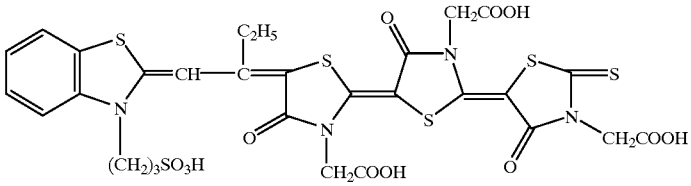
$N(C_2H_5)_3$
6-20
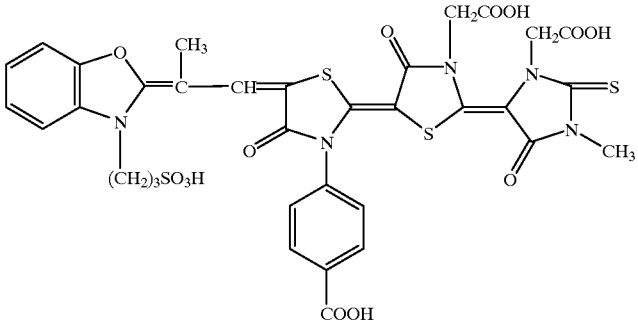
6-21
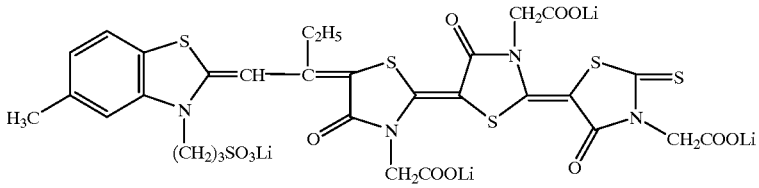
6-22
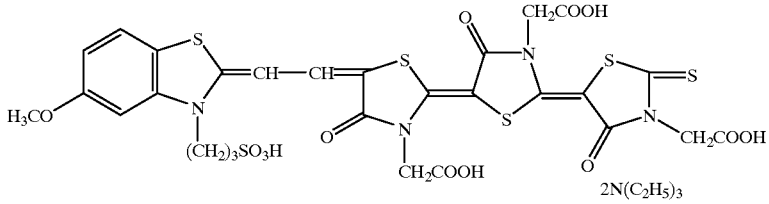
$2N(C_2H_5)_3$ -continued
6-23
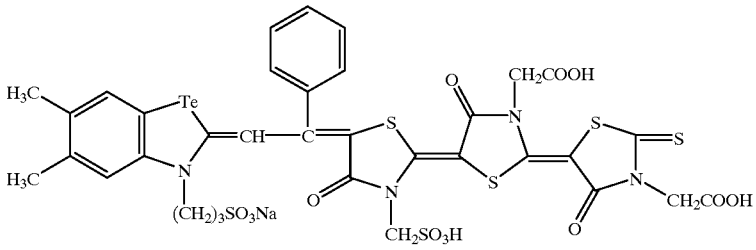
6-24
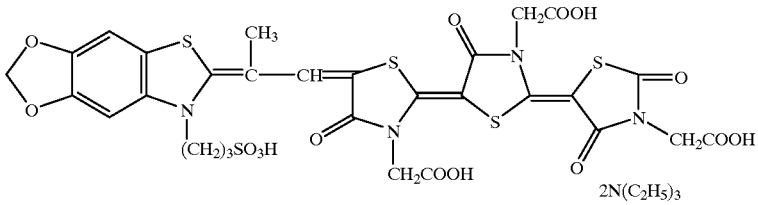
6-25
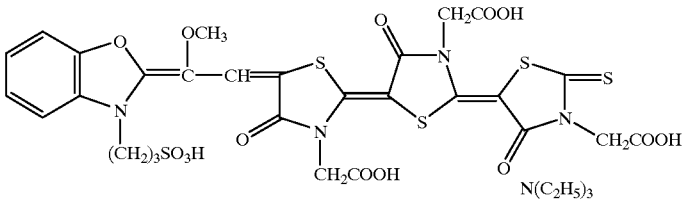
6-26
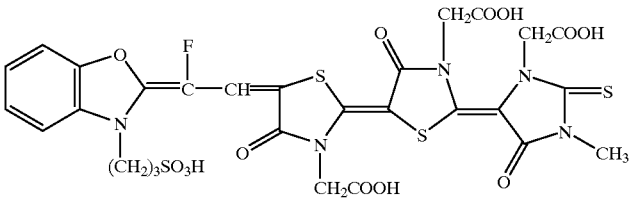
6-27
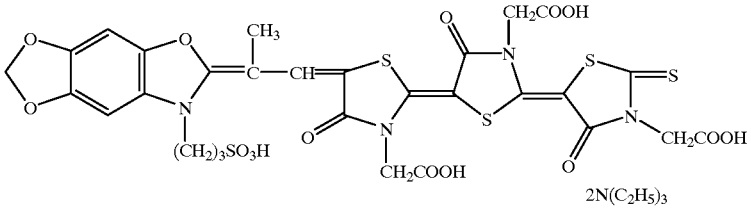
6-28
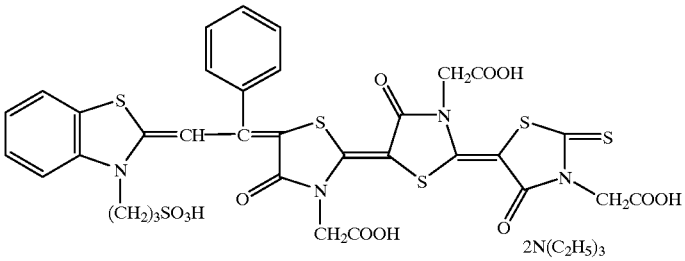

-continued 6-29

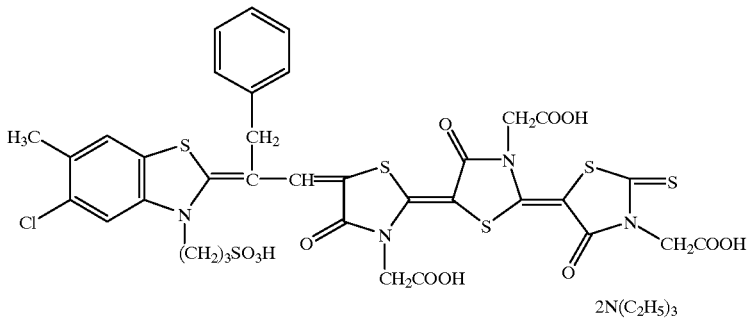

The foregoing compounds can be easily synthesized referring the known methods disclosed in, for example, F. M. Hamer "Cyanine dyes and Related Compounds" Inter Science Publishers, 1964, U.S. Pat. Nos. 2,454,629 and 2,493,748.

The foregoing dyes may be added to the silver halide emulsion by adding and dissolving into the coating solution or dissolving in a solvent such as water, methanol, ethanol, a cetone or a mixture thereof and adding into the coating solution. The compound may be added in a form of powder. The compound ma y be added to a layer adjacent to the emulsion layer such as a protective layer or an interlayer according to necessity. as long as any influence is not formed on the photographic property.

The amount of the sensitizing dye to be added into the silver halide emulsion relating to the invention is preferably within the range of from $5\times10^{-6}$ to $2\times10^{-1}$ moles per mole of silver halide even though the amount may be changed depending on the kind of silver halide emulsion or that of the dye.

The effects of the present invention are enhanced when an ultra-high contrast light-sensitive material which contains a compound represented by Formula H is subjected to a rapid processing for a time of 15 to 120 sec. (preferably, 15 to 60 sec.) from the start to the finish of drying, dry to dry. Further, when the light-sensitive material is transported at a speed of 400 to 3,000 mm/min. in the processor, the effects of the invention are also enhanced.

Compound represented by the following Formula (Ha) are preferable among the hydrazine compounds represented by Formula (H).

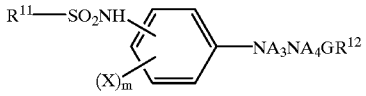

In the formula, $R^{11}$ represents an aliphatic group such as an octyl group and a decyl group, an aromatic group such as a phenyl group, a 2-hydroxyphenyl group and a chlorophenyl group, or a heterocyclic group such as a pyridyl group, a thienyl group and a furyl group. These groups each may preferably have an optional substituent. Moreover, it is preferable that $R^{11}$ has at least a ballast group or a group capable of accelerating adsorption to silver halide.

As the ballast group, a group usually used for in immobile photographic additives such as a coupler is preferably used. Examples of the ballast group include a group which has 8 or more carbon atoms and is relatively inactive on the photographic property such as an alkyl group, an alkenyl group, an alkoxyl group, a phenyl group, a phenoxy group and an alkylphenoxy group.

Examples of the group capable of accelerating adsorption to silver halide include a thiourea group, a thiourethane group, a mercapto group, a thioether group, a thione group, a heterocyclic group, a thioamidoheterocyclic group, a mercapto-heterocyclic group, and adsorption accelerating groups described in JP O.P.I. No. 64-90439.

In Formula (Ha), X is a group substitutable to the phenyl group, m is an integer of from 0 to 4, and plural X may be the same or different when m is 2 or more.

In Formula (Ha), $A_3$ and $A_4$ are the same as $A_1$ and $A_2$ in Formula H. It is preferable that both of $A_3$ and $A_4$ are hydrogen atoms.

In Formula (Ha), G is a carbonyl group, a sulfonyl group, a sulfoxy group. a phosphoryl group or an iminomethylene group, and the carbonyl group is preferred.

In Formula (Ha), $R^{12}$ is a hydrogen atom, an alkyl group, an alkenyl group, an alkynyl group, an aryl group, a heterocyclic group, a carbamoyl group or an oxycarbonyl group, and these groups each may have a substituent. Examples of the preferable group represented by $R^{12}$ include a substituted alkyl group in which the carbon atom bonded with G is substituted with at least one electron withdrawing group, a —$COOR^{13}$ group and a —$CON(R^{14})(R^{15})$ group, in which $R^{13}$ is an alkynyl group or a saturated heterocyclic group, $R^{14}$ is a hydrogen atom, an alkyl group, an alkenyl group, an alkynyl group, an aryl group or a heterocyclic group, and $R^{15}$ is an alkenyl group, an alkynyl group, a saturated heterocyclic group, a hydroxyl group or an alkoxyl group. An alkyl group substituted with two electron withdrawing groups is more preferable and an alkyl group substituted with three electron withdrawing groups is particularly preferable. The electron withdrawing group to be substituted to the carbon atom of $R^{12}$ bonding with G is preferably one having a $\sigma_p$ value of not less than 0.2, more preferably one having a $\sigma_p$ value of not less than 0.3. Examples of such the electron withdrawing group include a halogen atom, a cyano group, a nitro group, a nitrosopolyhalo-alkyl group, a polyhaloaryl group, an alkylcarbonyl group, an arylcarbonyl group, a formyl group, an alkyloxycarbonyl group, an aryloxycarbonyl group, an alkylcarbonyloxy group, a carbamoyl group, an alkylsulfinyl group, an arylsulfinyl group, an alkylsulfonyl group, an arylsulfonyl group, an alkyl-sulfonyloxy group, an arylsulfonyloxy group, a sulfamoyl group, a phosphino group, a phosphine oxide group, a sulfonate group, a sulfonic amido group, an arylazo group, an adimino group, an ammonio group, a sulfonio group and an electron deficient heterocyclic group.

$R^{12}$ in Formula (Ha) is particularly preferably a fluorine-substituted alkyl group, a monofluoromethyl group, difluoromethyl group and trifluoromethyl group.

Concrete examples of the dye represented by Formula (H) are shown below. However, the dye usable in the invention is not limited thereto.
H-1
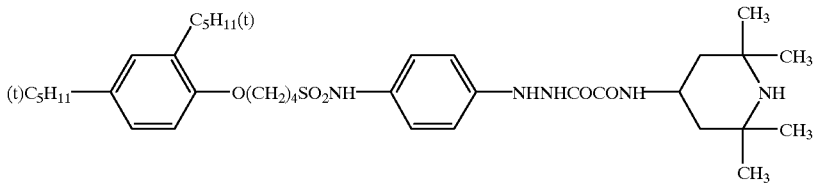
H-2
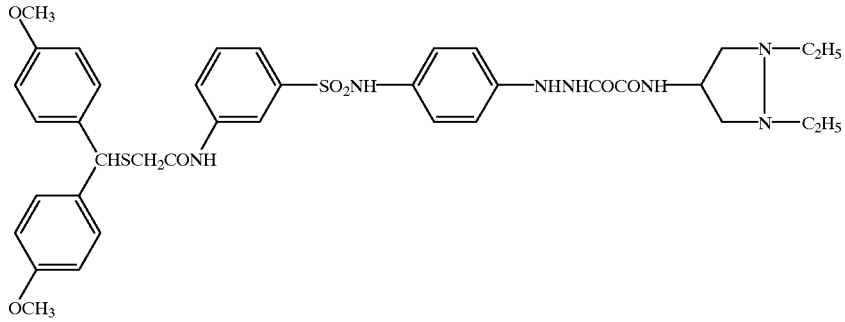
H-3
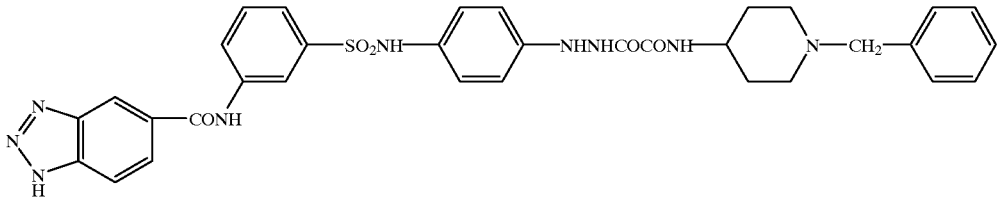
H-4
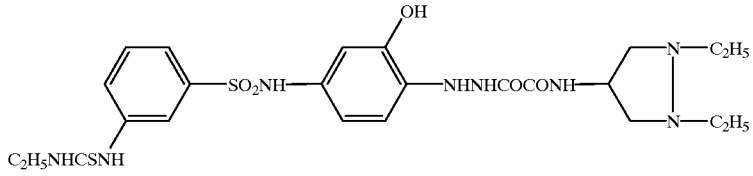
H-5
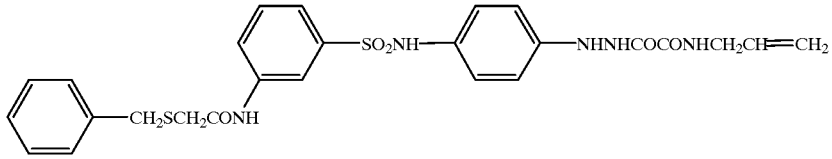
H-6
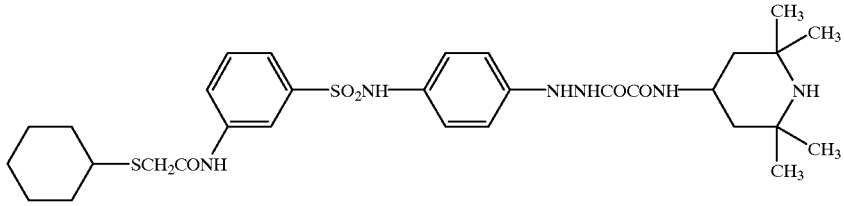

-continued
H-7
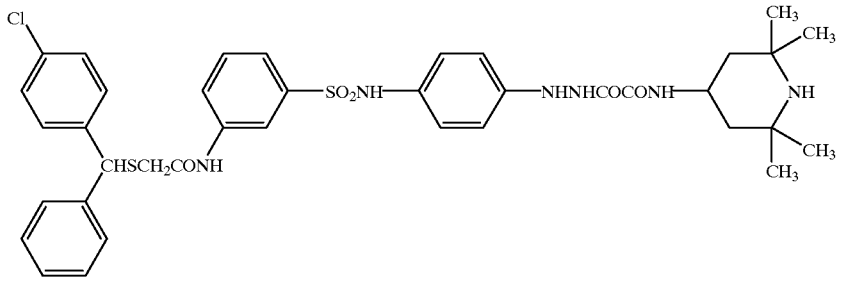
H-8
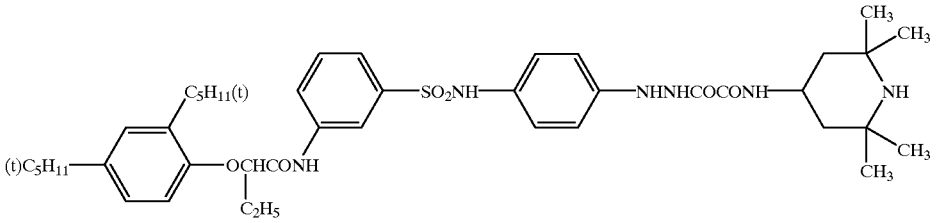
H-9
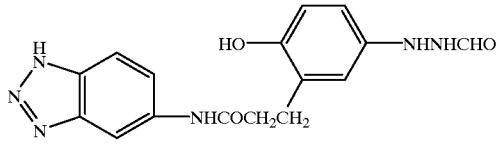
H-10
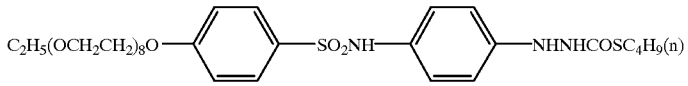
H-11
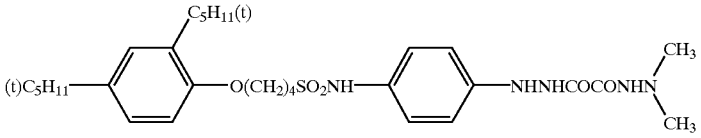
H-12
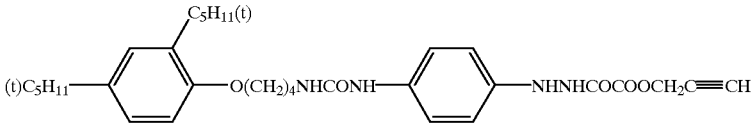
H-13
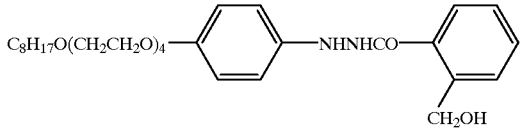
H-14
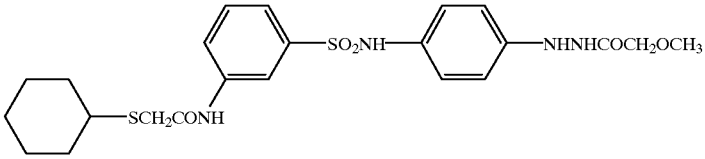

-continued
H-15
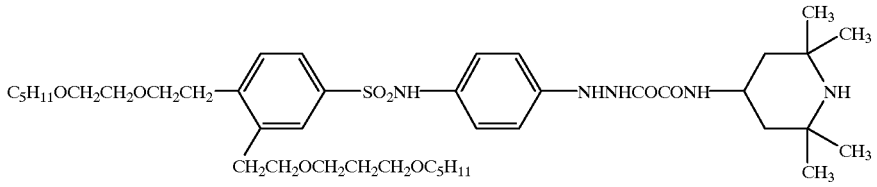
H-16
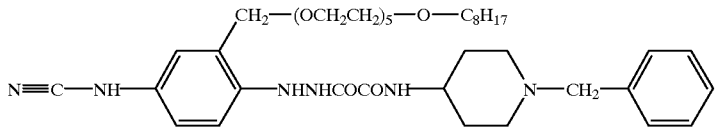
H-17
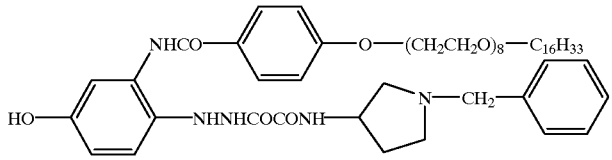
H-18
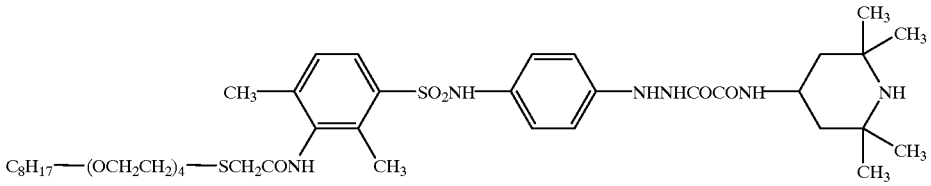
H-19
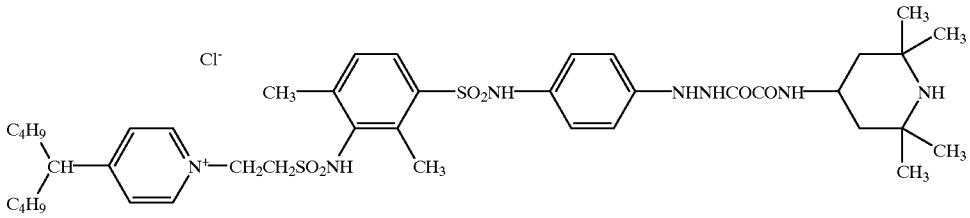
H-20
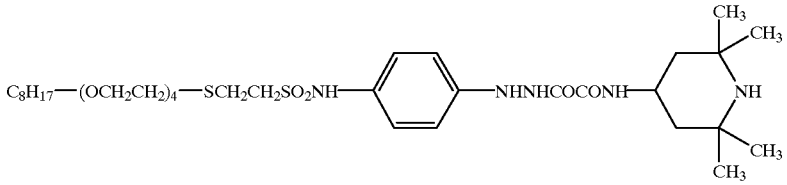
H-21
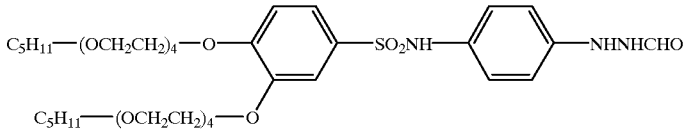
H-22
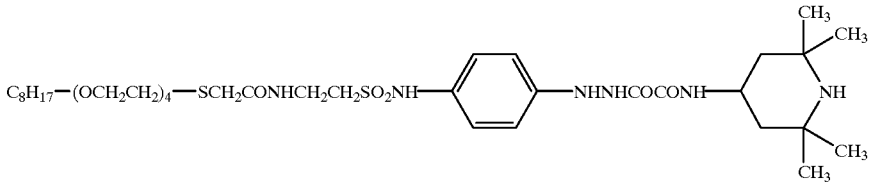

-continued
H-23
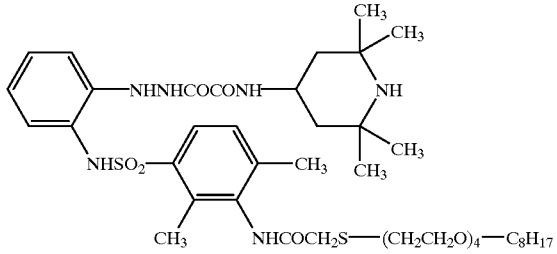
H-24
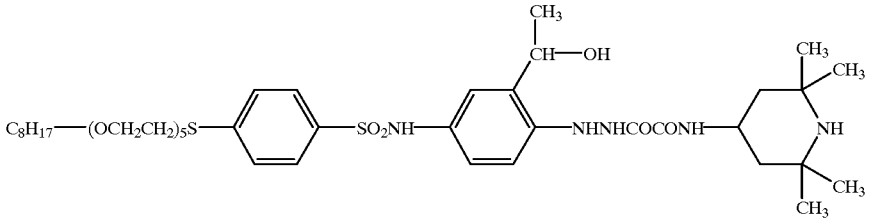
H-25
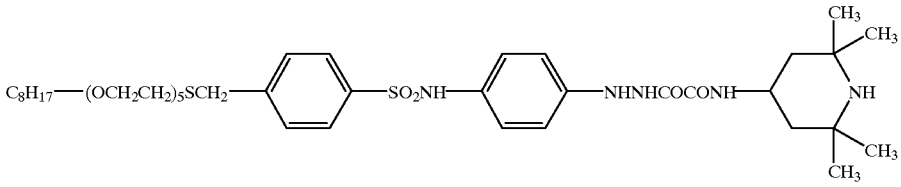
H-26
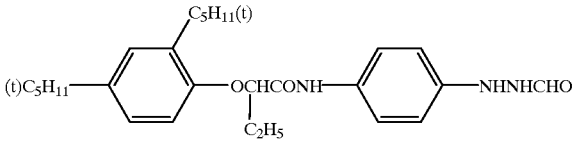
H-27
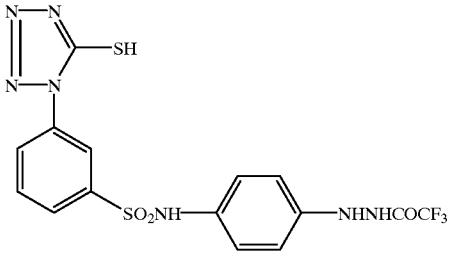
H-28
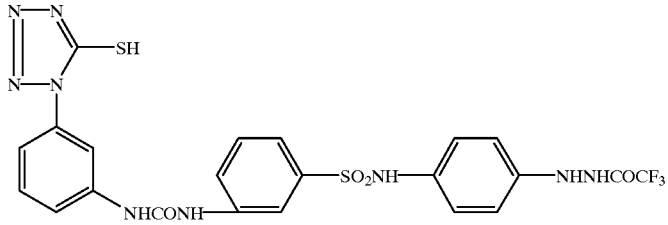
H-29
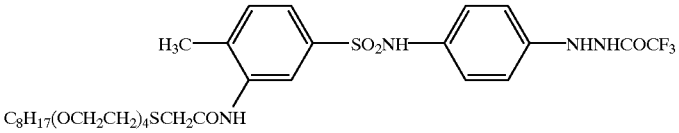
H-30
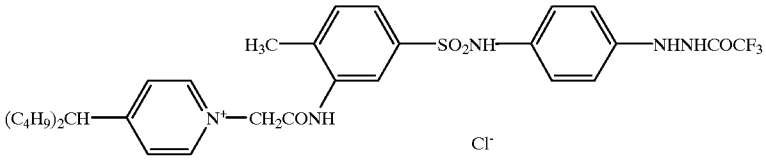

-continued
H-31
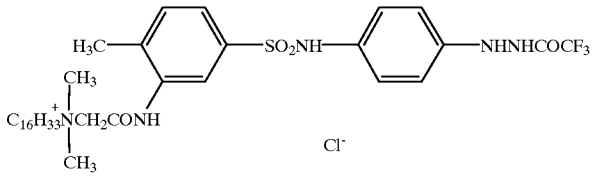
H-32
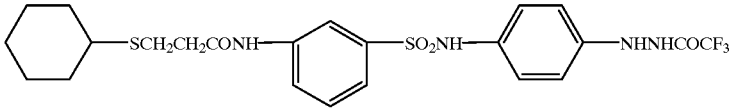
H-33
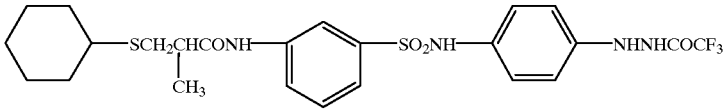
H-34
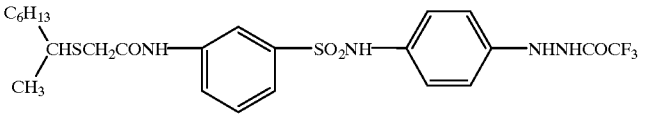
H-35
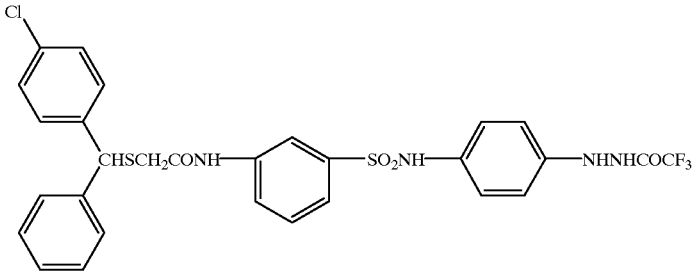
H-36
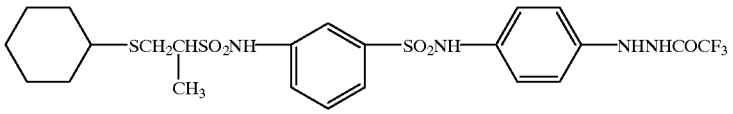
H-37
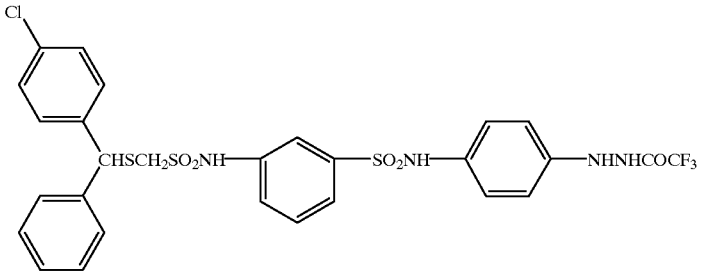
H-38
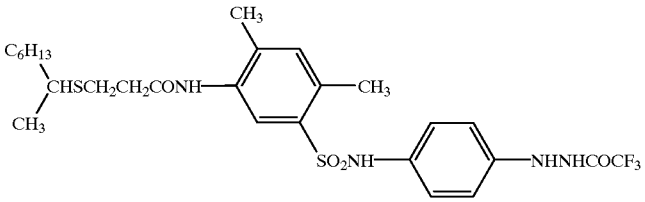

-continued
H-39
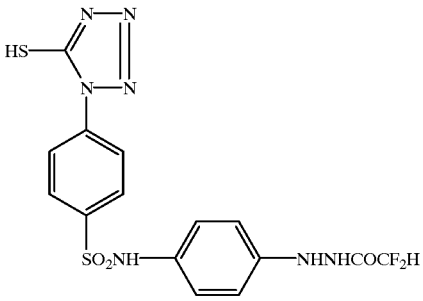
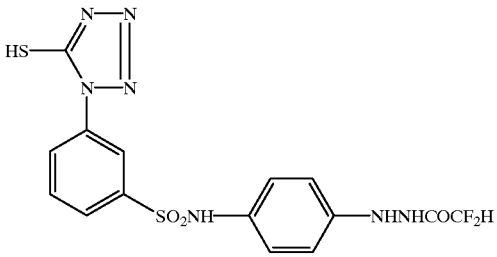
H-41
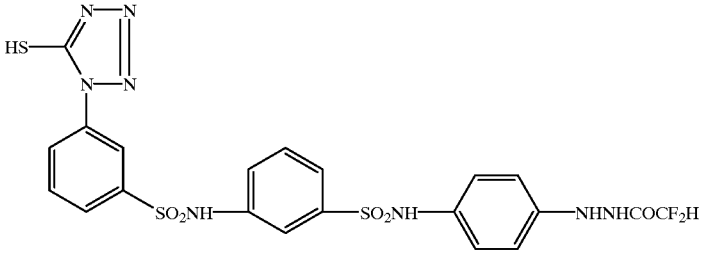
H-42
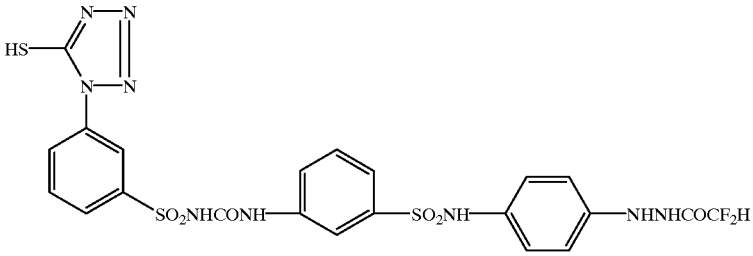
H-43
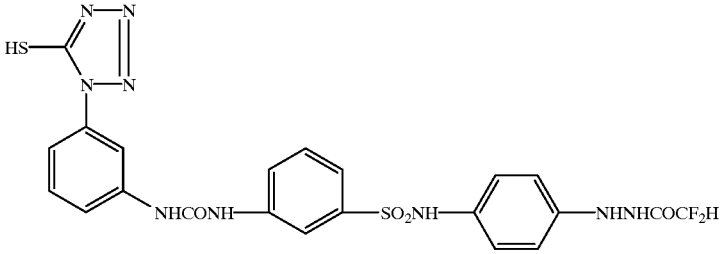
H-44
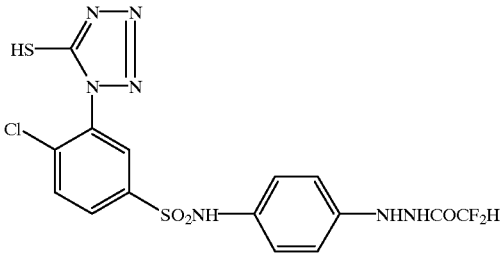
H-45
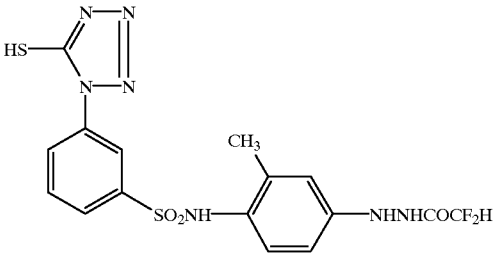
H-46
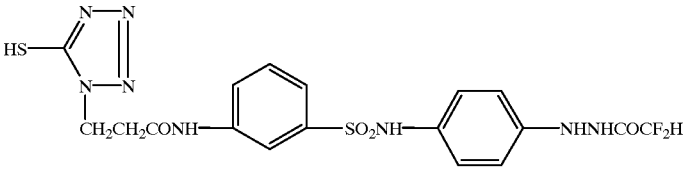

-continued
H-47
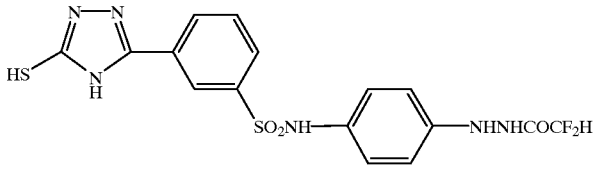
H-48
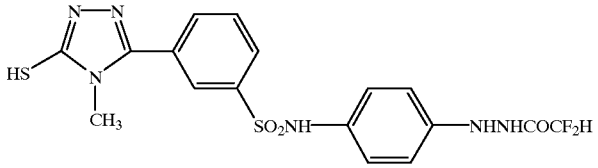
H-49
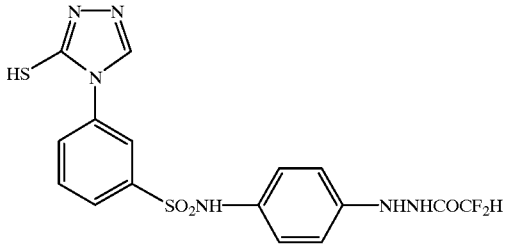
H-50
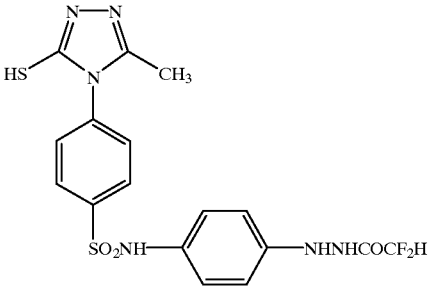
H-51
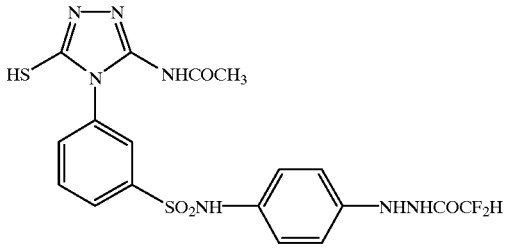
H-52
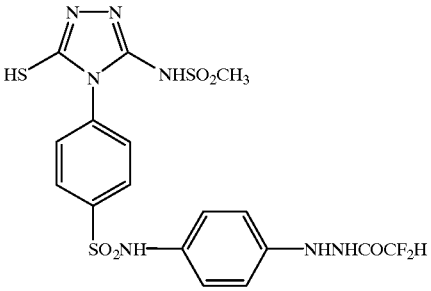
H-53
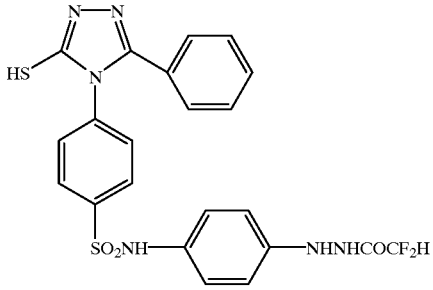
H-54
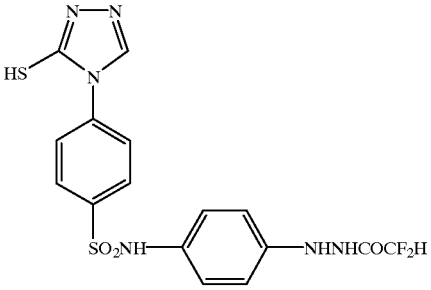
H-55
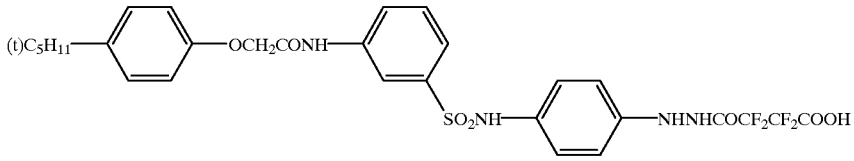

-continued
H-56
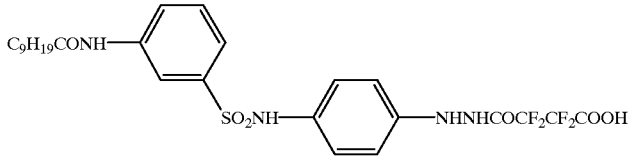
H-57
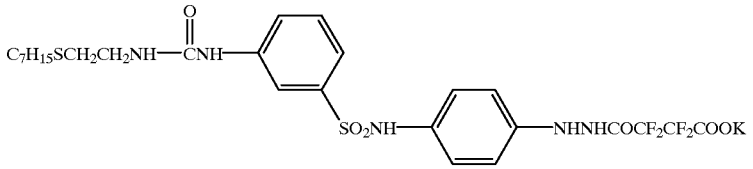
H-58
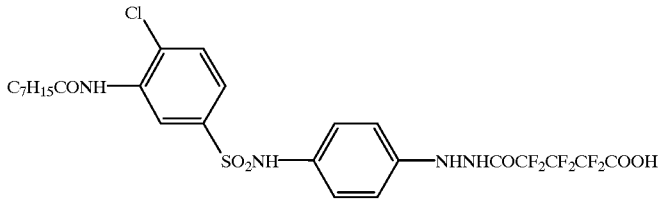
H-59
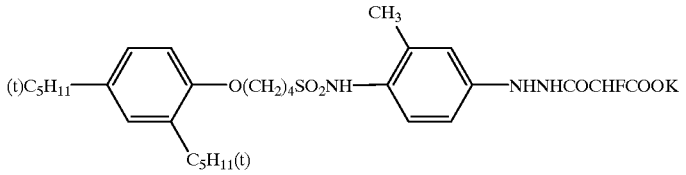
H-60
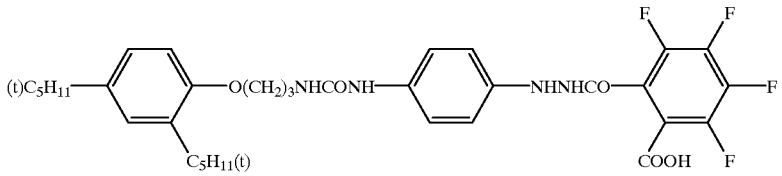
H-61
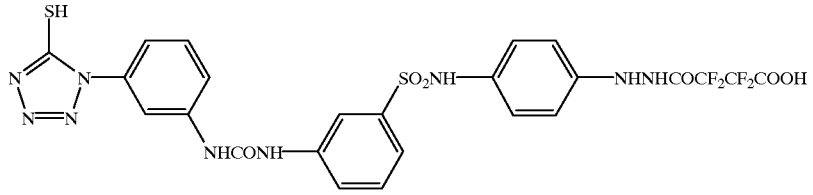
H-62
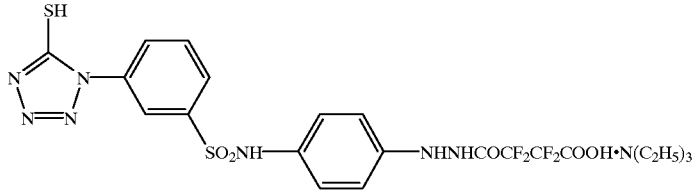
H-63
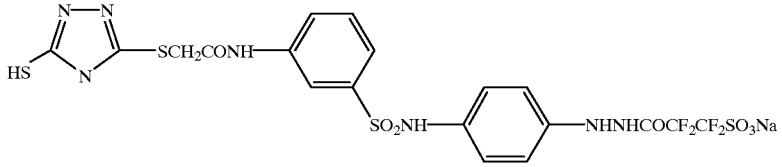

Examples of preferable hydrazine compound other than the above-mentioned are (1) to (252) described in columns 4 to 60 of U.S. Pat. No. 5,229,248. These hydrazine compounds can be synthesized by the method described on columns 59 to 80 of the foregoing US Patent.

The adding amount of the hydrazine compound may be an amount sufficient to make an ultra-high contrast image. The amount is usually within the range of from $10^{-6}$ to $10^{-1}$ moles, preferably $10^{-5}$ to $10^{-2}$ moles, per mole of silver halide even though the optimal amount is changed depending on the diameter, the halide composition and the degree of chemical sensitization of the silver halide grain and the kind of inhibitor. The hydrazine compound is added into at least one layer provided on the emulsion coated side of the light-sensitive material. It is preferable that the hydrazine compound is added into the silver halide emulsion layer and/or a layer adjacent to the emulsion layer and addition into the emulsion layer is particularly preferred. The amount off the hydrazine derivative contained in the photographic constitution layer arranged at the position nearest to the support is from 0.2 to 0.8 mole-equivalent, preferably from 0.4 to 0.6 mole-equivalent, of the total amount of the hydrazine derivative contained in a photographic constitution layer arranged at a position farther to the support. In the invention, the hydrazine derivative may be used singly or in combination of two or more kinds thereof.

It is preferable that the following techniques are utilized in the light-sensitive material.

(1) Dispersion of fine solid particle of dye

Compounds described in JP O.P.I. No. 7-5629, [0017] on page (3) to [0042] on page (16)

(2) Compound having an acidic group

Compounds described in JP O.P.I. No. 62-237445, line 11 of lower-left column on page 292(8) to line 3 of lower-right column on page 309(25)

(3) Acidic polymer

Compounds described in JP O.P.I. No. 6-186659, [0036] on page (10) to [0062] on page (17)

(4) Sensitizing dye

Compounds described in JP O.P.I. No. 5-224330, [0017] on page (3) to [0040] on page (13)

Compounds described in JP O.P.I. No. 6-194771, [0042] on page (11) to [0094] on page (22)

Compounds described in JP O.P.I. No. 6-242533, [0015] on page (2) to [0034] on page (8)

Compounds described in JP O.P.I. No. 6-337492, [0012] on page (3) to [0056] on page (34)

Compounds described in JP O.P.I. No. 6-337494, [0013] on page (4) to [0039] on page (14)

(5) Super sensitizer

Compounds described in JP O.P.I. No. 6-347938, [0011] on page (3) to [0066] on page (16)

(6) Nucleation accelerating agent

Compounds described in JP O.P.I. No. 7-114126, [0158] on page (36) to [0169] on page (36)

(7) Tetrazolium compound

Compounds described in JP O.P.I. No. 6-208188, [0059] on page (8) to [0067] on page (10)

(8) Pyridinium compound

Compounds described in JP O.P.I. No. 7-110556, [0028] on page (5) to [0068] on page (29)

(9) Redox compound

Compounds described in JP O.P.I. No. 4-245243, on page 235(7) to page 250(22)

(10) PSP support

Support described in JP O.P.I. No. 3-54551

Known usable additives other than the above-mentioned are described in, for example, Research Disclosure No. 17643, December 1978, No. 18716, November 1979 and No. 308119, December 1989.

An automatic processor having at least four process, namely processes of developing, fixing, washing including stabilizing and drying, is used in the invention.

Known developing agnes such as hydroxybenzene compounds, 3-pyrazolidone compounds, aminophenol compounds, ascorbic acid compounds and metal complexes may be used singly or in combination in the developing solution. An alkaline agent such as sodium hydroxide and potassium hydroxide and a pH buffering agent such as a carbonate, a phosphate, a borate, boric acid, acetic acid, citric acid and alkanolamine are preferably added into the developing solution.

Moreover, a conservative, a dissolving aid, a sensitizer, a surfactant, a defoaming agent, a fog inhibitor, a chelating agent, a development accelerator and a hardener may be added to the developing solution according to necessity. It is preferable that the pH value of the developing solution is adjusted within the range of from 7.5 to not more than 10.5, more preferably from 8.5 to 10.4.

A fixing solution having an usual composition can be used. A thiosulfate such as sodium thiosulfate, potassium thiosulfate and ammonium thiosulfate, a thiocyanate such as sodium thiocyanate, potassium thiocyanate and ammonium thiocyanate, and an organic sulfur composition capable of forming a soluble stable silver complex salt known as a fixing agent are usable as the fixing agent.

Although a water-soluble aluminum salt such as aluminum chloride, aluminum sulfate and potassium alum, and an aldehyde compound such as glutaraldehyde and an adduct of glutaraldehyde with sulfite, each functioning as a hardening agent may be added to the fixing solution, the image formed by the method according to the invention is excellent even when such the hardening agent is not added. Effects of the invention are further enhanced when the fixing solution is substantially free of an aluminum compound. Herein, the expression "substantially free of an aluminum compound" means that the aluminum compound is preferably not more than 0.01 mol/l.

The fixing solution may contain a conservative such as a sulfite and a bisulfate, a pH buffering agent such as acetic acid and citric acid, a pH controlling agent such as sulfuric acid and a chelating agent having a water softening ability.

It is preferable in the invention that the concentration of ammonium ion is not more than 0.1 moles per liter of the fixing solution. A concentration within the range of from 0 to 0.05 moles per liter is particularly preferred. The concentration of acetic acid ion in the fixing solution is preferably from less than 0.33 moles per liter.

The washing treatment is preferably carried out using washing water containing a cleaning agent which contains an oxidizing agent and a germicide. An oxide of a metal or non-metal, an oxo-acid and a salt thereof, a peroxide compound, and a compound containing an organic acid system are usable as the oxidizing agent. Sulfuric acid, nitrous acid, nitric acid and hypochloric acid are preferable as the oxo-acid and hydrogen peroxide and phentonic acid agent are preferable as the peroxide compound, and hydrogen peroxide is most preferred from the viewpoint of draining of water to a sewerage.

Any germicide can be used as long as it does not give bad influence on the photographic property. In concrete, various antibacterial agents and antimold agents are usable which include the followings: a thiazolylbenzimidazole compound, an isothiazolone compound, a chlorophenol compound, a bromophenol compound, a thiocyanic acid compound, an isothiocyanic acid compound, an acid azide compound, a diazine compound, a triazine compound, a thiourea compound, an alkylguanidine compound, a quater ammonium salt, an organic tin compound, an organic zinc compound, a cyclohexylphenol compound, an imidazole compound, a benzimidazole compound, a sulfamide compound, an active halogen compound such as sodium chlorinated isocyanulate, a cheleting agent, a sulfite compound, an anti-biotic such as penicillin. Moreover, the germicides described in L. E. West, "Water Quality Criteria" Phot. Sci. and Eng., Vol. 9, No. 6, 1965, various kinds of anti-mold agents described in JP O.P.I. Nos. 57-8542, 58-105145, 59-126533, 55-11194 and 57-157244, and the compounds described in H. Horiguchi "Chemistry of" Sankyou Shuppan, 1982, and "Hand Book of Anti-bacterium and Anti-mold Technology" edited by Nihon Boukinn Boubai Gakkai, Gihoudou, 1986, are also usable.

In the invention, it is preferable that the moisture content of the light-sensitive material after the processing of developing, fixing and washing is not more than 18 g/m$^2$ and the moisture content of the light-sensitive material just after passing through each of the squeezing rollers of the processes of developing, fixing and washing is not less than 50% of the moisture content after passing through each of the processing baths, respectively. The moisture content is measured by the following procedure.

The emulsion side of a sample of light-sensitive material having a size of 8 cm×12.5 cm is blackened and the sample processed by the step at which the moisture content is measured. The processed sample is set between two sheets of blotting paper and passed between two rollers to remove water drops on the surface of the sample. Then the sample is put on a flat glass plate so as to contact the emulsion side of the sample to the glass plate to prevent the evaporation of moisture and the weight of the sample (weight 1) is weighed together with the glass plate. After the weighing, the sample is dried for 24 hours in a room conditioned at a temperature of 23° C. and a relative humidity of 48%. After the drying, the weight of the sample is measured together with the glass plate (weight 2). The different between weight 1 and weight 2 per square meter is determined from the measured weight.

The automatic processor to be used in the invention includes at least a developing process, a fixing process, a washing process and a drying process. It is preferable that the light-sensitive material is transported while being held on a rotating roller having a width larger than that of the light-sensitive material.

The "washing process" in this specification includes all process having a function for washing off the fixing solution. The process is usually performed by transporting the light sensitive material through a tank or a washing tank filled with a solution. However, a process in which the solution is sprayed onto the light-sensitive material while transporting, or a process in which the solution is supplied to the light-sensitive material by coating the solution, are also included in the washing process according to the invention. In the process in which the light-sensitive material is transported through the tank filled by the solution, includes a process in which the washing is performed while supplying washing water, a process in which the washing is performed by using water standing in the tank, a processing in which a part of water is recycled after a treatment by filtering, ozone or light, and a process in which a solution, so-called stabilizing solution or rinsing solution containing an anti-molding agent, a chelating agent, an oxidant or a surfactant, is replenished depending on the processed amount of light-sensitive material. Although such the process is usually performed at an ordinary temperature, the process may be performed at a temperature from 30° C. to 50° C. The number of the tank may be single or plural. When plural tanks are used, a multi-step counter-flow method may be applied in which the solution overflowed from a tank is supplied to another tank arranged at a preceding position. Moreover, a non-pipe processing may performed when the stabilizing solution, in such the case the processor is not necessary to be directly connected to the city water pipe. A rinsing bath may be arranged at a position before or after each processing tank.

In the invention, the processor has a transportation roller directly contacting with the light-sensitive material in the transportation system arranged after the last washing process at which the solution is directly supplied to the light-sensitive material and an auxiliary roller which is directly contacted with the transporting roller and not contacted with the light-sensitive material. It is necessary that the auxiliary roller is contacted with at least one of the rollers directly relating to transportation of the light-sensitive material, and the auxiliary roller may be contacted with two or more transporting rollers. The transporting rollers contacted with the auxiliary roller may be positioned at any side of the light-sensitive material, the image forming surface and the backing layer, and may be positioned at both sides of the light-sensitive material. The number of the auxiliary roller may be single or plural. A second auxiliary roller not contacted with the light-sensitive material may be existed.

There is no limitation on the raw material and the shape of the auxiliary roller. Various resins and rubbers may be used as the raw material. The auxiliary roller also may be one covered with sponge or cloth. It is particularly preferable that the surface is water absorbable. The auxiliary roller may have a plane surface, a surface having a ditch, a roughened surface, or a porous surface having fine holes. The width of the auxiliary roller is preferably the same as or larger than that of the light-sensitive material to be processed. However, the width of the auxiliary roller may be narrower than that of the light-sensitive material as long as the auxiliary roller is contacted with the transporting roller within the width of the pass of the light-sensitive material. The diameter of the auxiliary roller may be the same as, or larger or smaller than that of the transporting roller.

The auxiliary roller according to the invention may be fixed or not fixed on the processing rack. The auxiliary roller also may be mounted only by the weight of itself.

In the invention, the auxiliary roller may be arranged anywhere after the finish of the last washing process in which the solution is directly supplied to the light-sensitive material, and it is particularly preferable that the roller is arranged at a position between the finish of washing process and the drying process. The auxiliary roller is further preferably positioned in a squeezing process at where water on the light-sensitive material is stripped off. The drying process is a process at where heat energy is provided to the light-sensitive material by applying dried air current or heat radiation such as far infrared rays or by contacting to a heated roller, for removing moisture from the surface or interior of the light-sensitive material. A process in which the moisture is removed by a reduced pressure may be included in the drying process.

Figure 2:
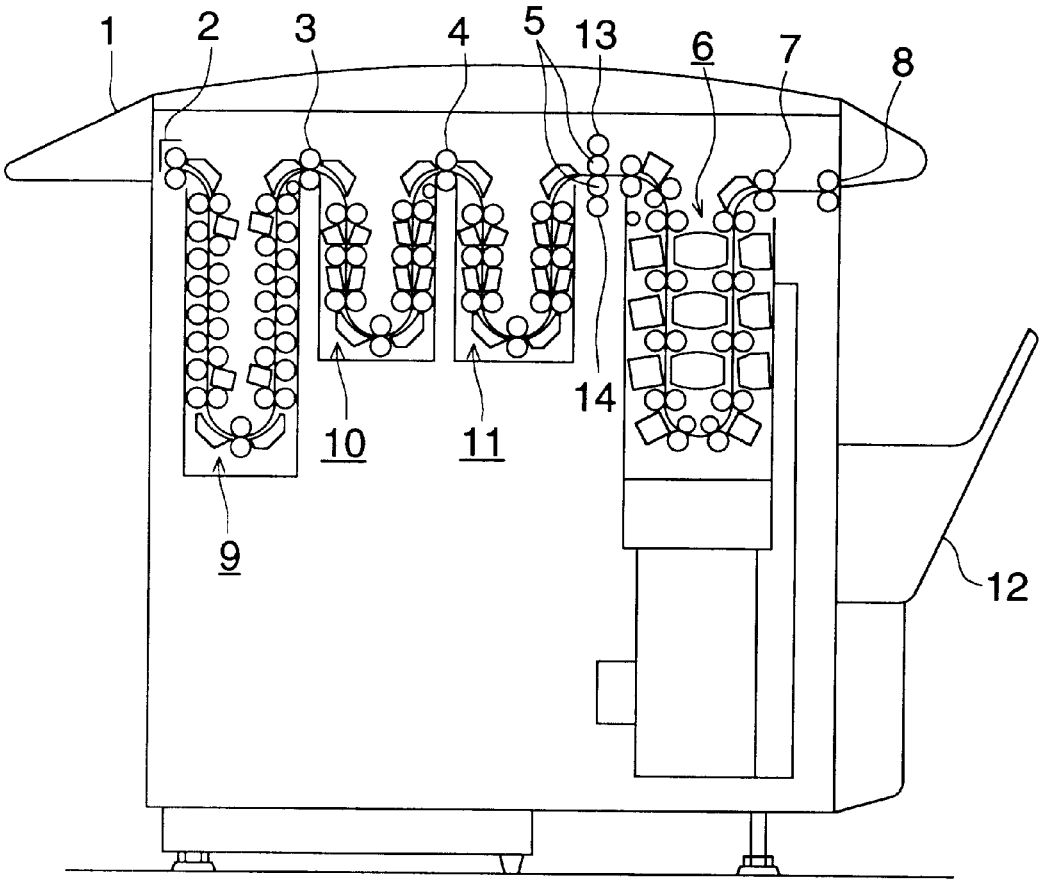
FIG. 2 illustrates the film transport mechanism of an automatic processor used in the invention

The film transporting mechanism of an automatic processor relating to the invention is described according to FIG. 2. In FIG. 2, a silver halide photographic light-sensitive material inserted from a inserting stand 1 is introduced into a developing rack 9 through a cross-over rack 2, and developed. Then the light-sensitive material is transported to a fixing rack 10 through a developing-fixing bridging rack 3. After the fixing, the light-sensitive material is transported to a washing rack 11 through a fixing-washing cross-ver rack 4, and washed. Thereafter, the light-sensitive material is transported to a squeeze rack 5 in which auxiliary rollers 13 and/or 14 are arranged according to the invention. The light-sensitive material is sufficiently dried in a drying rack 6, and the light-sensitive material processed and dried is put into a film basket 12 through a drying outlet guide 7 and a drying outlet rack 8.

Although there is no limitation on the light-sensitive material and the processing solution to be used in the processing, the effect of the invention is enhanced when a silver halide photographic light-sensitive material spectrally sensitized at 600 to 800 nm. A developer is preferable, which contains a developing agent such as a dihydroxybenzene type developing agent, an aminophenol type developing agent, a phenidone type developing agent and an ascorbic acid type developing agent. A fixing solution containing a fixing agent such as a sulfite ion and a thiosulfate ion is preferred. The fixing solution may contains a component having a gelatin hardening ability such as an aluminum compound. These processing solution each may be prepared by diluting a concentrated solution by 1 to 5 times, or by dissolving a solid or semi-solid state processing composition such as one in a form of a tablet, a granule or a paste.

An activator processing may be utilized as a specific embodiment of the processing of the light-sensitive material according to the invention, in which a light-sensitive material containing the developing agent in the emulsion layer thereof is developed by an alkaline solution. Such the developing process is often used as one of rapid processing methods of light-sensitive material in a combination with a silver salt stabilizing process using a thiocyanate. The invention can be applied such the processing solution.

The effect of the invention is enhanced when the transportation speed of the light-sensitive material is from 400 to 3000 mm/min. A transportation speed of from 500 to 2500 mm/min. is particularly preferred. The effect of the invention is enhanced when the total processing time (the period of from the insertion to output of the light-sensitive material) is from 25 to 120 seconds.

EXAMPLES

The invention is described in detail below according to the examples. The embodiment of the invention is not limited to the examples.

Example 1

(Preparation of Silver Halide Emulsion A)

An aqueous silver nitrate solution A and an aqueous solution C of water soluble halide containing NaCl and KBr were added to solution A by a double-jet method spending 30 minutes to prepare a cubic grains composed of 70 mole-% of silver chloride and 30 mole-% of silver bromide having a size of 0.18 $\mu$m. The silver electrode potential ($E_{Ag}$) at the start of mixing was 160 mV and that at the finish of mixing was 100 mV. Thereafter, unnecessary salt was removed by an ultrafilteration and gelatin was added to the emulsion in an amount of 15 g per mole of silver halide. The gelatin was dispersed for 30 minutes at a temperature of 55° C. and a pH of 5.7. After the dispersing, $4\times10^{-4}$ moles per mole of silver halide of Chloramine T was added to the emulsion. Thus finished emulsion had a silver electrode potential of 190 mV at 40° C.

| | | |
|---|---|---|
| A: | Ossein gelatin | 25 g |
| | Nitric acid (5%) | 6.5 ml |
| | Deionized water | 700 ml |
| | $Na[RhCl_5(H_2O)]$ | 0.02 mg |
| B: | Silver nitrate | 170 g |
| | Nitric acid (5%) | 4.5 ml |
| | Deionized water | 200 ml |
| C: | NaC1 | 47.5 g |
| | KBr | 51.3 g |
| | Ossein gelatin | 6 g |
| | $Na_3$ $[IrCl_6]$ | 0.15 mg |
| | Deionized water | 200 ml |

To thus obtained emulsion, $1.5\times10^{-3}$ moles per mole of silver of 4-hydroxy-6-methyl-1,3,3a,7-tetraazaindene, $8.5\times10^{-4}$ moles per mole of silver of potassium bromide were added, and the pH and $E_{Ag}$ of the emulsion were adjusted to 5.6 and 123 mV, respectively. Then the emulsion was chemically ripened at 50° C. for 60 minutes after addition of $2\times10^{-5}$ moles per mole of silver of flower of sulfur dispersed in fine particles and $1.5\times10^{-5}$ moles per mole of silver of chloroauric acid. After the ripening, $2\times10^{-3}$ moles per mole of silver of 4-hydroxy-6-methyl-1,3,3a,7-tetraazaindene, $3\times10^{-4}$ moles per mole of silver of 1-phenyl-5-mercaptotetrazole and $1.5\times10^{-3}$ moles per mole of silver of potassium iodide were added to the emulsion. The temperature of the emulsion was lowered by 40° C., and $1\times10^{-4}$ moles per mole of the sensitizing dye described in Table 1 was added to the emulsion.

Thus obtained Emulsion A was simultaneously coated together with a protective layer, 2nd layer, on a side of a subbed support and cooled to set so that the coating amount per square meter was become to the following Emulsion Receipt A-1. The coating was carried out so that the emulsion layer, 1st layer, and the 2nd layer were arrange in this order from the support side.

Then the following backing layer and backing protective layer were coated in a speed of 200 m/minute on the opposite side of the support having an antistatic layer and a subbing layer and set at −1° C. The coated layers on the both sides of the support were simultaneously dried to prepare a sample. Besides, a sample according to Emulsion Receipt A-2 was prepared in the same manner as in Emulsion Receipt A-1 except that the hydrazine derivative was omitted.

(Support)

The both sides of a biaxis-stretched polyethylene terephthalate support having a thickness of 100 $\mu$m were subjected to corona discharge of 30 W/m$^2$·min. Then a subbing layer having the following composition was coated on the both sides of the support and dried at 100° C. for 1 minute.

(Subbing Layer)

| | |
|---|---|
| Copolymer of 2-hydroxyethyl methacrylate (25)/butyl acrylate (30)/t-butyl acrylate (25)/styrene (20) (the number represents weight ratio) | 0.5 g/m$^2$ |
| Surfactant A | 3.6 mg/m$^2$ |
| Hexamethylene-1,6-bis(ethyleneurea) | 10 mg/m$^2$ |

(Anti-static Layer)

The polyethylene terephthalate support subbed with the above-mentioned was subjected to corona discharge of 10

W/m$^2$·min, and an anti-static layer having the following composition was coated on a side thereof. The coating was carried out in a speed of 70 m/min using a roll fit coating pan and an air knife. The coated layer was dried at 90° C. for 2 minutes and thermally treated at 140° C. for 90 seconds.

| | |
|---|---|
| Water-soluble electric conductive polymer B | 0.6 g/m$^2$ |
| Hydrophobic polymer particle C | 0.4 g/m$^2$ |
| Polyethylene oxide compound (MW 600) | 0.1 g/m$^2$ |
| Hardener E | 0.1 g/m$^2$ |
| 1st layer (Emulsion layer) | |
| Gelatin | 1.0 g |
| Silver halide emulsion A (in terms of silver) | 3.3 g |
| 5-nitroindazole | 0.01 g |
| 2-mercaptohypoxantine | 0.02 g |
| Suspension of polymer of 75 weight-% of colloidal silica, 12.5 weight-% of vinyl acetate and 12.5 weight-% of vinyl pivarate | 1.4 g |
| Dextran (weight average molecular weight: 65,000) | 0.10 g |
| 4-mercapto-3,5,6-fluorophthalic acid | 0.05 g |
| Sodium polystyrenesulfonate (average molecular weight: 500,000) | 0.015 g |
| pH value of the coating liquid was 5.8 | |
| 2nd layer (Protective layer) | |
| Gelatin | 0.90 g |
| Dextran (weight average molecular weight: 65,000) | 0.20 g |
| Resorcinol | 0.15 g |
| 1-phenyl-4-methyl-4'-hydroxymethyl-3-pyrazolidone | 0.005 g |
| Nucleation accelerating agent Na | 0.20 g |
| Slipping agent S | 0.012 g |
| Germicide Z | 0.005 g |
| Sodium polyoxyethylenelaurylsulfonate | 0.010 g |
| Sodium dihexylsulfosuccinate | 0.015 g |
| Silica (average particle diameter: 5 $\mu$m) | 0.01 g |
| Silica (average particle diameter: 8 $\mu$m) | 0.015 g |
| Hardener (1) | 0.15 g |
| Backing Layer | |
| Gelatin | 1.8 g |
| F-1 | 0.080 g |
| F-2 | 0.050 g |
| F-3 | 0.020 g |
| Suspension of polymer of 75 weight-% of colloidal silica, 12.5 weight-% of vinyl acetate and 12.5 weight-% of vinyl pivarate | 0.7 g |
| Sodium polystyrenesulfonate | 0.010 g |
| Hardener (2) | 0.05 g |
| Backing protective layer | |
| Gelatin | 1.8 g |
| Matting agent: monodisperse poly(methyl methacrylate) having an average diameter of 3 $\mu$m | 0.045 g |
| Sodium polyoxyethylenelaulylethersulfonate | 0.005 g |
| Sodium dihexylsuccinate | 0.005 g |
| Hardener (1) | 0.15 g |

Hardener (1)

$(CH_2{=}CHSO_2CH_2CONHCH_2)_2$—

Hardener (2)

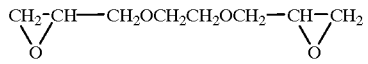

Germicide Z

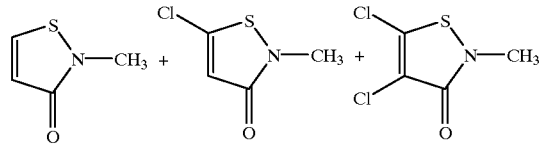

-continued
Nucleation accelerating agent Na
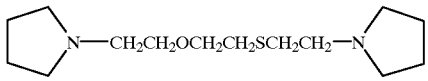
Slipping agent S
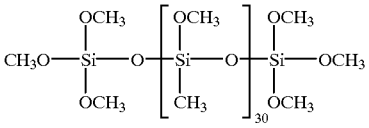
Water-soluble electric conductive polymer B
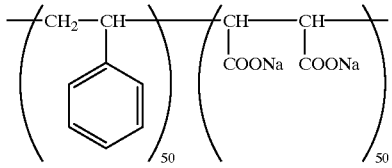
Hydrophobic polymer particle C
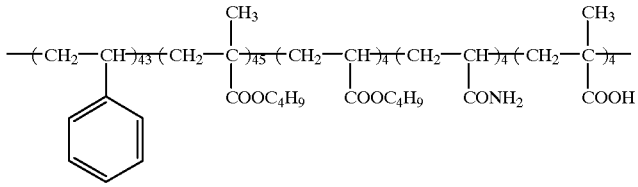
Hardener E
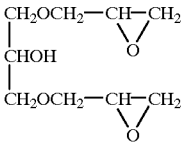
Surfactant A
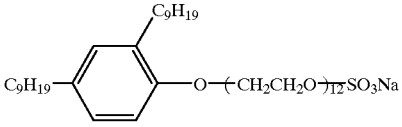
F-1
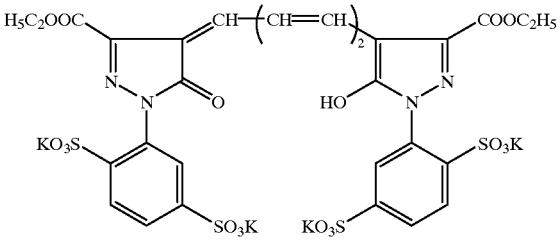
F-2

-continued

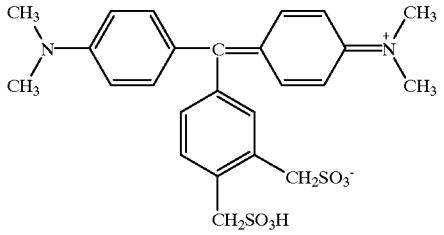

F-3

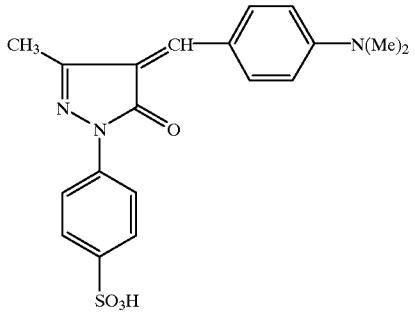

Developing solution

| | |
|---|---|
| Diethylenetriaminepentaacetic acid | 1 g |
| Sodium sulfite | 30 g |
| 1-phenyl-4-methyl-4'-hydroxymethyl-3-pyrazolidone | 1.5 g |
| Hydroquinone | 40 g |
| 1-phenyl-5-mercaptotetrazole | 0.025 g |
| Potassium bromide | 4 g |
| 5-methylbenzotriazole | 0.21 g |
| 2,5-dihydroxybenzoic acid | 5 g |
| 8-mercaptoadenine | 0.07 g |
| Potassium hydroxide | an amount necessary to adjust pH of the using solution to 9.8 |
| Water to make | 1 l |

Fixing solution

| | |
|---|---|
| Ammonium thiosulfate (59.5 w/v % aqueous solution) | 830 ml |
| Disodium ethylenediaminetetraacetate | 515 mg |
| Sodium sulfite | 63 g |
| Boric acid | 22.5 g |
| Acetic acid (90 w/v % aqueous solution) | 82 g |
| Citric acid (50 w/v % aqueous solution) | 15.7 g |
| Gluconic acid (50 w/v % aqueous solution) | 8.55 g |
| Aluminum sulfate (48% aqueous solution) | 13 ml |
| Glutaraldehyde | 3 g |
| Sulfuric acid | an amount necessary to adjust pH of the using solution to 4.6 |
| Water to make at the time of use to | 1 l |

Processing condition

| | Temperature | Processing time | Replenishing amount |
|---|---|---|---|
| Developing | 38° C. | 25 seconds | 130 ml/m$^2$ |
| Fixing | 37° C. | 25 seconds | 130 ml/m$^2$ |

-continued

| | | | |
|---|---|---|---|
| Washing | 5° C. | 15 seconds | — |
| Drying | 50° C. | 20 seconds | — |

The processing was performed by Automatic Processor LD-M1060, manufactured by Dainihon Screen Co., Ltd., which is modified by changing the squeezing roller provided between after the step of washing and before the step of drying to a roller exhibiting a contact angle shown in Table 1.

Measurement of Contact Angle

The contact angel was measured at 23° C. by a contact angle measuring apparatus CA-Z manufactured by Kyowa Kaimen Kagaku Co., Ltd.

Evaluation Method

The above-prepared black and white silver halide photographic light-sensitive material in Daizen size (24 inch×20 inch) was exposed to light so that 10% of the area of the light-sensitive material was blackened, and 500 sheets of the light-sensitive material were continuously processed. The dye stain and the roller mark formed on the unexposed area of the processed sheet was visually evaluated and classified into 5 ranks. The sample classified into Rank 2 or less was unacceptable for practical use. The sample classified into Rank 3 could be used practically even though a stain was apparently observed. On the sample classified into Rank 4, the stain could be observed only by a careful observation. On the sample classified into Rank 5, no stain was adhered. It is desired that the number of stained sheet is not more than 10 sheets per 500 sheets of the processed sample. It is particularly preferred that the number of stained sheet is not more than 5.

The color remaining was visually evaluated with respect to the unexposed area of processed sample, and the sample was classified into 5 ranks. The sample classified into Rank 2 or less was unacceptable for practical use. The sample classified into Rank 3 could be used practically even though a stain was apparently observed. On the sample classified into Rank 4, the stain could be observed only by a careful observation. On the sample classified into Rank 5, no color was observed.

The transportation ability was evaluated according to the number of sheets continuously output from the processor without catching in the processor, and classified as follows.

500 sheets: A 251 to 499 sheets: B 51 to 250 sheets: C 11 to 50 sheets: D 0 to 10 sheets: E Results of the evaluation are shown in Table 1.

TABLE 1

| | | | Evaulation result | | | |
|---|---|---|---|---|---|---|
| No. | Sensitizing dye No. | Contact angle of roller | Dye stein | Roller mark | Color remaining | Transportation ability |
| 1 | S-R1 | 80 | 2 | 3 | 1 | D |
| 2 | S-R2 | 120 | 1 | 2 | 1.5 | C |
| 3 | S-R1 | 40 | 2 | 1.5 | 1 | B |
| 4 | 1-9 | 95 | 1.5 | 2.5 | 3 | D |
| 5 | 5-9 | 150 | 1 | 2 | 3 | C |
| 6 | 2-7 | 40 | 4.5 | 4.5 | 4.5 | A |
| 7 | 3-8 | 55 | 5 | 4 | 4 | A |
| 8 | 3-12 | 10 | 4 | 5 | 4.5 | A |
| 9 | 4-8 | 30 | 5 | 4.5 | 5 | A |
| 10 | 5-15 | 40 | 5 | 4 | 4.5 | A |
| 11 | 6-4 | 45 | 4.5 | 5 | 5 | A |
| 12 | 6-24 | 15 | 4.5 | 5 | 5 | A |
| 13 | 1-9 | 30 | 4.5 | 4.5 | 5 | A |
| 14 | 5-9 | 15 | 5 | 4.5 | 4.5 | A |

S-R1

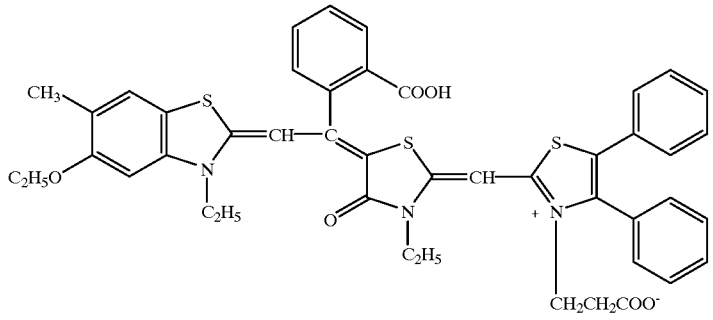

-continued

S-R2

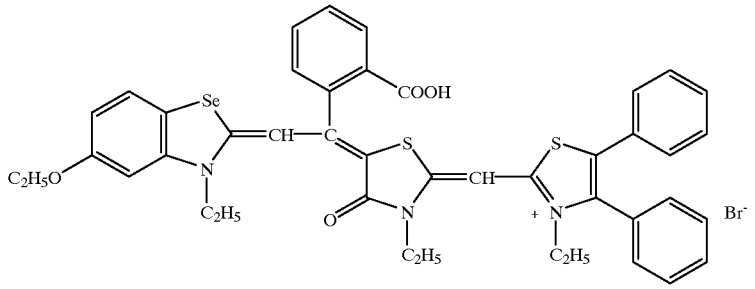

Example 2

The evaluation was carried out in the same manner as in Example 1 except that $4\times10^{-5}$ moles per mole of silver of the hydrazine compound described in Table 2 was added into the emulsion coating liquid of the light-sensitive material and the receipt of the developing solution and the processing condition were changed as follows.

Developing Solution

| | |
|---|---|
| Diethylenetriaminepentaacetic acid | 1 g |
| Sodium sulfite | 30 g |
| potassium carbonate | 95 g |
| 1-phenyl-4-methyl-4'-hydroxymethyl-3-pyrazolidone | 2.5 g |
| Sodium erythorbate monohydrate | 60 g |
| Potassium bromide | 4 g |
| Benzotriazole | 0.21 g |
| Potassium hydroquinonemonosulfonate | 10 g |
| 8-mercaptoadenine | 0.07 g |
| Potassium hydroxide | an amount necessary to adjust pH of the using solution to 10.0 |
| Water to make | 1 l |

Processing Condition

| | Temperature | Processing time | Replenishing amount |
|---|---|---|---|
| Developing | 38° C. | 15 seconds | 130 ml/m$^2$ |
| Fixing | 37° C. | 10 seconds | 130 ml/m$^2$ |
| Washing | 5° C. | 15 seconds | — |
| Drying | 50° C. | 10 seconds | — |

Results are Shown in Table 2

TABLE 2

| No. | Sensitizing dye No. | Hydrazine | Contact angle of roller | Evaluation result: Dye stein | Roller mark | Color remaining | Transportation ability |
|---|---|---|---|---|---|---|---|
| 1 | S-R1 | — | 40 | 1 | 1 | 2 | D |
| 2 | 3-8 | — | 80 | 1.5 | 2 | 2.5 | E |
| 3 | 1-9 | H-7 | 95 | 2 | 1.5 | 2 | C |
| 4 | 3-12 | H-34 | 120 | 2 | 1 | 1.5 | B |
| 5 | 6-40 | H-11 | 105 | 1 | 1.5 | 2 | C |
| 6 | 5-15 | H-11 | 55 | 4.5 | 4 | 4 | A |
| 7 | 5-15 | H-34 | 40 | 4 | 4.5 | 5 | A |
| 8 | 5-15 | H-34 | 15 | 5 | 5 | 4.5 | A |

TABLE 2-continued

| No. | Sensitizing dye No. | Hydrazine | Contact angle of roller | Evaluation result: Dye stein | Roller mark | Color remaining | Transportation ability |
|---|---|---|---|---|---|---|---|
| 9 | 5-15 | H-39 | 45 | 4.5 | 4.5 | 5 | A |
| 10 | 5-15 | H-39 | 10 | 5 | 5 | 4.5 | A |
| 11 | 6-24 | H-42 | 20 | 4.5 | 5 | 4 | A |
| 12 | 6-24 | H-45 | 30 | 5 | 4 | 5 | A |

Example 3

The evaluation was carried out in the same manner as in Example 2 except that the composition of the fixing solution was changed according to the following formula and, in addition to the squeezing roller, the ratio (expressed in %) of the area of EPDM exhibiting a contact angle with water of 20° the total surface area of all of the roller arranged in the transport rack in the drying zone of the processor was changed as shown in Table 3.

Fixing Solution FA-1

| | |
|---|---|
| Ammonium thiosulfate | 200 g |
| Sodium sulfite | 15 g |
| Sodium metabisulfate | 25 g |
| Citric acid | 5 g |
| Aluminum sulfate 18 · $H_2O$ | 15 g |
| Boric acid | 12 g |
| KOH | an amount necessary to adjust pH value to 4.7 |
| Water to make at the time of use to | 1 l |

Fixing solution FA-2

| | |
|---|---|
| Ammonium thiosulfate | 180 g |
| Sodium sulfite | 15 g |
| Sodium metabisulfate | 5 g |
| Citric acid | 5 g |
| DTPA · 5H | 5 g |
| N-acetylpenicillamine | 0.5 g |
| KOH | an amount necessary to adjust pH value to 5.8 |
| Water to make at the time of use to | 1 l |

Results are shown in Table 3.

TABLE 3

| No. | Sensitizing dye No. | Hydrazine | Fixing solution | EPDM (%) | Evaluation result: Dye stein | Roller mark | Color remaining | Transportation ability |
|---|---|---|---|---|---|---|---|---|
| 1 | S-R1 | — | FA-1 | 20 | 2 | 3 | 1 | C |
| 2 | S-R1 | — | FA-1 | 90 | 2.5 | 1.5 | 1.5 | E |
| 3 | 6-24 | H-34 | FA-2 | 85 | 4 | 4.5 | 4.5 | A |
| 4 | 6-24 | H-34 | FA-2 | 100 | 4.5 | 4 | 5 | A |
| 5 | 6-24 | H-34 | FA-2 | 90 | 5 | 5 | 5 | A |
| 6 | 6-24 | H-34 | FA-2 | 90 | 4.5 | 4.5 | 4.5 | A |
| 7 | 6-24 | H-38 | FA-2 | 100 | 5 | 5 | 5 | A |
| 8 | 6-24 | H-38 | FA-2 | 85 | 4 | 4.5 | 4.5 | A |

Example 4

Experiments were carried out in the same manner as in Example 3 except that the replenishing amounts of developing solution and fixing solution were changed to 80 ml, the amount of hardener (1) in the light-sensitive material was controlled so that the total moisture contents in the emulsion side and the backing side just after passing the squeezing roller arranged between the finishing of the washing process and the starting of the drying process was as shown in Table 4, and the ratio of EPDM was fixed at 80%.

Results are shown in Table 4.

TABLE 4

| No. | Sensitizing dye No. | Moisture content in film ($g/m^2$) | Evaulation result: Dye stein | Roller mark | Color remaining | Transportation ability |
|---|---|---|---|---|---|---|
| 1 | S-R2 | 28 | 5 | 2 | 3 | E |
| 2 | 2-1 | 15 | 4 | 4.5 | 4 | A |
| 3 | 2-1 | 10 | 5 | 4 | 4.5 | A |
| 4 | 2-1 | 14 | 4.5 | 5 | 5 | A |
| 5 | 2-1 | 12 | 5 | 4.5 | 4.5 | A |
| 6 | 2-1 | 8 | 4.5 | 5 | 5 | A |

Example 5

Evaluation were carried out in the same manner as in Example 3 except that the replenishing amounts of the developing solution and the fixing solution were each 80 ml per square meter of the silver halide photographic light-sensitive material, and the ratio of (Moisture content just after passing)/(Moisture content before passing) was changed by controlling the pressure of the squeezing roller was changed. Thus results are shown in Table 5.

TABLE 5

| No. | Sensitizing dye No. | d (moisture content) | Evaulation result: Dye Stain | Roller mark | Color remaining | Transportion ability |
|---|---|---|---|---|---|---|
| 1 | 1-15 | 75% | 4.5 | 5 | 4.5 | A |

[Effects of the Invention]

The problems of occurrence of stain, color remaining, unsuitable transportation and roller mark are prevented by the invention even when the light-sensitive material exposed by an image-setter is subjected to a rapid processing.

Disclosed embodiments can be varied by a skilled person without departing from the spirit and scope of the invention.

What is claimed is:

1. A method for processing a silver halide photographic light sensitive material in an automatic processor, the method comprising the steps of:

(a) developing an exposed silver halide photographic light sensitive material with a developing solution, (b) fixing the developed silver halide photographic material with a fixing solution, (c) washing the fixed silver halide photographic material with water, and (d) drying the washed silver halide photographic material, wherein the silver halide photographic material exhibits an absorption maximum at a wavelength of 600 to 800 nm; the automatic processor comprises at least a roller provided after completing the step of washing, the roller is brought into contact with the silver halide photographic material, and the surface of the roller is covered with a material exhibiting a contact angle with water(θ) within a range of $0°<\theta<60°$.

2. The processing method of claim 1, wherein the silver halide photographic material comprises a sensitizing dye represented by the following formulas (1) to (6):

Formula (1)

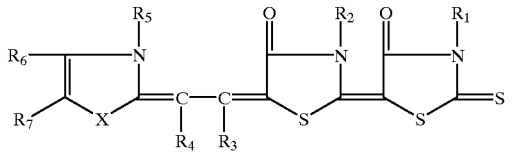

wherein X is —O—, —S— or —Se—; $R_1$, $R_2$, $R_3$, $R_4$ and $R_5$ are each an organic group and at least two of $R_1$, $R_2$, $R_3$, $R_4$ and $R_5$, each has a water-solubilizing group, provided that $R_3$ and $R_4$ are not organic groups having a water-solubilizing group at the same time, and $R_1$, $R_2$, $R_3$, $R_4$ and $R_5$ are each a hydrogen atom, an alkyl group, an alkenyl group or an aryl group when the group is not the group having the water-soluble group; $R_6$ and $R_7$ are each a hydrogen atom, hydroxyl, a halogen atom, carboxyl, cyano, an alkyl group, an alkenyl group, an alkynyl group, an alkoxyl group, an alkylthio group, an arylthio group, an aryl group, an acyl group, an acyloxy group, an alkoxycarbonyl group, an alkylsulfonyl group, a carbamoyl group or a sulfamoyl group, the groups represented by $R_6$ or $R_7$ each may have a substituent, and $R_6$ and $R_7$ may be bonded together to form a ring;

Formula (2)

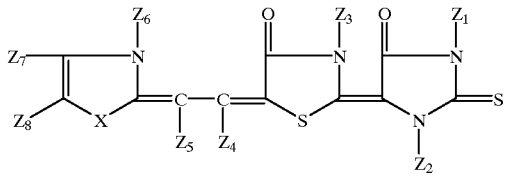

wherein Y is —O—, —S—or —$S_e$—; $Z_1$, $Z_2$, $Z_3$, $Z_4$, $Z_5$ and $Z_6$ are each an organic group and at least two of $Z_1$, $Z_2$, $Z_3$, $Z_4$, $Z_5$ and $Z_6$ each has a water-solubilizing group, provided that $Z_4$ and $Z_5$ are not organic groups having a water-solubilizing group at the same time, the organic group represented by $Z_1$, $Z_2$, $Z_3$, $Z_4$, $Z_5$ or $Z_6$ is a hydrogen atom, an alkyl group, an alkenyl group or an aryl group when the organic group is not a group having a water-solubilizing group; and $Z_7$ and $Z_8$ are the same as $R_6$ and $R_7$ defined in Formula (1);

Formula (3)

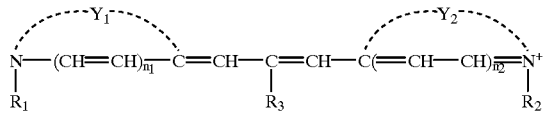

$(X_1^-)m_1$ wherein $Y_1$ and $Y_2$ are each a group of non-metal atom necessary to form a benzothiazole ring, a benzoselenazole ring, a naphthothiazole ring, a naphthoselenazole ring or a quinoline ring, these heterocyclic rings each may be substituted with a lower alkyl group, an alkoxyl group, an aryl group, a hydroxyl group, an alkoxycarbonyl group or a halogen atom; $R_1$ and $R_2$ are each a lower alkyl group, an alkyl group having a sulfo group or an alkyl group having a carboxyl group; $R_3$ is a methyl group, an ethyl group or a propyl group, $X_1$ is an anion, $n_1$ and $n_2$ are each 1 or 2, $m_1$ is 1 or 0, and l is 1 or 0;

Formula (4)

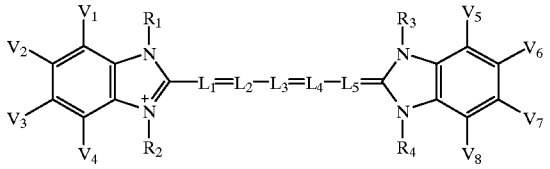

$(M_1)_l$ wherein $R_1$, $R_2$, $R_3$ and $R_4$ are each a substituted or unsubstituted aliphatic group and at least one of $R_2$ and $R_4$ has a water-solubilizing group; $V_1$, $V_2$, $V_3$, $V_4$, $V_5$, $V_6$, $V_7$ and $V_8$ are each a hydrogen atom or a substituent, $V_1$ and $V_2$, $V_2$ and $V_3$, $V_3$ and $V_4$, $V_4$ and $V_5$, $V_5$ and $V_6$, $V_6$ and $V_7$, and $V_7$ and $V_8$ each may be condensed to form a ring, the sum of Hammett's values $\sigma_p$ of $V_1$ to $V_4$, and that of $V_5$ to $V_8$ are each not less than 0.12; $L_1$, $L_2$, $L_3$, $L_4$ and $L_5$ are each a methine group; $M_1$ is an ion necessary to neutralize the intramolecular charge, and is a number of ion necessary to neutralize the charge;

Formula (5)

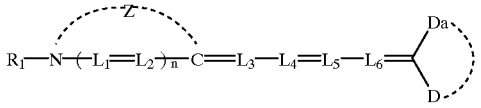

$(M_1)m_1$ wherein $R_1$ is a substituted or unsubstituted alkyl group; Z is a group of atoms necessary to form a 5- or 6-member nitrogen-containing heterocyclic ring; D and Da is a group of atoms necessary to form an acyclic or cyclic acidic nucleus; $L_1$, $L_2$, $L_3$, $L_4$, $L_5$ and $L_6$ is a methine group; $M_1$ is a counter ion necessary to neutralize the intramolecular charge, $m_1$ is a number of 0 or more necessary to neutralize the intramolecular charge, and n is 0 or 1;

Formula (6)

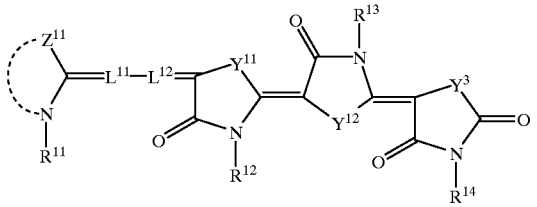

$(M^{11})n^{11}$ wherein $Y^{11}$, $Y^{12}$ and $Y^{13}$ are each —N($R^{10}$)—, an oxygen atom, a sulfur atom, a selenium atom or a tellurium atom; $R^{11}$ is an aliphatic group having 8 or less carbon atoms and having a water-solubilizing group; $R^{10}$, $R^{12}$, $R^{13}$ and $R^{14}$ are each an aliphatic group, an aryl group or a heterocyclic group and at least three of them are substituted with a water-solubilizing group; $Z^{11}$ is a group of non-metal atoms necessary to form a 5- or 6-member nitrogen-containing heterocyclic ring, which may be condensed; $L^{11}$ and $L^{12}$ are each independently a substituted or unsubstituted methine group; $M^{11}$ is an ion necessary to neutralize the total intramolecular charge and $n^{11}$ is the number of ion necessary to neutralize the charge.

3. The processing method of claim 1, wherein the roller is provided between after completion of the step of washing and before start of the step of drying.

4. The processing method of claim 1, wherein the roller is a squeezing roller to squeeze washing water adhered to or penetrated into the silver halide photographic material.

5. The processing method of claim 1, wherein the roller is at least one of two opposed rollers, which is covered with a material exhibiting a contact angle with water (θ) within a range of $0°<\theta<60°$.

6. The processing method of claim 5, wherein the silver halide photographic material comprises a support and a silver halide emulsion layer containing silver halide grains and provided on at least one side of the support, and the roller is brought into contact with the emulsion layer side of the silver halide photographic material.

7. The processing method of claim 5, wherein the opposed rollers each are covered with a material exhibiting a contact angle with water (θ) within a range of $0°<\theta<60°$.

8. The processing method of claim 1, wherein the silver halide photographic material comprises a hydrazine compound represented by the following formula (H):

Formula (H)

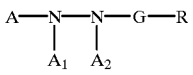

wherein A is an aryl group or a heterocyclic group containing a sulfur atom or an oxygen atom; G is —$(CO)_n$—, a sulfonyl group, a sulfoxy group, —P(=O)$R_{52}$— or an iminomethylene group, in which n is an integer of 1 or 2, and $R_{52}$ is an alkyl group, an alkenyl group, an alkynyl group, an aryl group, an alkoxyl group, an alkenyloxy group, an alkynyloxy group, an aryloxy group or an amino group, the groups represented by $R_{52}$ each may have a substituent; both of $A_1$ and $A_2$ are each a hydrogen atom or one of them is a hydrogen atom and the other one is a substituted or unsubstituted alkylsulfonyl group or a substituted or unsubstituted acyl group; R is a hydrogen atom, an alkyl group, an alkenyl group, an aryl group, an alkoxy group, an alkenyloxy group, an aryloxy group, a heterocyclicoxy group, an amino group, a carbamoyl group, or an oxycarbonyl group, and the group represented by R may have a substituent.

9. The processing method of claim 1, wherein the steps of developing to drying are completed within a time of 15 to 60 sec.

10. The processing method of claim 3, wherein one or more rollers are provided in the step of drying and an initial roller thereof is brought into contact with the silver halide photographic material, and the surface of the initial roller is covered with a material exhibiting a contact angle with water (θ) within a range of $0° < \theta < 60°$.

11. The processing method of claim 3, wherein one or more rollers are provided in the step of drying and at least 80% of the surface of each roller is covered with a material exhibiting a contact angle with water (θ) within a range of $0° < \theta < 60°$.

12. The processing method of claim 1, wherein the fixing solution is substantially free of an aluminum compound.

13. The processing method of claim 1, wherein the moisture content of the silver halide photographic material at the time immediately after completion of the step of washing is not more than 18 $g/m^2$.

14. The processing method of claim 13, wherein the moisture content of the silver halide photographic material at the time immediately after passing through the roller is at least 50% by weight, based on the moisture content at the time immediately after completion of the step of washing.

15. The processing method of claim 1, wherein the processor comprises an auxiliary roller which is brought into contact with the roller described in 1 and is not brought into contact with the silver halide photographic material.

16. The processing method of claim 1, wherein the silver halide photographic material is transported at a speed of 400 to 3,000 mm/min.

* * * * *